US009002184B2

(12) United States Patent
Graibus et al.

(10) Patent No.: US 9,002,184 B2
(45) Date of Patent: Apr. 7, 2015

(54) METHODS FOR SUPER HEATED STEAM GENERATION

(71) Applicant: Trimeteor Oil and Gas Corporation, Las Vegas, NV (US)

(72) Inventors: Richard B Graibus, Las Vegas, NV (US); Jimmy L Turner, Las Vegas, NV (US); Charles T McCullough, Las Vegas, NV (US); Dennis K Williams, Houston, TX (US); Edward L Sulitis, Pahrump, NV (US)

(73) Assignee: Trimeteor Oil and Gas Corporation, Las Vegas, NV (US)

( * ) Notice: Subject to any disclaimer, the term of this patent is extended or adjusted under 35 U.S.C. 154(b) by 316 days.

(21) Appl. No.: 13/684,349

(22) Filed: Nov. 23, 2012

(65) Prior Publication Data

US 2013/0136435 A1 May 30, 2013

Related U.S. Application Data

(60) Provisional application No. 61/629,802, filed on Nov. 28, 2011.

(51) Int. Cl.

| | |
|---|---|
| ***F22B 1/28*** | (2006.01) |
| ***F22B 27/14*** | (2006.01) |
| ***F22D 5/26*** | (2006.01) |
| ***F22G 5/20*** | (2006.01) |
| ***F22B 27/04*** | (2006.01) |
| ***F22B 35/10*** | (2006.01) |
| ***F22D 1/00*** | (2006.01) |
| ***F22G 1/06*** | (2006.01) |

(Continued)

(52) U.S. Cl.

CPC ..... *F22B 1/285* (2013.01); *F22B 1/287* (2013.01); *F22B 27/14* (2013.01); *F22D 5/26* (2013.01); *F22G 5/20* (2013.01); *F22B 27/04* (2013.01); *F22B 35/104* (2013.01); *F22D 1/003* (2013.01); *F22G 1/06* (2013.01); *F22G 5/00* (2013.01); *F22B 35/005* (2013.01)

(58) Field of Classification Search

None

See application file for complete search history.

(56) References Cited

U.S. PATENT DOCUMENTS 213,556 A * 3/1879 Everding ..... 122/40
613,562 A * 11/1898 Dressel ..... 362/169

(Continued)

OTHER PUBLICATIONS http://www.asme.org/kb/standards/bpvc-resources/boiler-and-pressure-vessel-code—2010-edition.

*Primary Examiner* — Thor Campbell

(74) *Attorney, Agent, or Firm* — Stephen D. Carver

(57) ABSTRACT

Modularized, superheated steam generators comprise a steam module (46), a thermocouple module (41), and an electrode module (45) assembled within a containment enclosure (66). The multi-stage steam module (46) comprises a plurality of first stage pressure vessels (77) surrounding and feeding a second stage pressure vessel (78). The steam module (46) is coaxially surrounded by insulation (48) disposed within a cylindrical shroud (72). The electrode module (45) radiantly heats the steam module with resistive heating elements (119). The thermocouple module (41) includes thermocouples monitoring first stage temperatures within and between pressure vessels (77). PLC computer SCADA software (600) operates the generators. Thermocouple data is analyzed to control heater temperatures, the water feeding system (340), and outputted steam temperature. PLC software (600) provides operating logic (602) establishing a start up subroutine (602), a ramp up subroutine (603), a steady state subroutine (605), and a shut down subroutine (606).

37 Claims, 41 Drawing Sheets

(51) Int. Cl.
*F22G 5/00* (2006.01)
*F22B 35/00* (2006.01)

(56) References Cited

U.S. PATENT DOCUMENTS

| | | | | | |
|---|---|---|---|---|---|
| 734,871 | A | * | 7/1903 | Hopwood | 122/40 |
| 1,646,912 | A | * | 10/1927 | Hodshon | 392/397 |
| 1,753,522 | A | * | 4/1930 | Larsen | 165/118 |
| 1,949,182 | A | * | 2/1934 | Roberts | 239/110 |
| 2,606,272 | A | * | 8/1952 | Platt | 392/396 |
| 3,243,575 | A | * | 3/1966 | Vignere, Sr. | 392/399 |
| 3,419,666 | A | * | 12/1968 | Groom | 373/109 |
| 3,683,866 | A | * | 8/1972 | Zmola | 122/32 |
| 4,357,908 | A | * | 11/1982 | Yazidjian | 122/32 |
| 4,398,603 | A | * | 8/1983 | Rodwell | 166/267 |
| 4,408,116 | A | * | 10/1983 | Turner | 392/399 |
| 4,445,568 | A | * | 5/1984 | Nguyen-Thanh | 165/81 |
| 4,582,480 | A | * | 4/1986 | Lynch et al. | 432/1 |
| 4,668,854 | A | * | 5/1987 | Swan | 392/399 |
| 4,744,160 | A | * | 5/1988 | Elliott et al. | 38/15 |
| 5,142,608 | A | * | 8/1992 | Meshekow | 392/303 |
| 5,858,304 | A | * | 1/1999 | Breach | 422/26 |
| 5,949,958 | A | * | 9/1999 | Naperkowski et al. | 392/399 |
| 6,094,523 | A | * | 7/2000 | Zelina et al. | 392/399 |
| 6,095,098 | A | * | 8/2000 | Beal et al. | 122/448.1 |
| 6,129,148 | A | * | 10/2000 | Meeks | 166/263 |
| 6,488,219 | B1 | * | 12/2002 | Herr | 239/533.13 |
| 7,031,601 | B2 | * | 4/2006 | Zheng | 392/394 |
| 7,092,519 | B1 | * | 8/2006 | Lindholm | 379/419 |
| 8,042,498 | B2 | * | 10/2011 | Hirayama et al. | 122/476 |
| 8,865,087 | B2 | * | 10/2014 | Buczynski | 422/292 |
| 2006/0057021 | A1 | * | 3/2006 | Sawyer et al. | 422/26 |
| 2009/0159591 | A1 | * | 6/2009 | Tomita et al. | 219/628 |
| 2011/0116775 | A1 | * | 5/2011 | Turner et al. | 392/399 |
| 2014/0301723 | A1 | * | 10/2014 | Masuda et al. | 392/398 |

* cited by examiner

| | Steam Genie | Nuclear Plant | Subcritical Boiler | Super Heated S.G. |
|---|---|---|---|---|
| Saturation Temperature | 358 | 537 | 637 | 286 |
| Degrees of Superheat | 0 | 33 | 369 | 914 |

METHODS FOR SUPER HEATED STEAM GENERATION

CROSS-REFERENCE TO RELATED APPLICATION

This application is based upon prior U.S. Provisional Patent Application Ser. No. 61/629,802, Filed Nov. 28, 2011, entitled "High Power Method and Apparatus for Generating Super Heated Steam," by inventors Richard B. Graibus, Charles T. McCullough, Edward L. Sulitis, and Jimmy L. Turner, and priority based upon said prior application is claimed.

BACKGROUND OF THE INVENTION

1. Field of the Invention

The present invention relates generally to high temperature, superheated steam generators for use in recovering crude oil of low specific gravity, the enhancement of reservoir drive, and deparrafinization. More particularly, the present invention relates to enhanced, computer controlled, high-powered superheated steam generators for producing superheated steam.

2. Description of the Related Art

It has long been recognized in the art that, when the natural drive energy of an oil reservoir or well decreases over time, natural internal pressure is inadequate to push oil to the surface. As reservoir pressure decreases over time, artificial lift will be required to achieve sufficient production. Various artificial lift processes are commonly used to increase reservoir pressure and to force oil to the surface at some time during the production life of a well.

Pumping and gas injection techniques are the two primary methods of inducing of artificial lift in wells. Beam pumping engages equipment on and below the surface to increase pressure and lift oil to the surface. Beam pumps, consisting of a sucker rod string and a sucker rod pump, are exemplified by the common "jack pumps" that are frequently employed with on-land oil wells.

Beam pumping systems rock back and forth, reciprocating a string of sucker rods, which plunge down into the wellbore. The sucker rods are connected to the sucker rod pump, which is installed as a part of the tubing string near the bottom of the well. The beam pumping system rocks back and forth to operate the rod string, sucker rod and sucker rod pump. The sucker rod pump lifts the oil from the reservoir through the well to the surface. Artificial lift pumping can also be accomplished with a downhole hydraulic pump, rather than sucker rods, or with electric submersible pump systems deployed at the bottom of the tubing string.

Artificial lift systems can employ gas injection to reestablish pressure, encouraging a well to produce. Injected gas reduces the pressure on the bottom of the well by decreasing the viscosity of the fluids, which causes fluids to flow more easily. Typically, the gas that is injected is recycled with fluids produced from the well. As the gas enters the tubing at these different stages, it forms bubbles, reduces the reservoir fluid viscosity, and lowers the pressure.

Superheated steam is ideal for gas injection. It is well known in the art to inject high temperature steam within wells to decrease the viscosity of heavy crude oils and to increase temperature, facilitating subsequent pumping and recovery. Injected steam at temperatures at or above the saturation temperature warms the well bore, heating the piping, the casings, and the surrounding environment. Injected steam must not only be of sufficient temperature and pressure to properly liquefy targeted crude oil within the well, but a sufficient volume of such steam is required during the injection process for success. Because of the relationship between temperature, volume and pressure, prior art stream generators have been limited in producing large volumes of steam because of the resultant variance in other steam parameters.

Steam generators for supplying superheated steam are known in the art. For example, U.S. Pat. No. 4,408,116 issued to Turner on Oct. 4, 1983 discloses a superheated steam generator with dual heating stages. A more recent steam generator design is illustrated in our prior pending application entitled "Super Heated Steam Generator With Slack Accommodating Heating Tanks," filed Nov. 15, 2009, Ser. No. 12/590,919, that is owned by the same assignee as in this case, the disclosure of which is hereby incorporated by reference.

There are currently several different types of steam injection technology for oil recovery. The two primary, prior art methods are "Cyclic Steam Stimulation" and "Steam Flooding." The "Cyclic Steam Stimulation" method, also known as the "Huff and Puff" method, consists of injection, soaking, and production stages. Steam is first injected to heat the oil in the reservoir to raise the temperature and lower the oil viscosity, thereby enhancing fluid flow. Injected steam may be left in the well for periods of time for soaking and diffusion of the steam into the well environment. Subsequently, oil is extracted from the treated well, at first by natural flow (since the steam injection will have increased the reservoir pressure) and then by artificial lift. Production decreases as the oil/steam mixture cools, necessitating repetition of the steam injection steps. The "huff and puff" method thus injects steam in periodic cycles, applying periodic "puffs" of steam between periodic soaking periods, during which the steam generator apparatus recharges and accumulates another volume of steam for subsequent injection. The "huff and puff" process is most effective in the first few steam cycles. However, it is typically only able to recover approximately twenty-percent of the Original Oil in Place (OOIP), compared to steam flooding, which has been reported to recover over fifty-percent of OOIP.

Steam flooding usually involves multiple wells. Oil production wells are complimented by separate steam injection wells. Two mechanisms are at work to improve the amount of oil recovered. The first is to heat the oil to higher temperatures and to thereby decrease its viscosity so that it flows more easily through the formation toward the producing wells. A second mechanism is the physical displacement occurring in a manner similar to water flooding, in which oil is pushed to the production wells. While more steam is needed for this method than for cyclic steam simulation methods, it is typically more effective at recovering a larger portion of the oil.

One form of steam flooding termed "steam assisted gravity drainage", abbreviated "SAGD," utilizes multiple, spaced apart, horizontal wells. Steam is injected into an upper SAGD well in an effort to reduce the viscosity of the oil deposits to the point where gravity will pull the oil into the producing well.

However, it has become evident to us that, for maximum crude oil recovery efficiency, superheated steam can be injected concurrently with an extraction operation in a single well. In this manner, time delays are avoided, and additional energy is available through the large number of degrees of superheat (defined as the difference between the actual steam temperature and the saturation temperature at the delivery pressure). The requirement of supplemental wells is obviated.

A variety of steam generators and associated steam injection techniques have been proposed. A recognized difficulty in the art relates to the generation of superheated steam at proper temperatures, pressures, and volumes. Injected steam must not only be of sufficient temperature to properly liquefy targeted crude oil within the well, but a sufficient volume of such steam is required during the injection process for success.

Previously it has been known in the art to provide a steam heater with an internal tank positioned coaxially within an outer shroud. It is known to use electric heating elements surrounded by lead disposed between a peripheral enclosure and an internal evaporator tank. As the lead heats and melts from the heating elements, heat is transferred by conduction. Molten metal (i.e., lead) surrounding each evaporator tank transfers heat to it by conduction. This basic construction is shown in Mexican patent No. 97201, issued November 1968. However, with the latter device, steam output temperatures vary widely, and critical operating parameters including tank and water temperature, output pressure and output volume are not dynamically controlled. Liquid levels within various tanks can vary constantly, resulting in irregular vaporization. Temperature fluctuations of between 400° and 600° F. were experienced, compromising operating the efficiency of the steam generation system. Steam generators with multiple stages for enhancing crude oil recovery are known in the art. For example, U.S. Pat. No. 4,408,116 issued to Turner on Oct. 4, 1983 discloses a superheated steam generator with dual heating stages. The latter design employs a plurality of radially spaced-apart first stage heaters that surround a central second stage heater. Water is supplied to each of the first stage heaters via interior feed tubes. A rigid, tubular sheath coaxially surrounds and protects each of the last mentioned tubes, and defines a steam output annulus between the sheath and the mouth of each first stage tank. Steam from the first stage tanks or pressure vessels is transmitted to the second stage pressure vessel by a plurality of conduits extending from first stage to a central manifold feeding an encircled second stage tank. Again, heat transfer between the heating elements and the evaporator tanks is primarily effectuated by conduction. Experiments have continued over the years with apparatus constructed in accordance with prior U.S. Pat. No. 4,408,116 mentioned above. As the price of crude oil increases, more and more efforts have been undertaken to recover deposits from marginal domestic wells. However, one common weakness in prior devices has been the inability to reliably and virtually continuously generate and deliver a large volume of high temperature, superheated steam. One problem has been experienced with the electrodes used to heat internal vaporization or evaporation tanks, and with other critical components. Wide temperature variations are encountered in use. Prior to energization, for example, the component temperature is that of the environment, i.e., ambient temperature. After heating commences, a temperature rise in excess of 1000° F. occurs. Because of the resultant thermal expansion of the metal components, and the various different coefficients of expansion that characterize parts of different construction materials, extreme stresses occur, as the dimensions of critical parts expand during heat-up. Most disturbingly, failures associated with such mechanisms as creep and creep fatigue occur over time in threaded pipe fittings employed with steam machines of the type described in the latter patent.

The stress problem has caused component failure in the past, necessitating time consuming and expensive field repairs. For example, because of the traditional mounting techniques used for high temperature tanks that are bathed within liquid lead during operation, component failures have been frequent. One recurrent problem, for example, has been burn-out or failure of critical electrical heating elements disposed within each heater assembly. These problems have been aggravated by the prior art use of liquid lead as a heat distribution medium or thermal mass. The configuration of internal parts such as the electrode heater elements, and the lack of precision, militate against proper dynamic control of operating points necessitated by manual operation.

In our prior pending U.S. application entitled "Super Heated Steam Generator With Slack Accommodating Heating Tanks," filed Nov. 15, 2009, Ser. No. 12/590,919, which is owned by the same assignee as in this case, a partial solution was proposed. For example, new electrode configurations, combined with a flexible tank mounting arrangement that accommodates thermal expansion and component shifting was proposed. After substantial field tests of the apparatus described in the aforementioned application, it has been concluded that the use of liquid lead for heat transfer is a fundamental problem. Moreover, reliance upon thermal conduction as a heat transfer mechanism appears to be a flawed approach, when compared to the other methods of heat transfer that may be available, such as convention and radiation heat transfer modes.

For example, when service is required to repair an internal component such as an electrode, the entire unit must first be allowed to cool to a temperature safe for repairs. When the unit is later opened for service, the technician encounters irregularly shaped formations of solid lead. Critical parts that must be removed are often partially captivated in the solid, unwieldy mass of cooled lead. Even worse, when component failure or breakage leads to a crack or the formation of pin holes, molten lead may leak from the tanks or pressure vessels. The repair technician is thus faced with a time consuming job requiring substantial lead clean-up. Solid lead waste is tedious to remove, requiring blow torches and the liberal use of protective gear and clothing. The environmentally proper disposal of lead waste is difficult as well.

Accordingly, it is suggested that inner pressure vessels within heating vessels should not be heated primarily by conduction phenomena, but rather by radiation. Heating elements must be arranged proximate the pressure vessels to provide adequate heat via radiation heat transfer, without overheating or burnout.

Thus, with a radiant heating design, to reach operating temperatures approximating 1200° F., the water and steam injection pathways must be dynamically controlled. While various prior art steam injection heaters have utilized piping arrangements establishing fluid flow in heat exchange relation, an adequate high temperature, superheated steam injection system must employ water control apparatus that minimized fluid-blocking back-pressures that are characteristic of prior art designs. Most importantly, it has been found that fluid flow paths must be continuously monitored and dynamically varied in response to sensed operating parameters. Temperatures within each pressure vessel must be continuously controlled. Thus, for example, water flow can be computer-sensed and computer-controlled to moderate operating temperatures while achieving proper output volumes. Simple, manually operated valves in water control pathways, for example, are insufficient as they are unable to respond in real time to dynamic operating conditions. Means must be provided for monitoring temperatures associated with the pressure vessels at judiciously spaced locations within the modules, and to respond to varying temperature gradients within the steam system. Water flow and electrode heater power must be coordinated with observed temperatures and pressures.

Further, dynamic operating parameters must be varied according to differing conditions experienced during different stages of operation. Recognizable phases of steam generator operation can be broadly classified into "start-up,"

"ramp-up," "steady state" and "shut down" phases, each of which requires different operational parameters. In other words, it has been determined that optimal operating conditions vary depending upon the stage of operation, and parameter correction is required. Thus a computer-controlled, dynamically monitored system is necessary for optimizing critical operational parameters during enhanced, superheated steam generator operation.

BRIEF SUMMARY OF THE INVENTION

The present invention comprises modularized, superheated steam generators for outputting steam to wells for enhancing oil extraction. The preferred generators comprise multiple, pressure vessels that produce steam through radiant heating.

High power and reduced power designs are described. In both embodiments major components are housed within an upright, generally cylindrical containment enclosure. Preferably, the steam generators are modularized, comprising separate steam modules, electrode heater modules, and thermocouple modules, all stacked within the containment enclosure. In both embodiments a unibody, steam module seats within a rigid shroud supported upon the containment enclosure. Each steam module comprises a plurality of separate, interconnected pressure vessels, forming first and second stages. Preferably, the steam module comprises a plurality of first stage pressure vessels that surround and feed a second stage pressure vessel at the center of the steam module. Various electrically resistive heating elements activate the pressure vessels through radiant heating.

The first stage pressure vessels deliver steam into an adjacent, second stage pressure vessel through a plurality of, arcuate conduits. Unlike the prior art, each first stage pressure vessel is fed water through its bottom head. Superheated steam generated in the second stage pressure vessel is outputted from the second stage vessel bottom. Our new designs obviate the use of threaded pipe fittings, threaded ninety degree elbows, bends, and pressure manifolds.

In each embodiment, a computer-controlled liquid feed system controls water flow to the steam module. Preferably, source water is preconditioned to remove mineral deposits and the like, to reduce scaling or mineral deposits. In the best mode, water softening apparatus and a chlorine filter precede a reverse osmosis water pretreatment system that provides treated source water to the steam module.

In the high power embodiment, an electrode module interfits with the steam module within the containment enclosure to heat all of the pressure vessels. Individual first and second stage pressure vessels in the preferred high power embodiment are not thermodynamically isolated from one another. Preferably an electrode module is suspended from a header plate disposed above the containment enclosure base. The electrode module comprises several electrically resistive, silicon-carbide heating elements that effectuate radiant heating of the steam module. The silicon carbide heating elements are preferably disposed within generally cylindrical patterns that substantially surround each pressure vessel. In the best mode, groups of heating elements proximate three pairs of first stage pressure vessels are arranged into three electrical zones, with the silicon carbide heating elements disposed closest to the second stage pressure vessel forming a fourth stage electrical zone. In assembly, the electrode module is dropped into place over the steam module, to dispose various silicon carbide heating elements adjacent each first stage and second stage pressure vessel. To minimize heat loss, numerous insulation packets are strategically placed within the containment enclosure.

In the lower power embodiment, the individual pressure vessels in the steam module are received by and housed within separate, heated canisters that externally isolate each pressure vessel from one another. Each canister comprises internal, coiled electrodes that surround and heat the enclosed pressure vessel through radiant heating. Electrode interconnections may be suspended from a header plate above the containment enclosure. Preferably, the coiled electrodes in each first stage canister are electrically arranged into six zones, with the electrode disposed in the second stage canister forming a seventh stage electrical zone. Optionally, with the low power embodiment, an eighth zone may be formed by an electrically resistive heater disposed above the pressure vessels within the containment enclosure for supplemental heating. Again, numerous insulation packets are fitted within the containment enclosure.

Each embodiment includes several thermocouples that are positioned adjacent various pressure vessels. Operating temperatures at various points within the apparatus are thus sensed, and evaluated by the computer control circuitry. Heater electrode power, and water flow, for example, are precisely controlled by the computer apparatus and software. Flow rates are computer monitored and controlled with various electrically-operated valves whose control solenoids are actuated by the computer system. Dynamic flow adjustments required during start-up, for example, can be continuously varied in real time.

The steam module and electrode module and accessory components are mounted non-rigidly to accommodate operational displacements. Thus, the structure is capable of mechanically expanding and moving in response to the severe heat, and they can contract during the cooling process during down time. Because different materials possess different coefficients of thermal expansion, the flexible mounting accommodates expansion with sufficient "slack", preventing cracking or critical irreversible deformation.

The preferred programmable logic controller (PLC) software control process controls all facets of the steam generator. Pressure vessel temperature and zone temperature are monitored by sensing the thermocouple module, and performance is varied by controlling water flow rates and the multiple heating elements in the electrode module.

Preferably, the PLC software system consists of four primary subroutines. A "start-up" subroutine begins with diagnostic checking, and determines the available power, which can be supplied by a generator or a utility. The high power unit uses 480 V.A.C. three phase power, while the lower powered steam generator uses 240 V.A.C. power. The latter subroutine checks for a proper ground, and provides the technician an opportunity to install an adequate ground for safety. Then, the start-up routine establishes electric power connections, providing power to the various circuit breakers, power supplies and transformers, energizing the PLC (i.e., "programmable logic controller") system and various peripherals.

"Start-up" is followed by a "ramp up" subroutine that initially checks for a proper water supply, supplied either through on-site connections or storage tanks. With adequate water and power available, the heating elements are energized by the PLC, and heater temperature and water flow are carefully monitored and balanced. Predetermined set-points are established. Thereafter water valves are opened to establish water flow into the steam module.

With the generator "ramped up" to proper operating parameters, the software executes a "steady state" subroutine that monitors correct operation. In this third fundamental subroutine, numerous operational parameters are monitored and stored in a data storage system. Water supplied to the heater stages is carefully controlled by a variable frequency pump drive. Water flow is coordinated with pressure vessel temperature, monitored through numerous thermocouples. Each steam generator comprises a plurality of first stage pressure vessels, preferably six, and preferably the PLC system can monitor and control individual flow rates to each pressure vessel.

Finally, the software can execute a "shut down" subroutine, which safely turns off key components in a proper sequence that avoids damage and prevents overheating.

Thus, an object of this invention is to provide superheated steam generators that output superheated steam at high volumes while maximizing superheat in the output steam volume.

A related object is to provide a gas injection means for maximizing artificial lift in a well.

Another fundamental object is to provide a modularized steam generator, wherein the critical pressure vessels, the heating electrodes or canisters, and the sensing thermocouples are disposed as modular subassemblies that readily interfit during assembly.

A basic object of our invention is to provide a reliable source of superheated steam for use in diverse processes.

It is also a fundamental object of our invention to provide a steam generator for supplying superheated steam to oil wells.

Thus a related object is to provide a steam generator of the character described that that can be used for the recovery of heavy and conventional oil.

A related object is to provide a superheated steam generator that supplies adequate steam for well deparrafinization.

Another object is to provide a superheated steam generator of the character described that maintains high temperatures (i.e., in excess of 900° F. in the high power environment) at pressures less than approximately 100 P.S.I.G.

Yet another object is to provide a steam generator of the character described that can operate twenty-four hours a day.

Another related object is to provide superheated steam generators of the character described that can operate unattended, and in a passive mode.

A basic object is to provide a superheated steam generator with modularized steam vessels and complementary, modularized radiant heating sources.

Another object is to provide superheated steam generators of enhanced superheat capabilities.

Another basic object of this invention is to provide superheated steam generators wherein water flow to the pressure vessels is precisely monitored and automatically controlled.

A related object is to provide a unique, modularized electrode configuration that efficiently heats adjacent, superheater pressure vessels non-destructively, while minimizing undesirable and degrading thermal gradients.

Another important object is to provide improved steam generators of the character described that heat the various pressure vessels with radiant heating.

Stated another way, an important object of our invention is to heat the various pressure vessels in steam generators of the character described primarily through the phenomena of radiant heating.

As a corollary, is an object to avoid the use of conduction phenomena as the primary means of heating the pressure vessels.

A related object to maximize heat transfer without the use of lead.

Another important object is to ease service burdens on repair technicians.

Another important object of our invention is to monitor and control water flow. It is a feature of our invention that proper water flow conditions are dynamically monitored and adjusted in accordance with multiple, computer-sensed conditions.

Another object of our invention is to control, and when necessary, to substantially synchronize the flow of water to the first stage pressure vessels within a superheated steam generator of the character described.

Another object of the invention is to provide a high power, superheated steam generator of the character described that is capable of outputting superheated steam at a temperature in excess of 1200° F.

Yet another object is to provide an enhanced, modular heater electrode configuration.

A still further object of our invention is to provide superheated steam generators of the character described that comply with the numerous and diverse safety requirements established by the American Society of Mechanical Engineers (ASME), Boiler and Pressure Vessel Code.

It is also an important object to provide a computerized system for controlling a superheated steam generator of the character described during critical ramp-up stages and subsequent steady state operation.

A related object is to provide a software system for controlling superheated steam generators of the character described.

Another object is to provide software-driven, superheated steam generators that establish and execute separate "start-up," "ramp-up," "steady state," and "shut down" procedures.

A related object is to provide a software-driven, superheated steam generator that gathers, stores, analyzes and responds to data derived during operation.

A still further object is to provide a software-controlled, water handling system for superheated steam generators of the character described.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout to indicate like parts in the various views.

DETAILED DESCRIPTION OF THE INVENTION

The entire disclosure of previously filed and copending U. S. utility patent application Ser. No. 12/59000,919, entitled "Super Heated Steam Generator With Slack Accommodating Heating Tanks," filed Nov. 15, 2009, is hereby incorporated by reference as if fully set forth herein.

Figure 1:
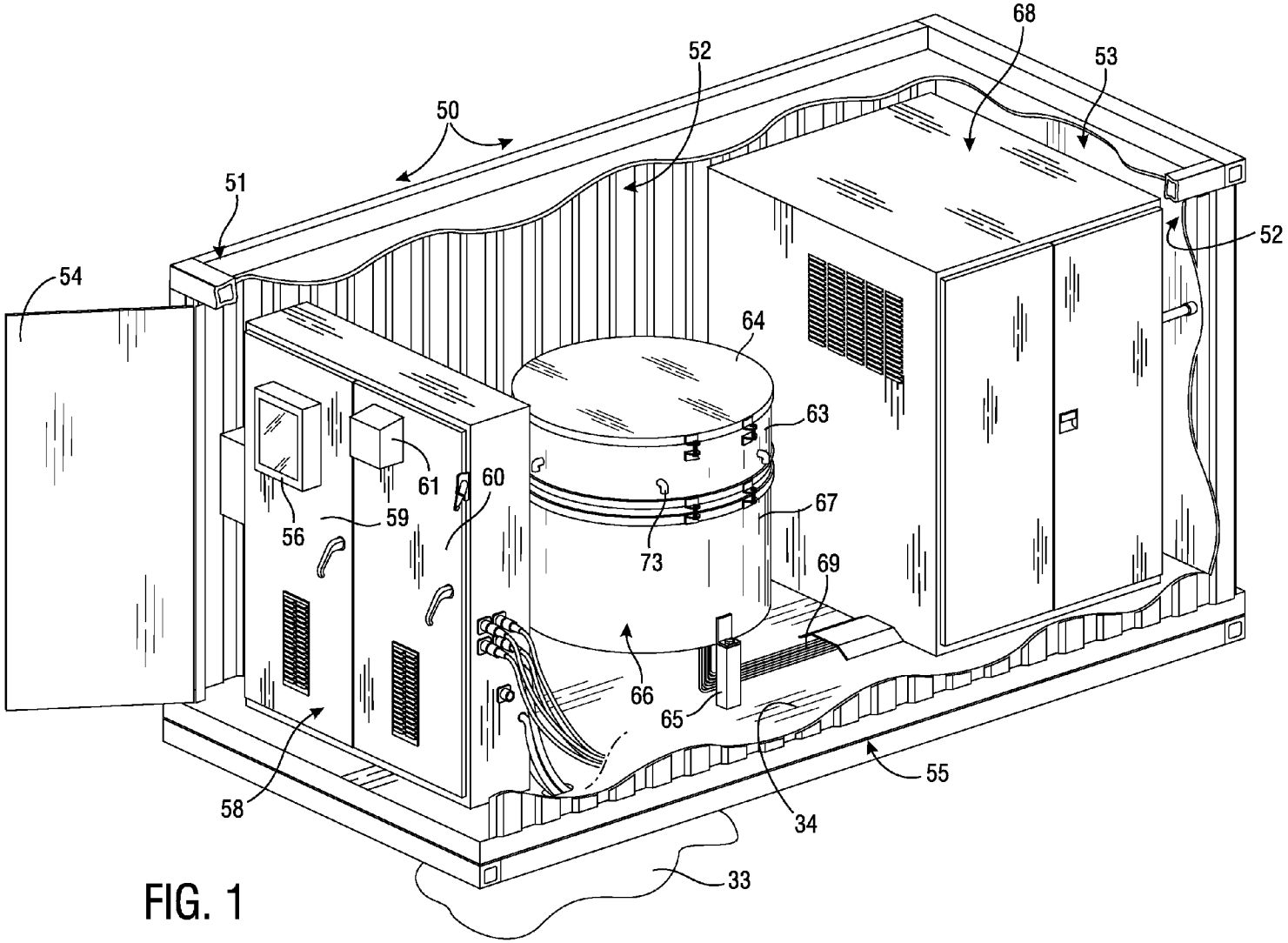
FIG. 1 is a fragmentary, isometric view of a modularized, superheated steam generator constructed in accordance with the best mode of the present invention, with parts thereof broken away or shown in section for clarity, or omitted for brevity.

A. General Hardware:

Referring initially to FIG. 1 of the appended drawings, a modularized, superheated steam generator constructed generally in accordance with the best mode of the invention has been generally designated by the reference numeral 50. Generator 50 comprises a rigid, preferably metallic enclosure 51 that is generally in the form of a parallelepiped, and which is preferably similar in size to a standard shipping container. Enclosure 51 comprises a rigid, channel steel frame with side walls 52, a rear end 53, and a front access door 54 that exposes the enclosure interior. Enclosure 51 includes a rigid, lower base 55 adapted to be disposed upon a suitable supporting surface 33, which may comprise a prepared concrete slab, a flat and stable platform, a suitable trailer bed, or the like. Enclosure 51 is adapted to be manipulated with conventional front-end loaders or hoists.

Secured within enclosure 51 is an electrical control housing 58 that contains a variety of electrical components and controls, including a computerized PLC (i.e., Programmable Logic Controller) system described in detail hereinafter. Access to control housing 58 is enabled by doors 59, 60. There is a touch screen, HMI (human machine interface) 56 mounted atop door 59, and a blower vent 61 mounted atop door 60 (FIG. 1).

Figure 27:
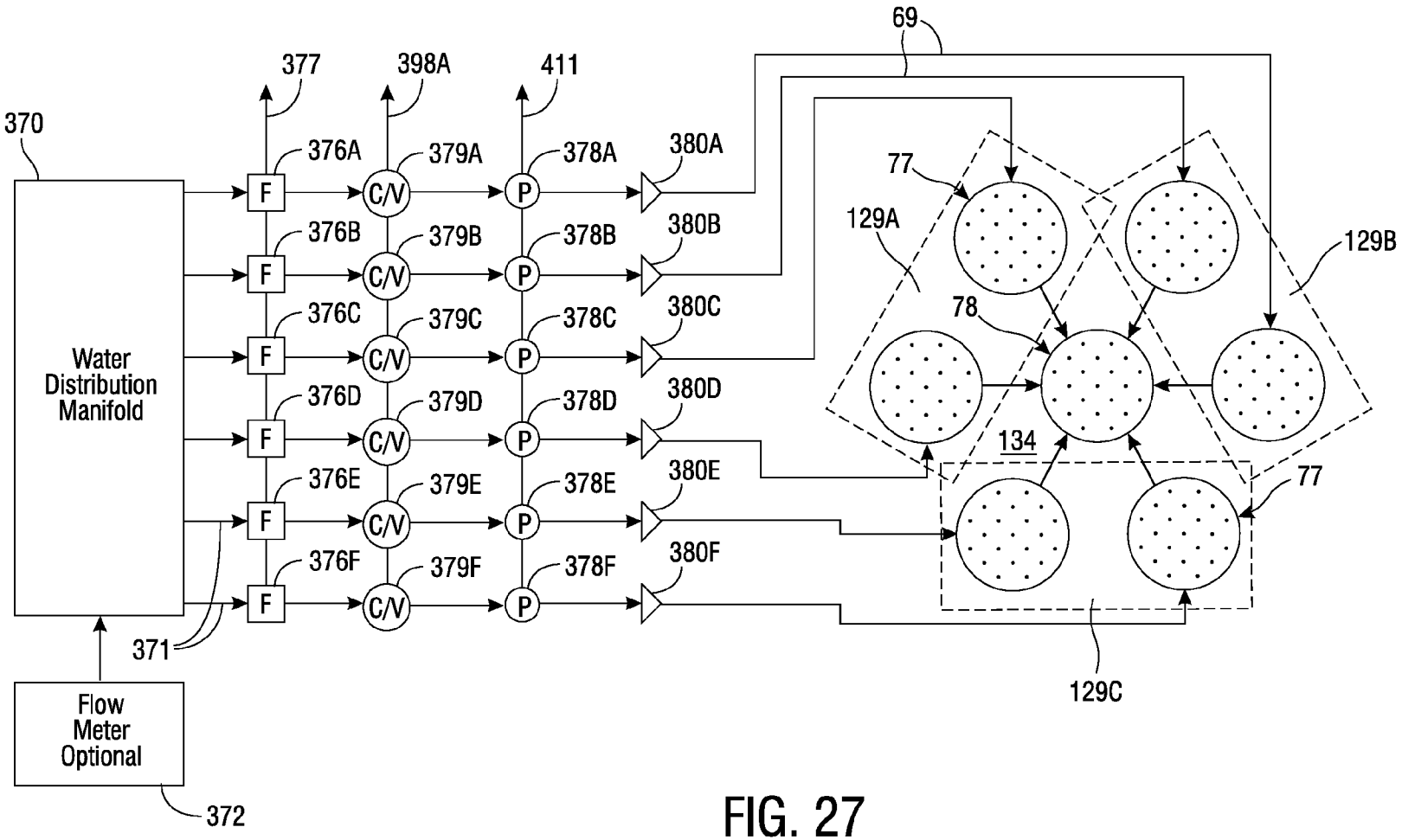
FIG. 27 is a generalized schematic diagram of the preferred water feeding system used with the high power generator, with four pressure vessel heating zones shown in dashed lines.

A generally right circular, cylindrical, superheated steam generator containment enclosure 66 is disposed adjacent control housing 58 within the interior of enclosure 51. An adjacent, generally cubicle water control enclosure 68 houses a commercially available, reverse-osmosis water pretreatment system with suitable controls, filters and pumps. Treated water is transmitted from the enclosure 68 to the steam generator containment enclosure 66 by a plurality of water feed lines 69 (FIGS. 1, 27). Fluid piping including the preferred water feeding and control apparatus is discussed in detail hereinafter.

Figure 6:
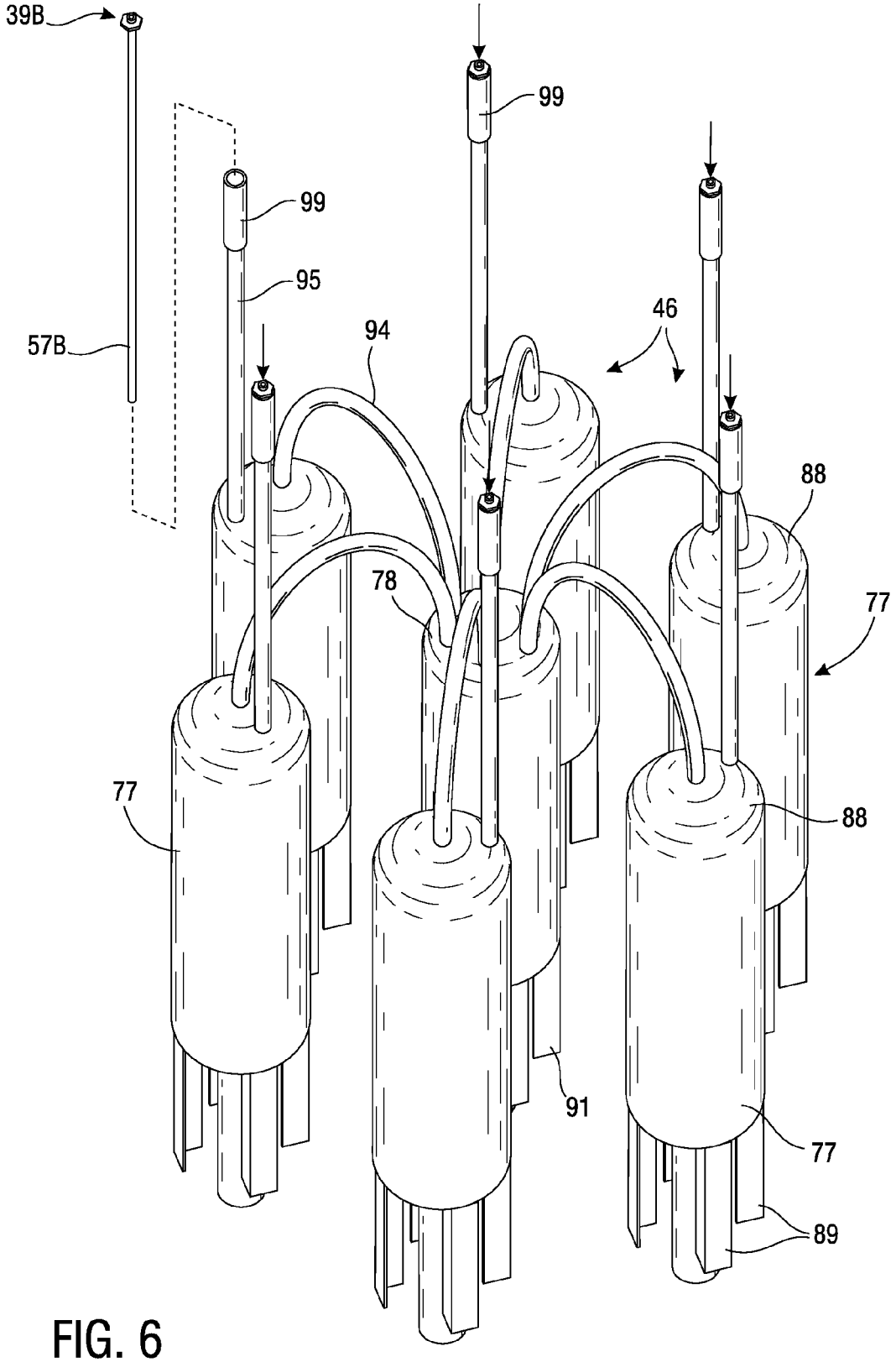
FIG. 6 is an enlarged, upper isometric view of the preferred steam module, with portions thereof broken away, partially exploded, or shown in section for clarity.

Referring jointly now to FIGS. 1-4 and 6, the containment enclosure 66 preferably comprises a rigid, generally cylindrical, lower stainless steel base 67 supported upon the floor 34 (FIG. 1) within enclosure 51 upon a plurality of radially spaced apart feet 65 (i.e., FIGS. 1, 6). An upper, circular cover 64 (FIGS. 1 and 2) can be removed as in FIG. 2 to expose the containment enclosure interior. Preferably, cylindrical extension 63 (FIG. 2) is stacked atop the containment enclosure 66. Extension 63 has a lower, reinforced peripheral flange 49A (FIGS. 2. 4) that engages a complimentary, encircling, flange 70 on base 67. Flange 49A has multiple radially spaced apart brackets 71A that threadably mate with similar spaced apart brackets 71B secured to flange 70 (FIGS. 2, 4) to coaxially secure the upper cylindrical extension 63 to the lower containment base 67. In assembly, similar brackets 71C (FIG. 2) disposed on the external periphery of cover 64 are threadably secured to complementary brackets 71D that are radially spaced apart around the periphery of extension 63. Preferably, spaced apart depressurizing vents 73 are disposed about the periphery of extension 63 (i.e., FIGS. 1-3). When cover 64 is removed from the vessel extension 63 (FIG. 2), an upper, generally cylindrical thermocouple volume 40 (FIG. 2) is exposed at the top of the containment enclosure. Volume 40 is defined between cover 64 (FIG. 2) and the thermocouple module 41 (FIG. 3) mounted below.

Preferably the containment enclosure 66 houses three interfitting, modular components, comprising a steam module, an electrode module, and a thermocouple module, all of which are stacked in assembly.

Figure 9:
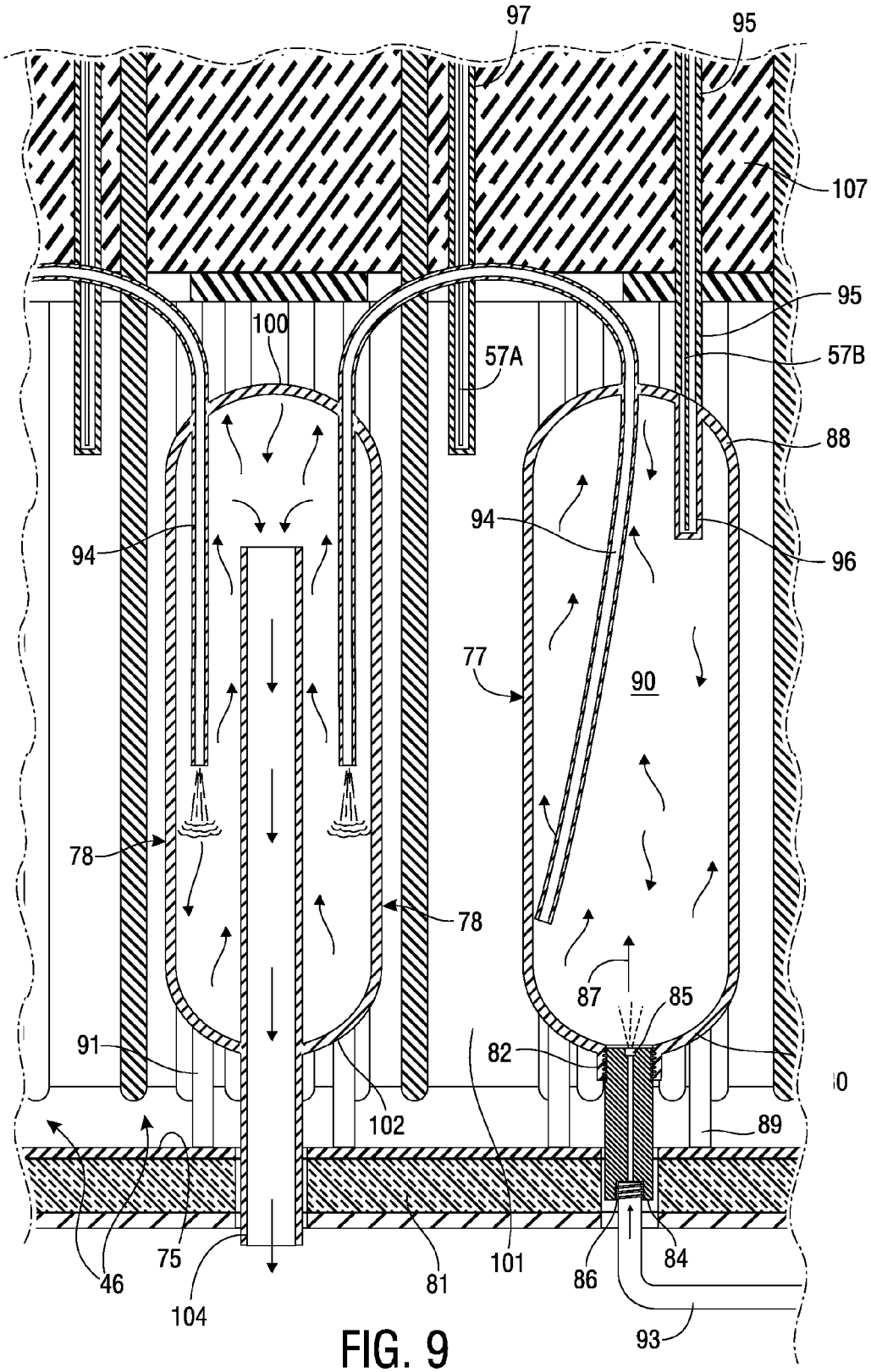
FIG. 9 is an enlarged, sectional view of the containment enclosure similar to FIG. 8, with portions thereof broken away or shown in section for clarity or omitted for brevity.

B. High Power Hardware:

The thermocouple module 41 comprises a rigid, circular header plate 42 that secures and suspends two arrays of temperature-sensing thermocouples above lower components. The first thermocouple array comprises thermocouples 39A (FIGS. 2, 3), that include lower elongated portions 57A (FIGS. 3, 9) that extend downwardly through an electrode module 45 into the interior of the containment enclosure proximate the steam module 46 below. Thermocouples 39A measure the temperature in regions between individual pressure vessels. All thermocouples used herein must be capable of measurements up to 1800° F. As best seen in FIG. 9, the lower thermocouple portions 57A extend into the heating zones between pressure vessels. Preferably thermocouples 39A are type "R." FIG. 11, detailed later, shows clearance holes 117 formed in the electrode module header plate 44, through which lower thermocouple portions 57A pass. Each zone temperature is measured by an arithmetic combination of three thermocouples 39A.

Figure 19:
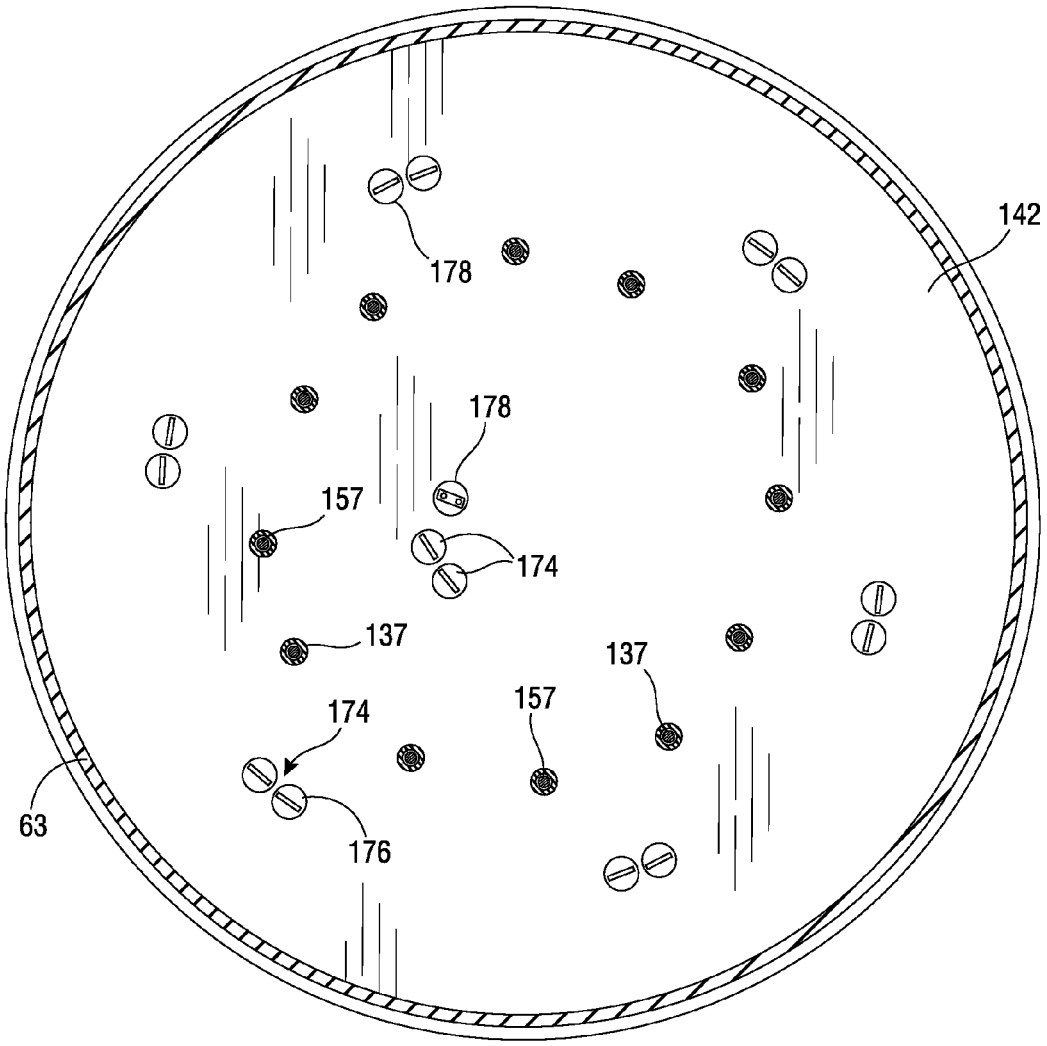
FIG. 19 is an enlarged, vertical sectional view taken generally along line 19-19 of FIG. 17 looking down in the direction of the arrows.

The second thermocouple array comprises thermocouples 39B (FIGS. 3, 11) that monitor the interior temperature of the first stage pressure vessels 77 described later. Preferably thermocouples 39B are type "K." Thermocouples 39B include lower elongated portions 57B (FIG. 3) extending downwardly into each first stage pressure vessel 77 (FIG. 19). Clearance holes 118 (FIG. 11) are defined in electrode module header plate 44 for thermocouple portions 57B. Thermocouples 39A and 39B include suitable wiring, generally designated by the reference numeral 74 (FIGS. 2, 3, 24) for interconnecting them with the computer circuitry discussed hereinafter.

Figure 2:
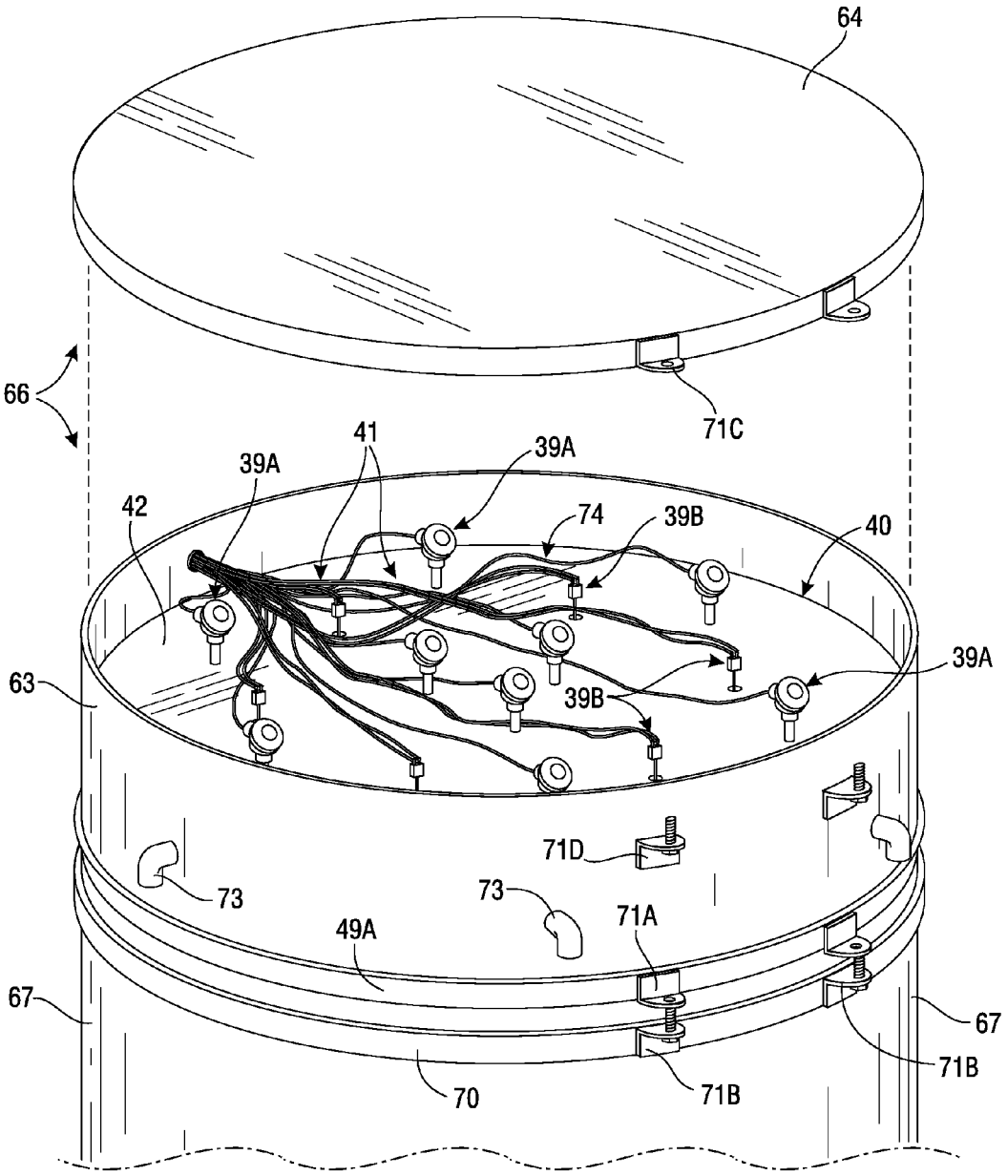
FIG. 2 is a partially exploded, fragmentary isometric view of the containment enclosure used with the high power generator, with the cover spaced apart, and with portions thereof broken away for clarity or omitted for brevity.
Figure 3:
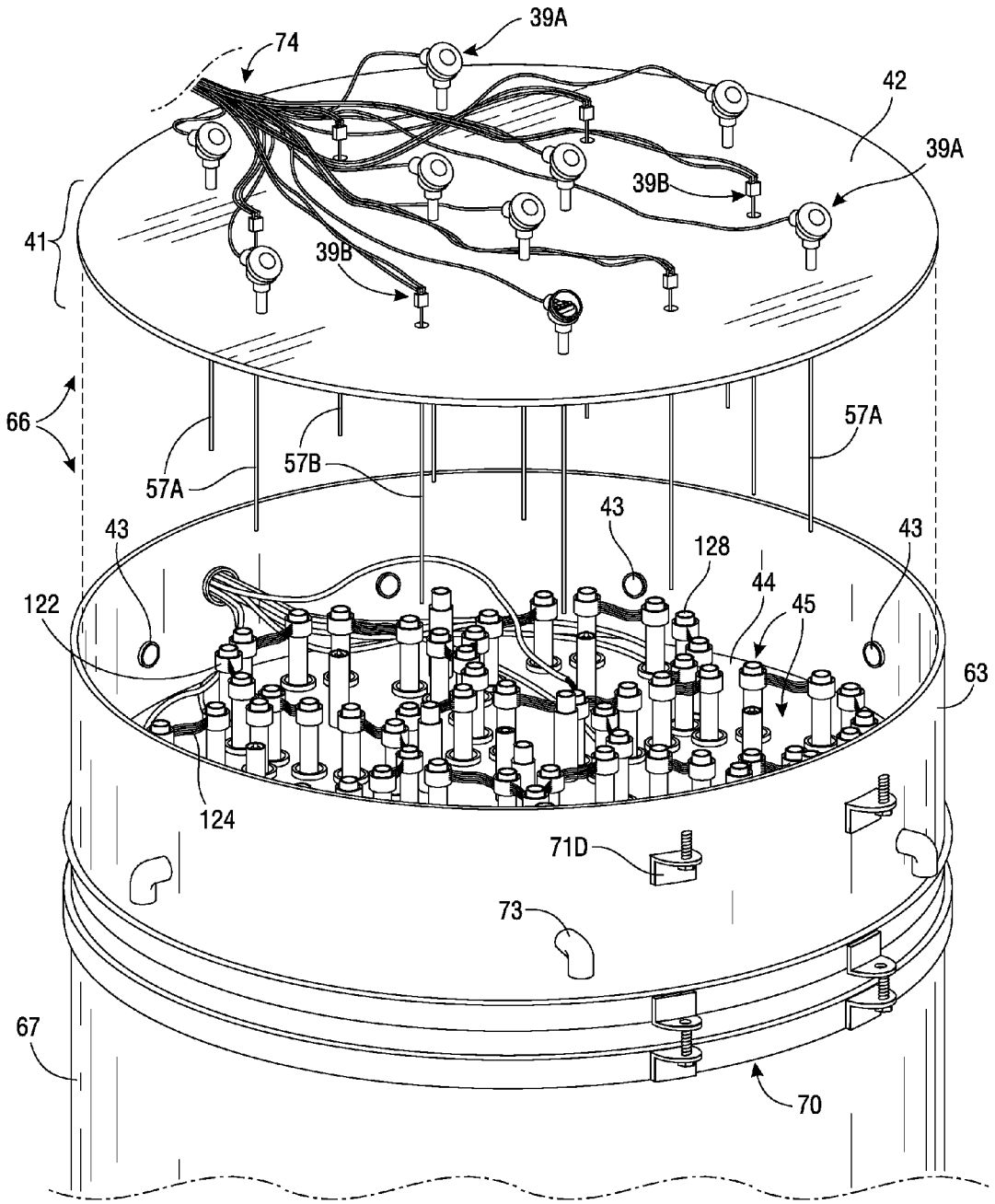
FIG. 3 is a partially exploded, fragmentary isometric view the containment enclosure of FIG. 2 with the cover removed and the thermocouple module spaced apart, with portions thereof broken away for clarity or omitted for brevity.

As best seen in FIGS. 2 and 3, a rigid, circular, thermocouple header plate 42 seats coaxially within the containment enclosure extension 63 upon a plurality of radially, spaced apart nubs 43 secured to the inner periphery of cylindrical extension 63. In this manner, the thermocouple module 41 is non-rigidly suspended and mounted to both ease manufacturing or assembly, and to accommodate thermodynamic expansion and contraction during machine operation.

An electrode module 45 (FIGS. 3, 4) is disposed beneath the thermocouple module 41. Electrode module 45 comprises a rigid, circular, electrode header plate 44 that is similar to header plate 42, and which coaxially rests within extension 63. In assembly, when extension flange 49A engages base flange 70, header 44 is coaxially disposed over an internal, cylindrical shroud 72 (i.e., FIGS. 4, 6). Shroud 72 is coaxially centered within containment enclosure base 67, with the annular insulation bundle 48 coaxially centered within shroud 72.

Figure 4:
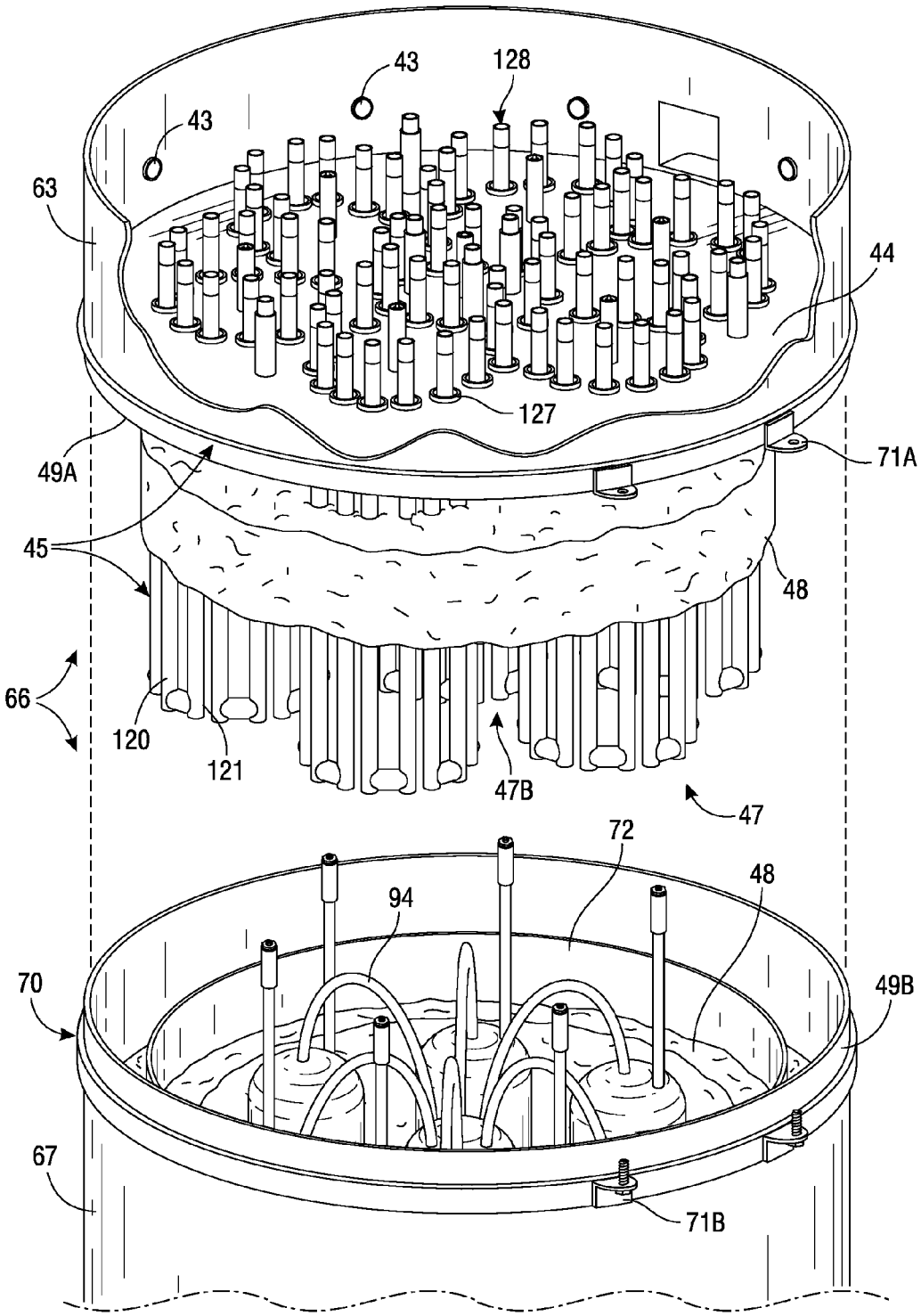
FIG. 4 is a partially exploded, fragmentary isometric view of the containment enclosure of FIGS. 2 and 3 with the cover and thermocouple module removed, with the modular electrode array separated from the steam module, with portions thereof broken away or shown in section for clarity.

Electrode module 45 (FIG. 4) comprises numerous electrically resistive, silicon carbide heater elements discussed in detail later that project downwardly from the rigid header 44 towards steam module 46 (i.e., FIGS. 4-6). In the high power embodiment, the heater elements preferably comprise silicon-carbide electric heating elements. The electrode module 45 is coaxially surrounded by insulation bundle 48 (i.e., FIGS. 4, 7), at the center of protective shroud 72. Another annular insulation bundle 79 (FIGS. 7, 8) is disposed between shroud 72 and the containment enclosure base 67.

Figure 10:
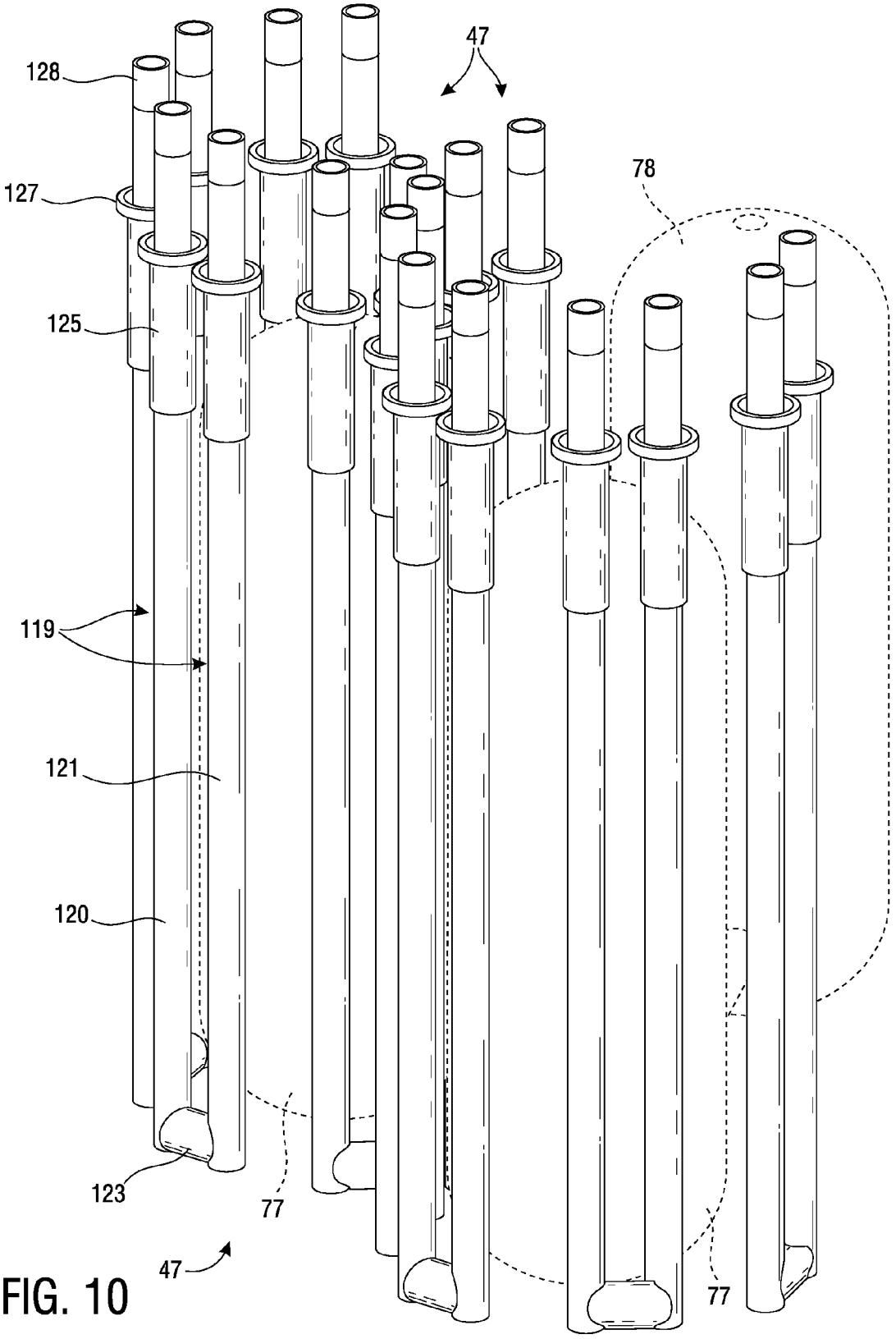
FIG. 10 is an enlarged, fragmentary, isometric view showing an array of heater elements employed in the high power embodiment, with portions of the environment shown in dashed lines for clarity.
Figure 12:
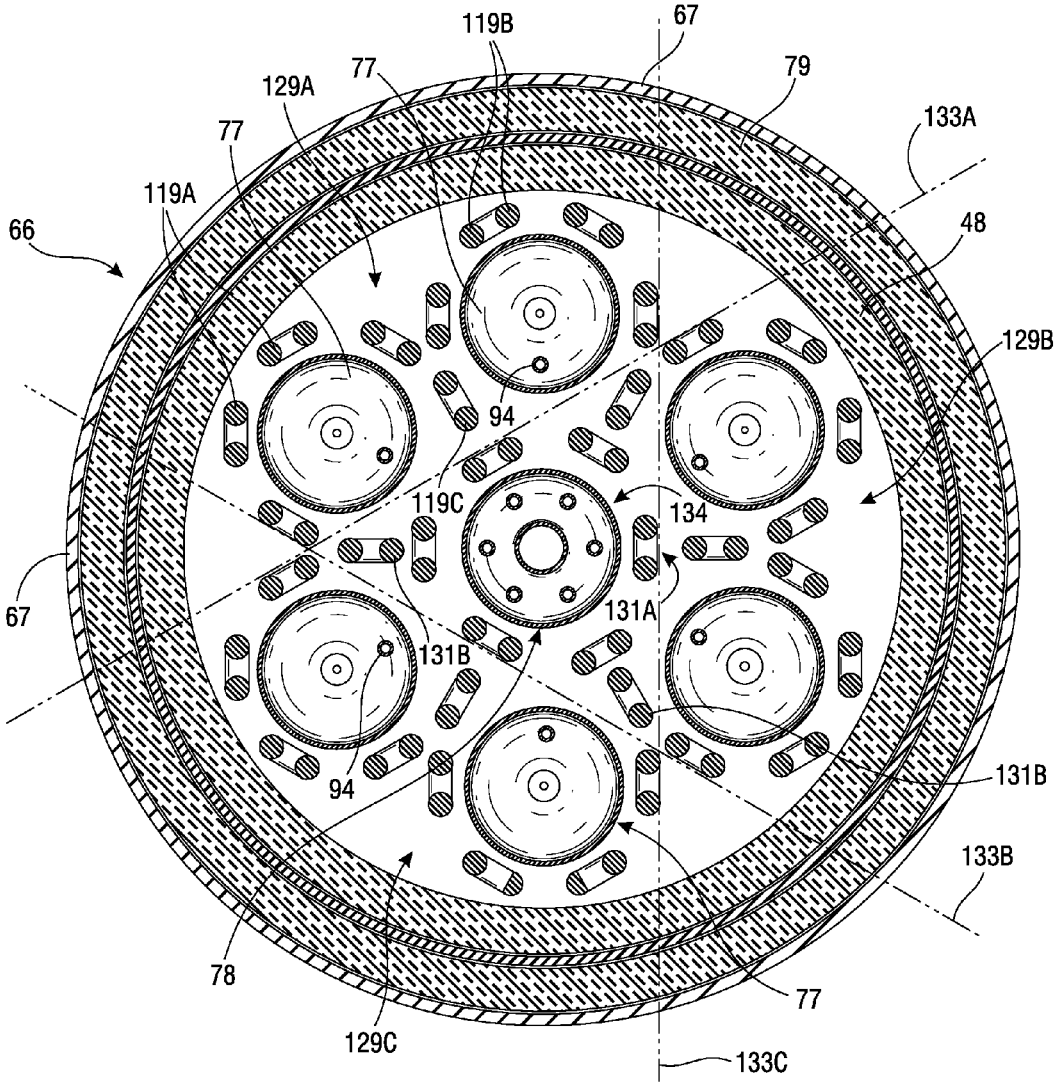
FIG. 12 is an enlarged, vertical sectional view taken generally along line 12-12 of FIG. 9 looking down in the direction of the arrows.
Figure 13:
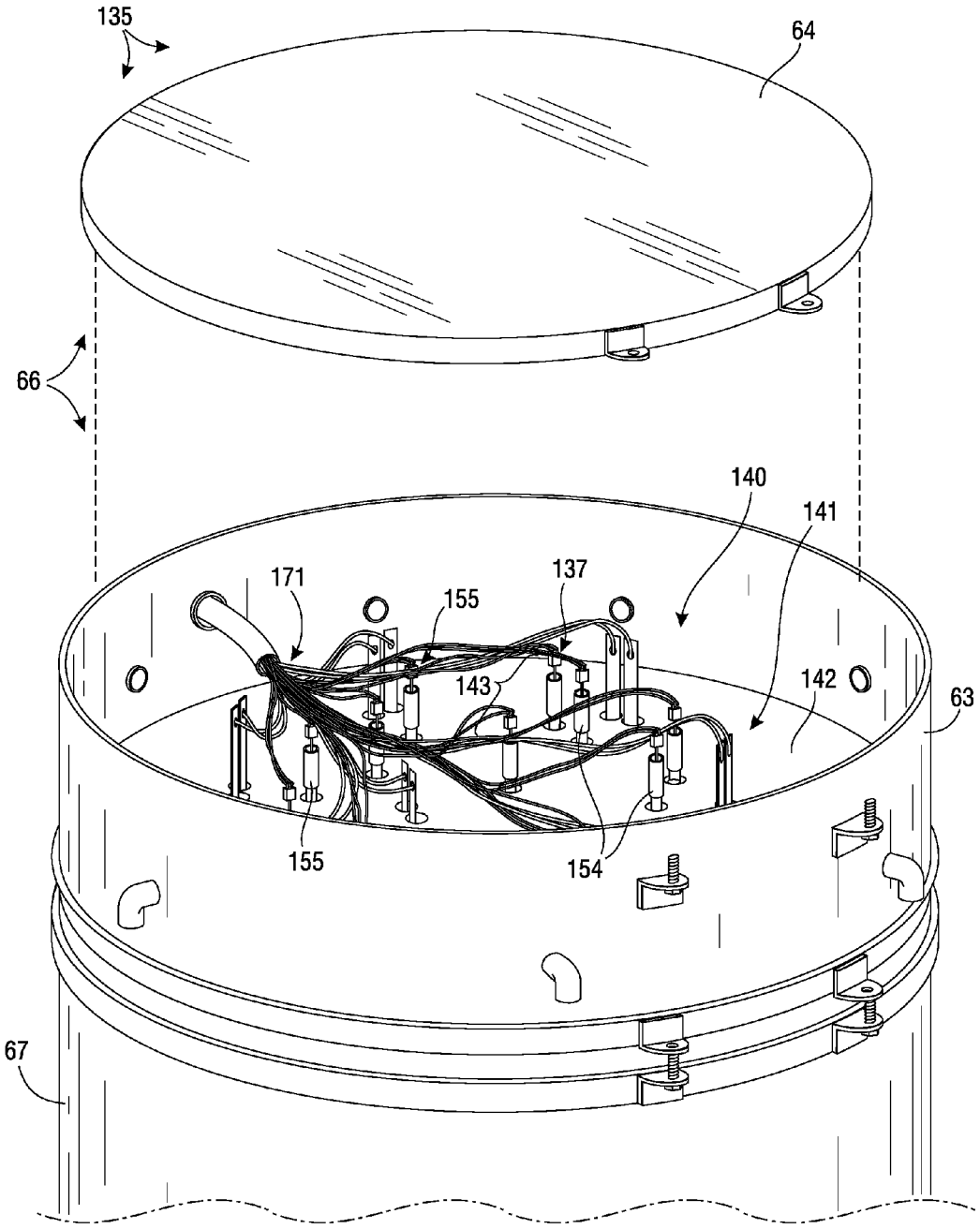
FIG. 13 is a partially exploded, fragmentary isometric view of the containment enclosure used with the alternative embodiment, i.e., the reduced power generator, with the cover spaced away, and with portions thereof broken away for clarity or omitted for brevity.

Preferably, the silicon-carbide electric heating elements within module 45 are geometrically spaced and arranged into separate arrays of individual, electrically resistive heating elements which are electrically wired into zones. The various heating elements are disposed proximate the various pressure vessels that are part of the steam module 46 discussed below. Layout of the heating elements 47 in the high power embodiment is best illustrated in FIGS. 10, 12 and 13, discussed below. In the best high power mode known to us at this time, there are three, similar primary electrode arrays 47 (FIG. 10), each of which substantially surrounds a pair of first stage pressure vessels. In the best mode, there are six first stage pressure vessels, arranged into three, first stage heating zones. A single, second stage heater zone is heated by electrode array 47B (FIGS. 4, 12). The electrode arrays 47, 47B configure most of their constituent heater elements in generally cylindrical formations that border the steam module and partially surround various pressure vessels.

In the high power mode the silicon-carbide electric heating elements are suspended from the rigid electrode header plate 44, and project downwardly into shroud 72. Individual heating elements are spaced and arranged to surround individual pressure vessels of the lower steam module 46. All heating is by radiation. The electrode configuration is such that various heating elements fit within voids between individual pressure vessels, occupying and interfitting within clearance spaces between individual pressure vessels 77, 78 of the steam module 46. Containment enclosure extension 63 and the electrode support header 44 are properly suspended and secured when the circular extension flange 49A (FIG. 4) surmounts the complimentary base flange 70, and brackets 71A are secured to complimentary brackets 71B.

Figure 5:
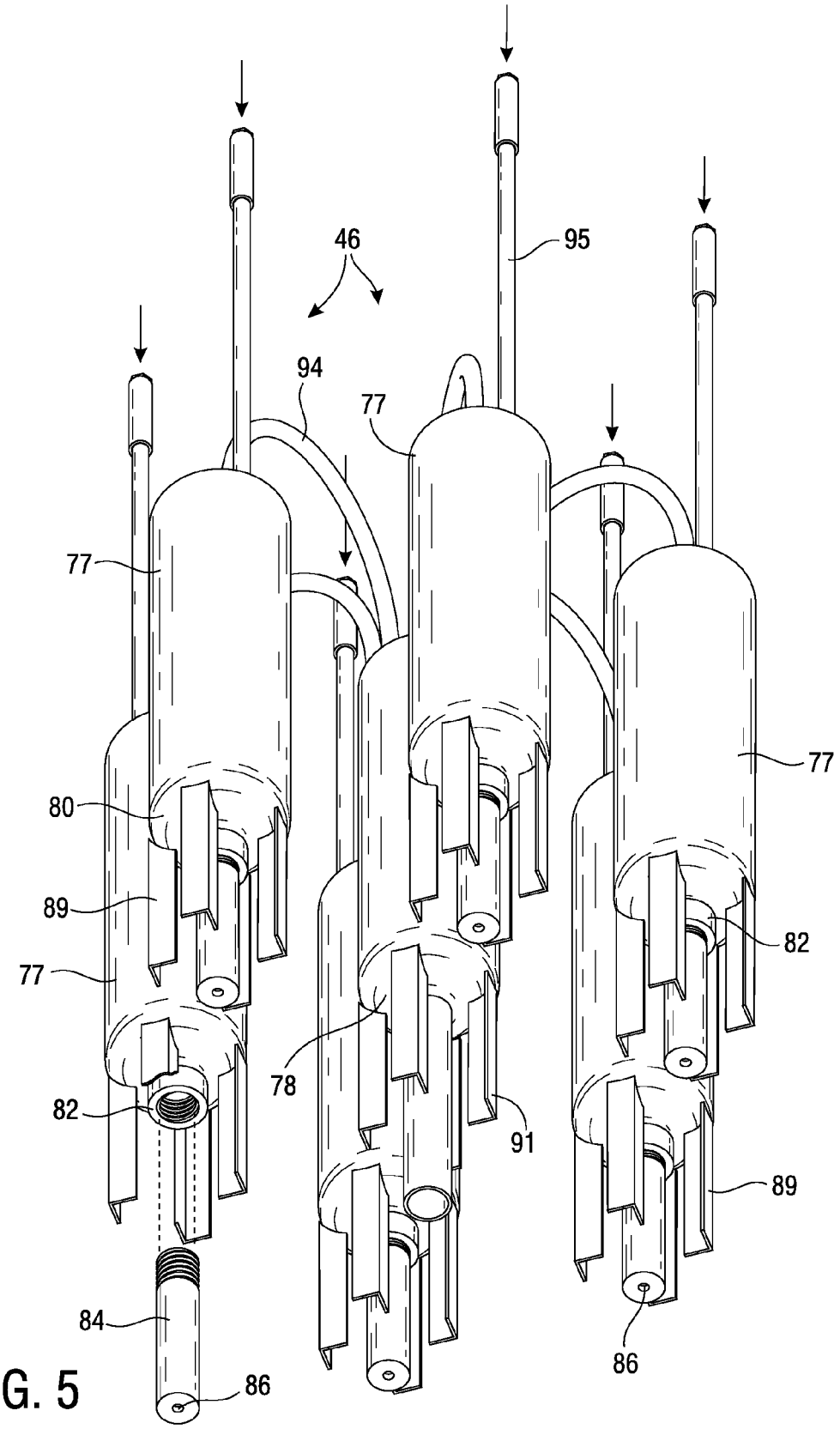
FIG. 5 is an enlarged, bottom isometric view of the preferred steam module, with portions thereof broken away, partially exploded, or shown in section for clarity.
Figure 7:
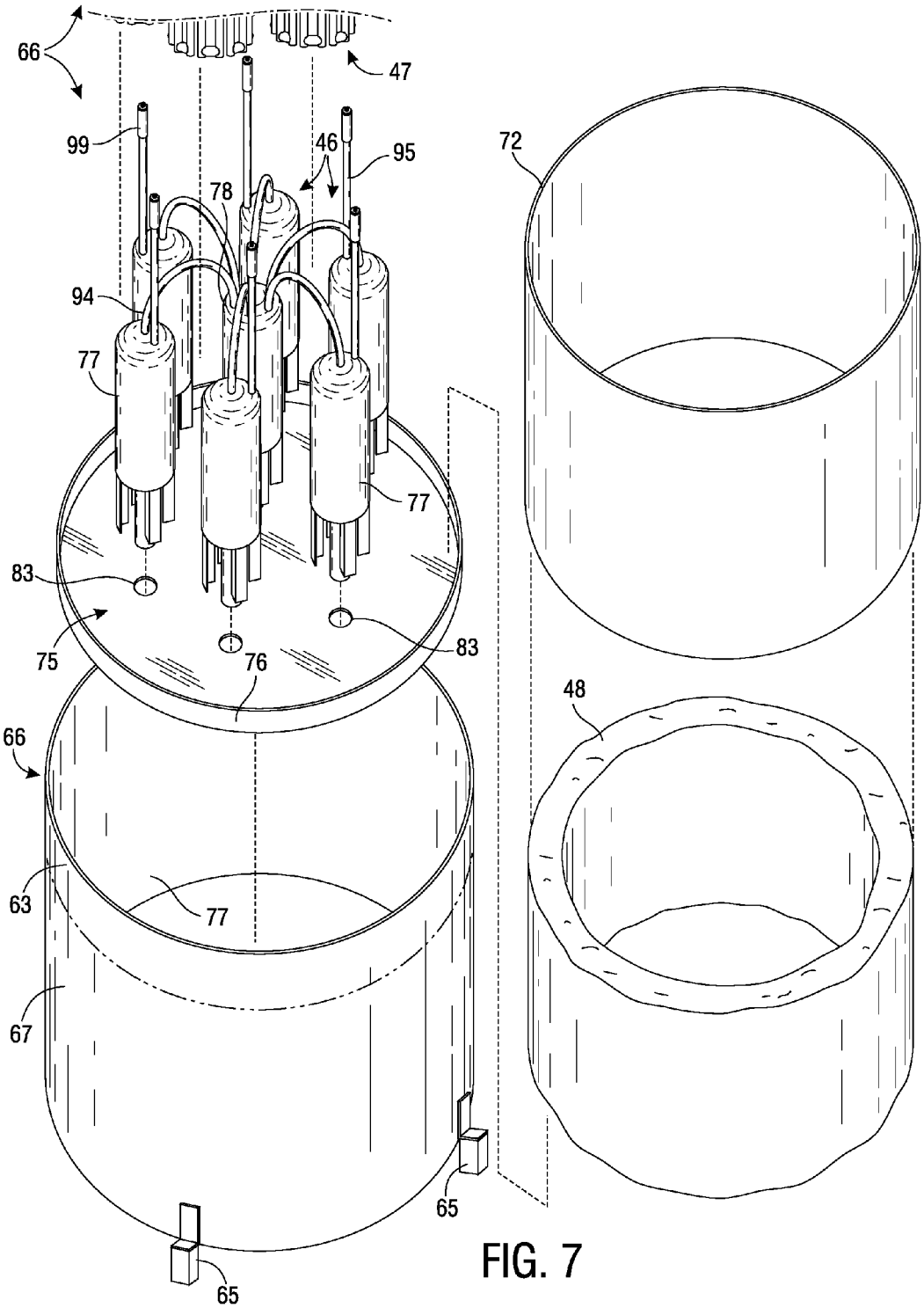
FIG. 7 is an exploded, isometric assembly view showing parts of the high power containment enclosure and the steam module, with portions thereof broken away or shown in section for clarity or omitted for brevity.

Turning now to FIGS. 5 and 6, the preferred steam module 46 comprises a rigid, unibody structure, preferably comprising at least one first stage pressure vessel 77 and at least one second stage pressure vessel 78. In the best mode, the first stage pressure vessels 77 are connected to and feed the second stage pressure vessel 78 disposed at the steam module center, and together vessels 77 and 78 form a unibody steam module. The first stage pressure vessels 77 are preferably radially. spaced-apart at equal, angular intervals about the second stage pressure vessel 78. Spacing depends upon the number of first stage vessels employed. In the best mode there are six first stage pressure vessels 77 that are preferably radially spaced apart at sixty-degree intervals about the second stage pressure vessel 78. The second stage pressure vessel 78 is thus disposed at the center of the shroud 72 within containment enclosure base 67. Shroud 72 and steam module 46 seat upon a rigid, circular, steam module support plate 75 (FIG. 7 9), which has an encircling flange 76 (FIG. 7). As detailed below, the pressure vessels 77, 78 are heated by electrode arrays 47, 47B (FIGS. 4, 10) of the electrode module within shroud 72.

Figure 8:
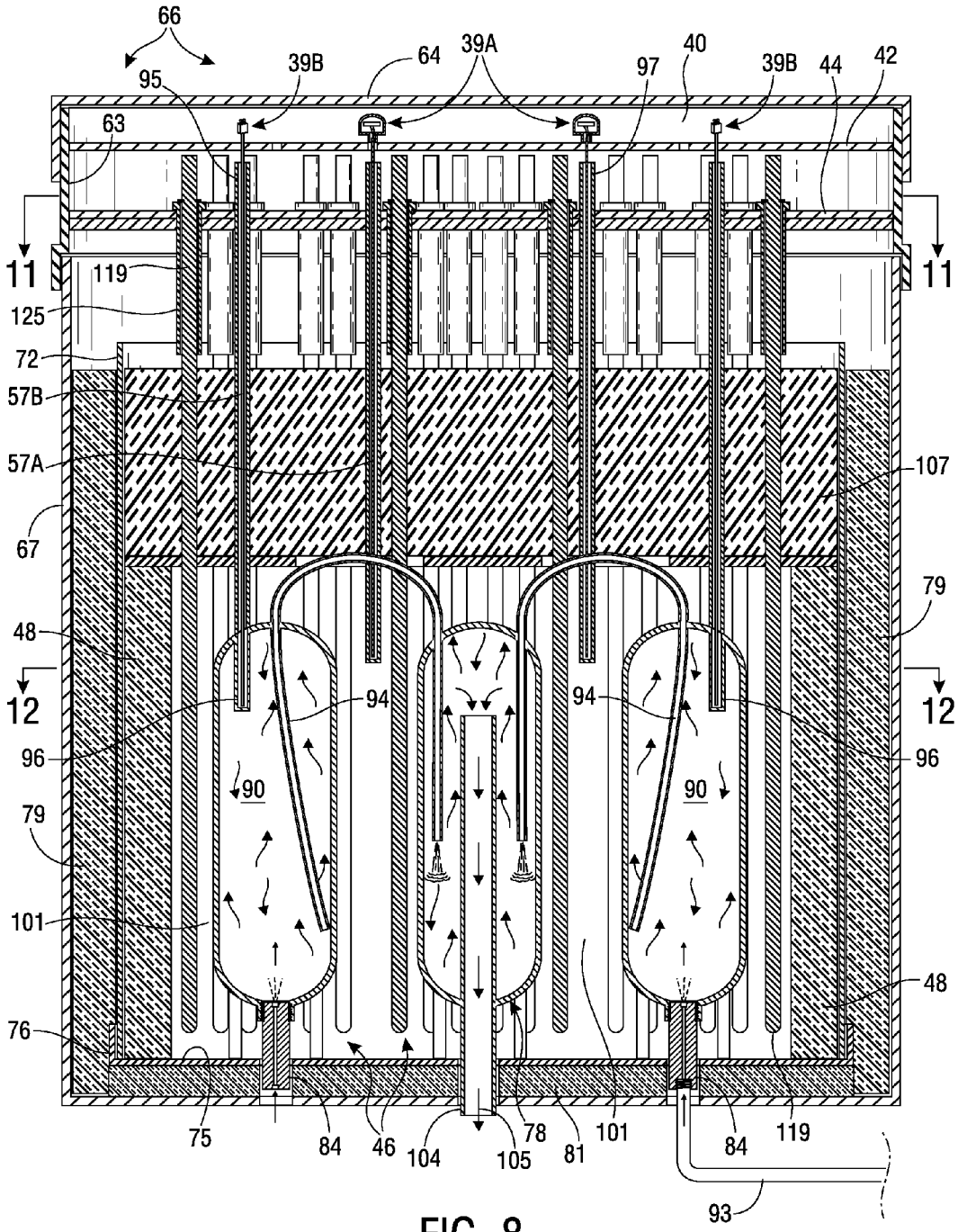
FIG. 8 is a longitudinal sectional view of the assembled high power steam generator containment enclosure.

The rigid, protective, cylindrical shroud 72 (FIGS. 4, 7, 9) is concentrically disposed within the containment enclosure, coaxially within base 67. Shroud 72 seats upon the steam module support plate 75 (FIG. 6) upon which the steam module 46 sits, firmly surrounded by an integral, peripheral flange 76 (i.e., FIG. 11). Coaxial alignment between shroud 72 and steam module support plate 75 is maintained by the integral, peripheral flange 76 (FIG. 7, 8). Plate 75 rests upon a rigid, insulative floor 81 (FIGS. 8, 9). The tubular insulation bundle 48 is coaxially disposed within shroud 72, and surrounds and thermally encloses the steam module 46 (i.e., FIGS. 7, 9). A similar, tubular insulation bundle 79 (FIG. 9) is disposed within the annulus formed between the shroud 72 and the containment enclosure base 67.

With primary reference directed to FIGS. 5-9, each first stage pressure vessel 77 is made of rigid steel, and is generally cylindrical, with integral, spaced apart top and bottom heads 88 and 82 respectively. The heads may be of various shapes as recognized in the art, (i.e., elliptical or hemispherical), but they are generally convex in appearance. The bottom head 80 comprises an internally threaded, tubular injector socket 82. A rigid, generally cylindrical, threaded injector 84 threadably engages socket 82 at the bottom of each first stage pressure vessel 77. Each injector 84 is surrounded by a plurality of radially spaced-apart vessel support legs 89 (FIGS. 6, 9) extending from bottom head 80 into supportive contact with the lower, steam module support plate 75. Clearance orifices 83 defined in support plate 75 (FIG. 7) allow the injectors 84 to pass through. Each injector 84 has an internal, single-fluid spray nozzle 85 that utilizes the kinetic energy of the liquid to establish a water spray 87 (FIG. 9) within each first stage pressure vessel interior. This type of spray nozzle is more efficient at producing spray area than other types. As the input fluid pressure increases, flow through the nozzle increases, and drop size decreases. As explained hereinafter, during operation, a computer controlled water system feeds water to each injector 84 through injector inlets 86 connected to feed tubes 93 (FIG. 9).

The top head 88 of each first stage pressure vessel 77 is penetrated at its center by a rigid feed pipe 94. Steam generated within the interior 90 of each first stage pressure vessel 77 is outputted through the arcuate, somewhat U-shaped steam feed pipe 94 that extends from the bottom interior of each pressure vessel 77 and exits through head 88. Steam is collectively delivered from all first stage pressure vessels 77 through the several pipes 94 to the second stage pressure vessel 78.

An interiorly closed, tubular passageway 96 (i.e., FIGS. 8, 9) penetrates top head 88 at on each first stage pressure vessel 77. Passageway 96 is interconnected with an elongated, hollow pipe 95 that extends upwardly through the shroud 72 and terminates beneath the thermocouple module. A generally cylindrical thermal well 99 is coaxially supported atop pipe 95 (i.e., FIG. 6). Pipes 95 and 96 coaxially receive lower portions 57B (i.e., FIGS. 6, 8, 9) of thermocouples 39B discussed above that monitor steam temperature in the first stage pressure vessels 77. Passageways 96 are not in fluid flow communication with the respective vessel interiors 90. Thermocouples 39A (i.e., FIG. 2, 8) have their lower portions 57A routed through vertical pipes 97 through insulation 107 (FIG. 9) to void regions 101 within shroud 72 (FIGS. 8, 9, 17) adjacent the pressure vessels 77, 78. Pipes 97 are closed at their bottom ends.

Figure 18:
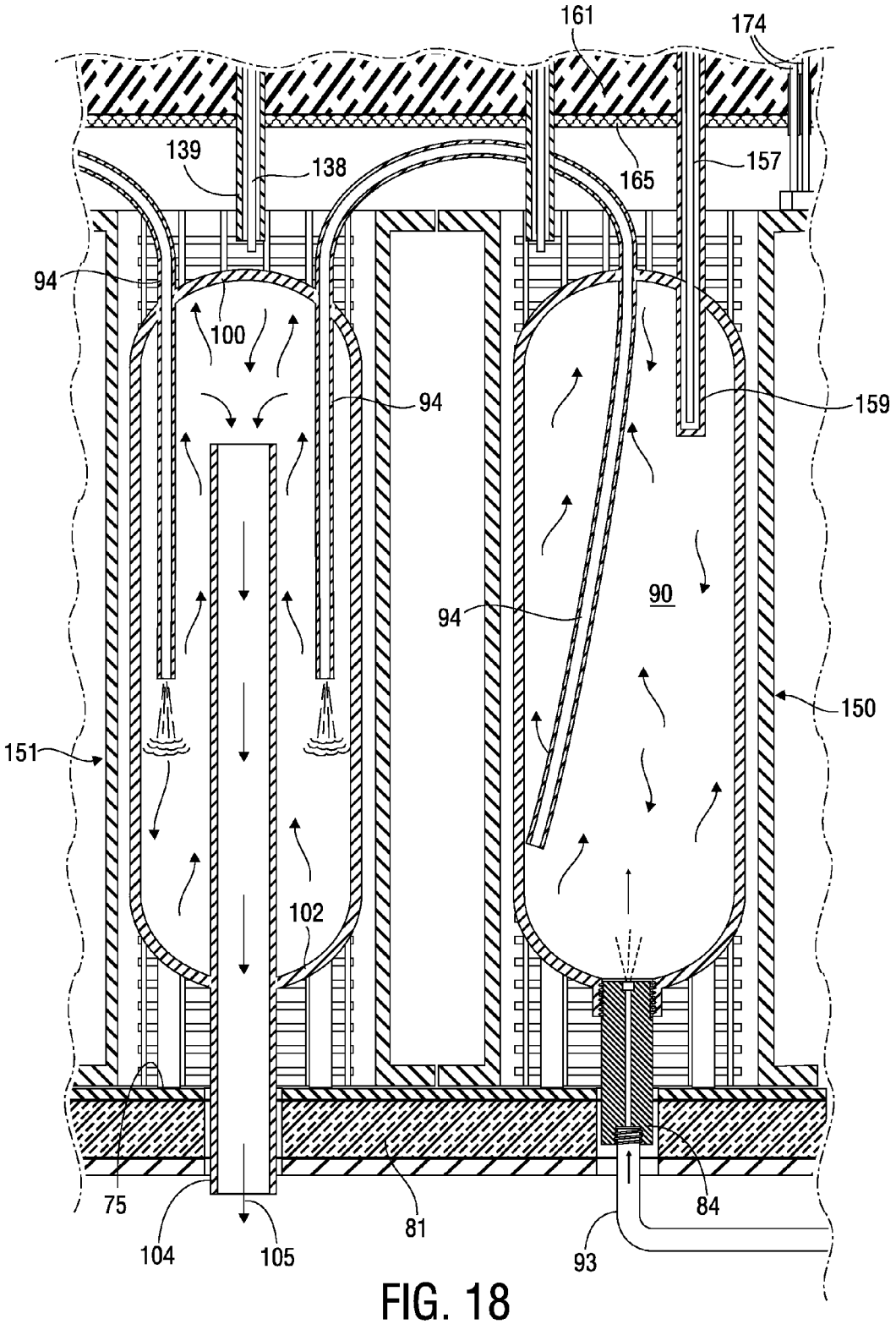
FIG. 18 is an enlarged, sectional view of the containment enclosure similar to FIG. 17, with portions thereof broken away or shown in section for clarity or omitted for brevity.

As best seen in FIGS. 8 and 9, the generally cylindrical secondary pressure vessel 78 comprises a similarly shaped top head 100 (FIGS. 9, 10) that is similar to upper head 88 on the first stage pressure vessels 77. Top head 100 is penetrated by a plurality of radially spaced apart, steam feed pipes 94 emanating from the first stage pressure vessels 77 surrounding second stage pressure vessel 78. The secondary pressure vessel bottom head 102 (FIG. 18) mounts a steam output pipe 104 that penetrates the containment enclosure and outputs from the bottom. Pipe 104 extends vertically, coaxially inwardly of second stage pressure vessel 78, terminating short of cap 100, but above the ends of feed pipes 94. Steam entering pressure vessel 78 through the various feed pipes 94 is forced by pressure through pipe 104, and out the bottom of the containment enclosure, as represent generally by arrow 105 (FIGS. 8, 18). Second stage pressure vessel 78 is supported by a minimum of three vertical component support legs 91 (FIGS. 5, 6, 9) that resist the effects of deadweight loading while not restrictively restraining the effects of lateral thermal displacements.

The various pipes 94, 104 are welded according to ASME welding procedures known in the art, i.e., ASME Boiler and Pressure Vessel Code, Section IX. For example, the nozzle to head welds of pipes 94 and 104 establishing mechanical joints between the elliptical head portions of the first and second stage pressure vessels 77, 78 are full penetration welds as described and permitted within the ASME Boiler and Pressure Vessel Code, Section VII, Division 1. All welds must pass testing and inspection through non-destructive methods including, but not limited to, both surface and volumetric examinations as prescribed by ASME Boiler and Pressure Vessel Code Section VII, Div. 1.

FIG. 10 shows one of three arrays 47 of silicon carbide heating elements associated with the high power electrode module 45. Pairs of first stage pressure vessels 77 are divided into heating zones for wiring purposes, as explained hereinafter and illustrated further in electrical diagrams. Since, in the best mode of the high power embodiment, there are six first stage pressure vessels 77, three primary or first stage heating zones are established with three similar arrays 47 of heating elements. A typical U-shaped heating element 119 comprises a pair of elongated and parallel vertical legs 120 and 121 joined at their bottoms with a union 123. Each leg 120, 121 has a tubular, insulative sleeve 125 secured near their upper connection ends 128 (FIG. 10). Ceramic sleeves 125 support integral mounting flanges 127 which, as viewed in FIG. 4, seat upon electrode module header 44 (FIG. 4) in assembly, with the electrode legs 120, 121 projecting downwardly from the bottom of header 44. The upper, terminal connection end 128 of each heating element 119 (i.e., FIGS. 3, 4, 10) receives a stainless steel C-clip 122 (FIG. 3) that interconnects with A.C. through power stainless steel braided wire 124.

Figure 11:
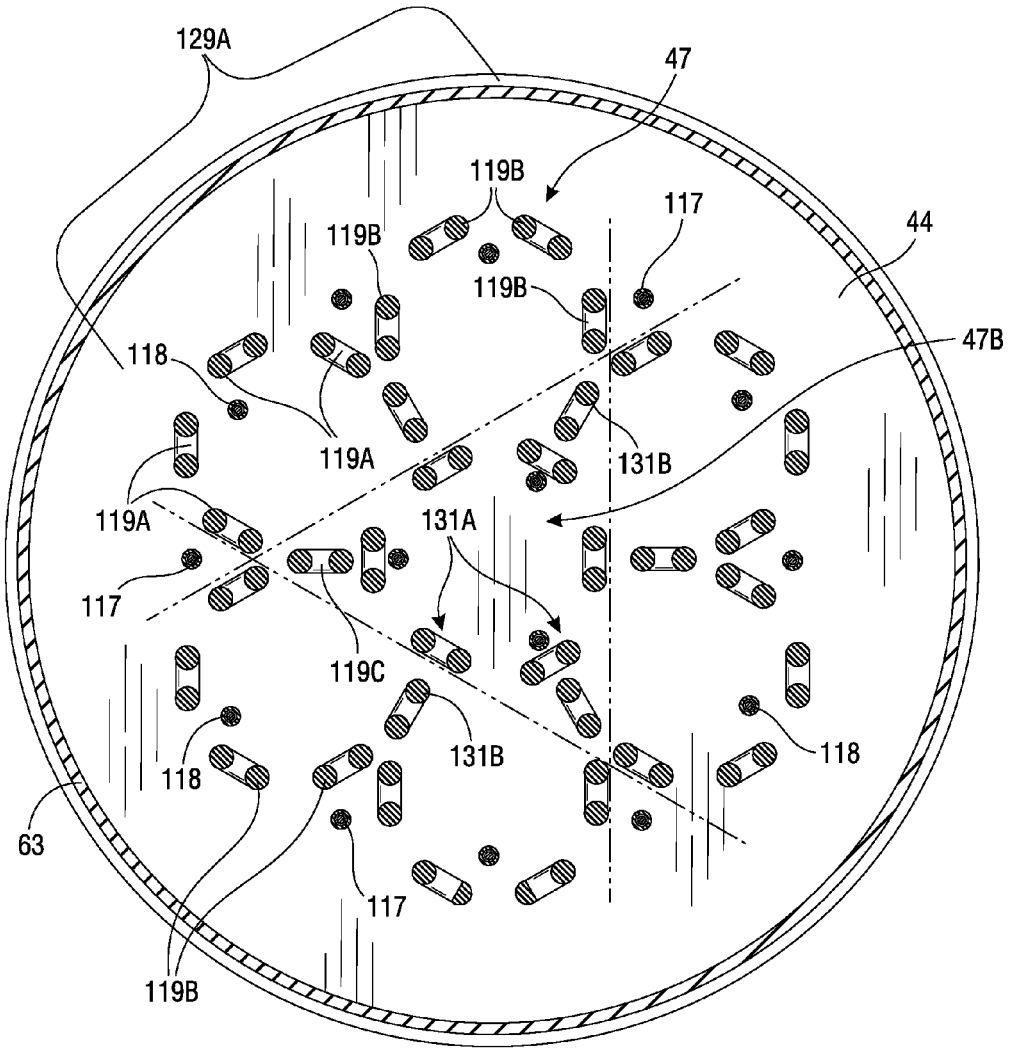
FIG. 11 is an enlarged, vertical sectional view taken generally along line 11-11 of FIG. 9 looking down in the direction of the arrows.

The preferred arrangement of heating zones in the high power embodiment is best illustrated in FIGS. 11 and 12. These vertical sectional views show placement of the heating elements and pressure vessels by looking down into the containment enclosure. The dashed lines, shown for illustration only, separate the four heating zones used in the high power embodiment.

A first heating zone is designated by the reference numeral 129A. Heating elements 119A, 119B associated with heating zone 129A are preferably disposed in two, somewhat circular patterns around two of the first stage pressure vessels 77. The electrode array 47 seen in FIG. 10 is identical to the combination of heating elements 119A, 119B in FIG. 11. There are intersecting dashed lines 133A, 133B and 133C drawn for convenience in FIG. 12 to show where the various heating zones are defined. First stage heating zones 129A, 129B and 129C (FIG. 12) all have nine heating elements. Zone 129A, for example, has four heating elements 119A substantially surrounding a first stage pressure vessel 77, four heating elements 119B surrounding an adjacent first stage vessel 77, and a ninth electrode 119C bordering two adjacent first stage vessels. Since there are three first stage heating zones, all having nine heating elements, there are twenty-seven "first stage" heating elements for heating the first stage pressure vessels 77 and 78. It will be appreciated that, in the high power embodiment, there is no thermodynamic isolation between the first and second stage pressure vessels 77, 78, so all heating elements can radiate heat to all pressure vessels.

In FIG. 12, the second stage pressure vessel 78 is located at the center of a triangular region defined between dashed lines 133A, 133B and 133C that represents the fourth heating zone 134. There are six heating elements 131A radially surrounding vessel 78 that are spaced apart at sixty degree intervals. Additionally, there are three heating elements 131B at the vertex of the triangles established by reference lines 133A-133C (FIG. 12). Heating elements 131A, 131B are similar to heating elements 119 and 119A-119C described above. Vessel 78 and its nine heating elements 131A and 131B occupy the fourth of the four heating zones used in the preferred high power steam generator embodiment.

C. Reduced Power Embodiment:

The reduced power steam generator 135 (i.e., FIGS. 13-20) is largely similar to the high power steam generator discussed above. The containment enclosure, its top and various internal portions are similar. The components are arranged similarly with, and externally appear identical to, the components seen in FIG. 1. The primary difference in the reduced power embodiment relates to the use of a different electrode module, which provides less heat than that described above. Again, there are three interfitting, stacked, modular components, comprising a steam module 46 identical with that described above, a different electrode module 145 (i.e., FIG. 15), and a similar thermocouple module 141 (FIG. 13), which interfit with one another. As explained further below, electrode module 145 (FIG. 15) comprises a plurality of internally heated, canisters 150, 151 that respectively receive pressure vessels 77 and 78 to heat the steam module 46. Preferably Fibrothal-brand canisters manufactured by Sandvik are preferred.

Generator 135 uses the same containment enclosure 66 with the same lower base 67 (FIG. 13, 14) with the same cylindrical extension 63 coupled atop the base in the manner described previously. Circular cover 64 (FIG. 13) sits atop the containment extension 63 as before. The same coupling brackets discussed before are used. When cover 64 is removed from vessel extension 63 (FIG. 13), an upper, generally cylindrical thermocouple volume 140 (FIG. 13) is exposed. Volume 140 lies between cover 64 and the thermocouple module 141 (FIG. 13) mounted below.

Figure 14:
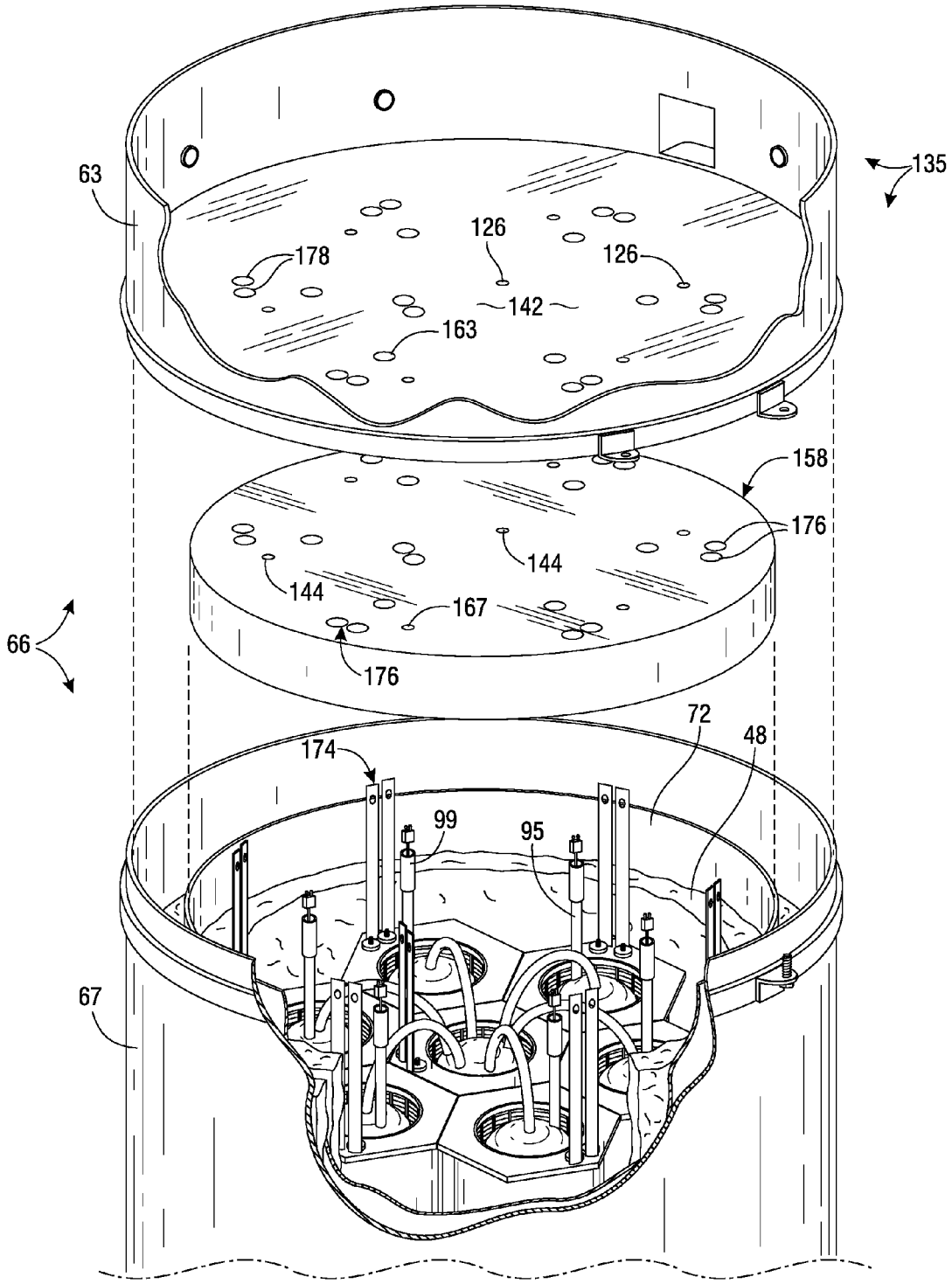
FIG. 14 is a partially exploded, fragmentary isometric view the reduced power containment enclosure of FIG. 13 with the thermocouple header spaced away, with portions thereof broken away for clarity or omitted for brevity.

The thermocouple module 141 comprises a rigid, circular header plate 142 that surrounds upper portions of temperature-sensing thermocouples. A first thermocouple array 143 (FIG. 13) comprises thermocouples 137 (i.e., FIG. 13), that include lower elongated portions 138 (FIG. 17) that extend coaxially downwardly within pipes 139 (FIGS. 17, 18) to electrode module canisters 150, 151. A rigid, circular, thermocouple header plate 142 seats coaxially within the containment enclosure extension 63. Beneath it is a shroud cover 158, that coaxially attaches to shroud 72 and is centered within containment enclosure base 67 (i.e., FIG. 14). Pipes 139 clear header plate 142 through orifices 126, and clear shroud cover 158 through orifices 144 (FIG. 14). In generator 135, the steam module pressure vessels 77, 78 are each housed within a separate heating canister, and thermocouples 137 measure the temperature in individual canisters 150. Preferably thermocouples 137 are type "R." All thermocouples are appropriate for measurements up to 1800° F.

Figure 17:
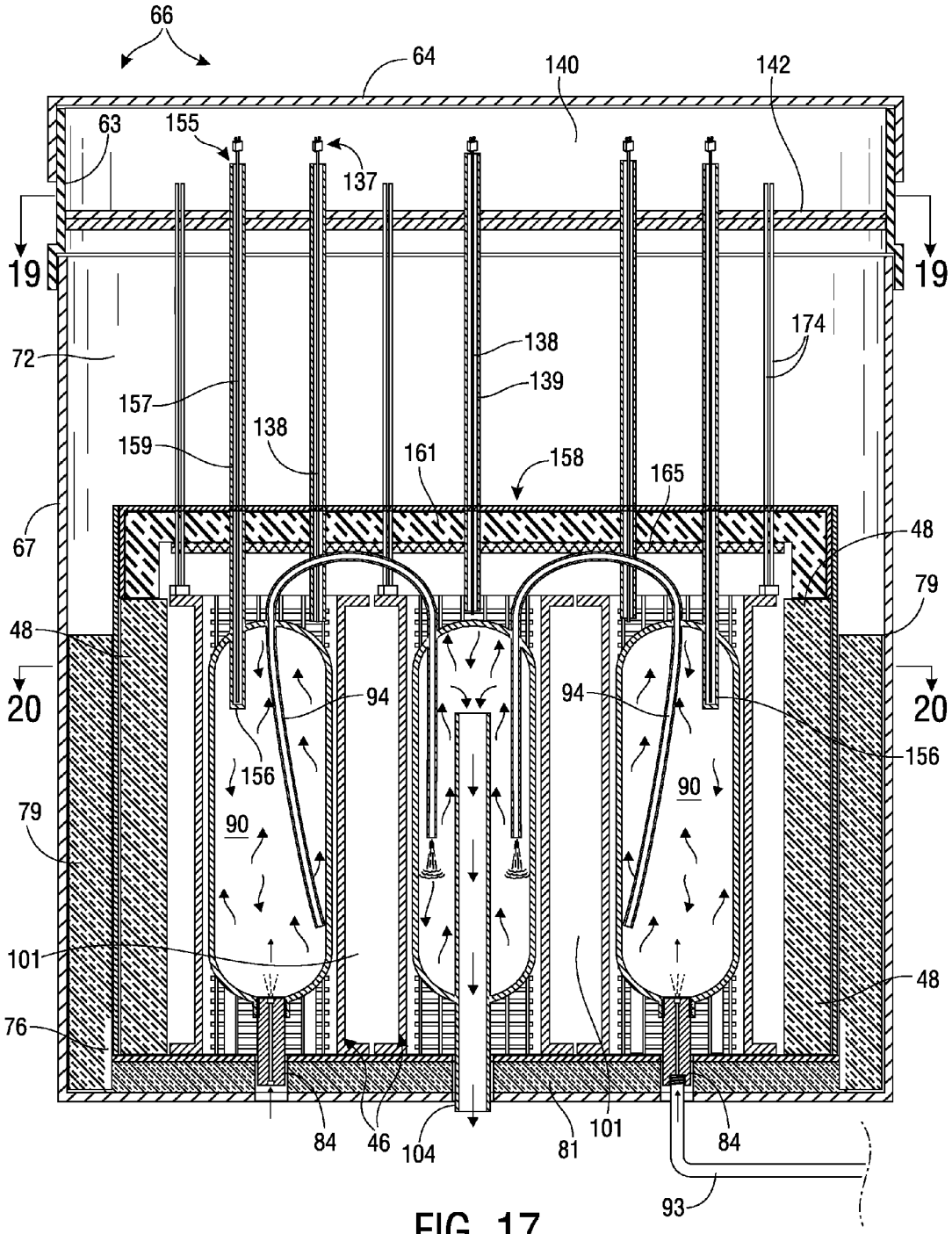
FIG. 17 is an enlarged, longitudinal sectional view of the assembled reduced power steam generator containment enclosure.

The second thermocouple array 154 comprises thermocouples 155 (FIGS. 13, 17-20) that monitor the interior temperature of the first stage pressure vessels 77. Preferably thermocouples 155 are type "K." Thermocouples 155 include lower, elongated portions 157 (FIG. 17) extending downwardly through pipes 159, that terminate within first stage pressure vessels 77 in a closed end 156 (FIG. 17). Thermocouples 137 and 155 include suitable wiring, generally designated by the reference numeral 171 (i.e., FIG. 13) for interconnecting them with the computer circuitry discussed hereinafter. Thermocouple header plate 142 has orifices 163 that clear thermocouple pipes 159. Shroud cover 158 has clearance orifices 167 (FIG. 14). Optionally an insulated, resistive heater assembly 165 (FIG. 15) is disposed beneath insulation layer 161 underneath cover 158 to further warm the steam module 46 positioned below. Preferably an insulation bundle 48 is coaxially centered within shroud 72, and outer insulation bundle 79 is entered outside shroud 72.

The reduced power steam generator 135 uses a modified electrode module 145 (FIGS. 15, 16), that comprises a plurality of radially spaced-apart, internally heated canisters 150, 151. Each canister contains internal, coiled heating elements wrapped in vacuum-formed, ceramic fiber insulation. The heater elements run on 240 V.A.C. power. The first stage pressure vessels 77 of the steam module 46 are received within canisters 150, and the second stage pressure vessel 78 is housed within central canister 151.

Figure 16:
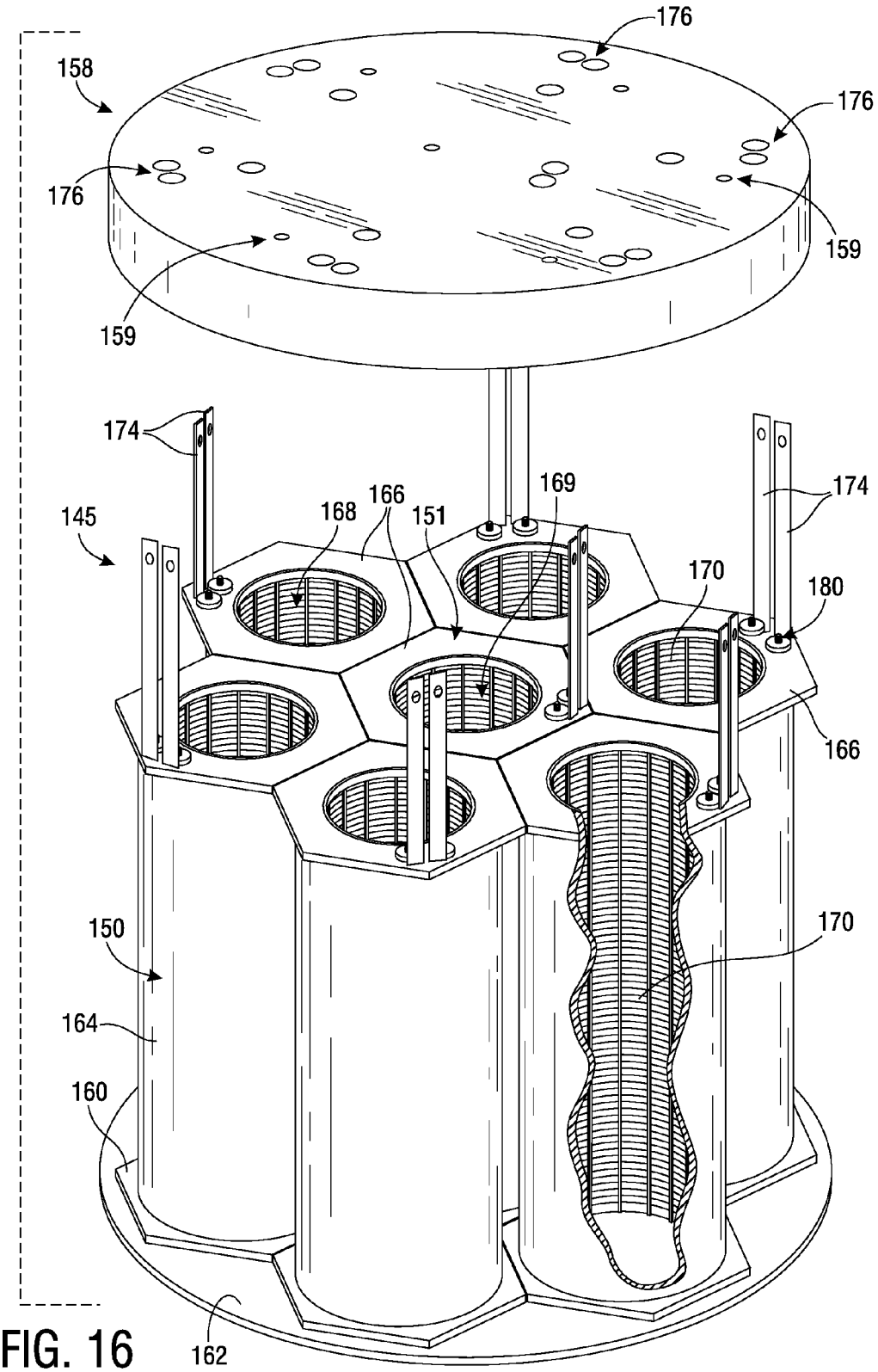
FIG. 16 is an isometric view of the electrode-bearing, canister array used with the reduced power generator that receives the steam module.
Figure 21:
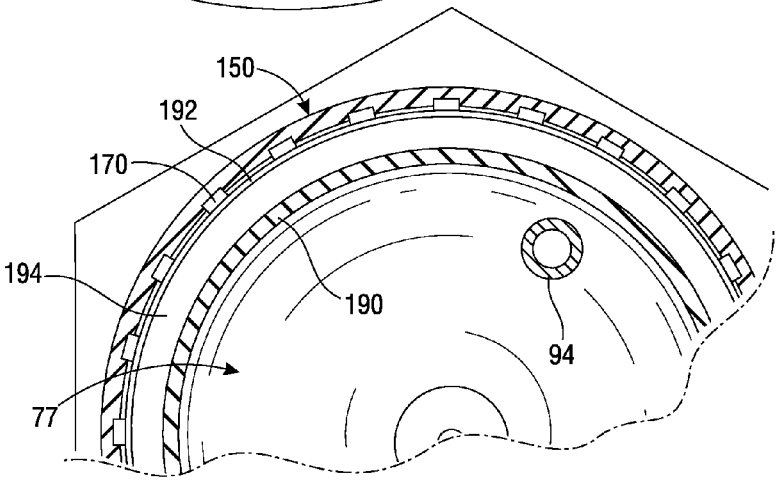
FIG. 21 is an enlarged, fragmentary sectional view of circled region 21 in FIG. 20.

Each canister 150 is disposed upon a rigid, polygonal support plate 160 disposed upon rigid floor 162 within shroud 72 previously discussed. Each canister 150 (FIG. 16) comprises a generally cylindrical, hollow casing 164 that extends from a lower support plate 160 to an upper, polygonal cap 166. Preferably plates 160 and caps 166 are hexagonal, because there are six canisters for the first stage pressure vessels that are arranged around the canister for the second stage pressure vessel 78. When arranged as in FIG. 16, the various caps 166 nest together and abut adjacent caps, forming a coplanar surface. Canisters 150 for the first stage pressure vessels 77 comprise an opening 168 that receive and house first stage pressure vessels 77. A similar opening 169 in the center canister receives the second stage pressure vessel 78 when the steam module 46 is lowered into place. The coiled electrodes within each canister 150 are designated by the reference numeral 170 (FIGS. 16, 21). As can be seen, the electrode comprises a coil of electrically resistive conductor shaped like a tube, and radiused to allow the pressure vessels to coaxially fit within the center of the coil.

The heating coil 170 is interconnected with a source of A.C. power through pairs of upright, terminal bars 174, that extend through orifices 176 in shroud cover 158 and orifices 178 (FIG. 14) in plate 142 (FIG. 19). The terminal bars 174 are secured at their bottoms to suitable insulators 180 (FIG. 16) on the hexagonal canister caps 166 that provide mechanical support. In the best reduced or medium power mode known to us at this time, there are seven heating zones, one for each canister. Power is supplied through wiring and computer control circuitry to be hereinafter described.

Figure 20:
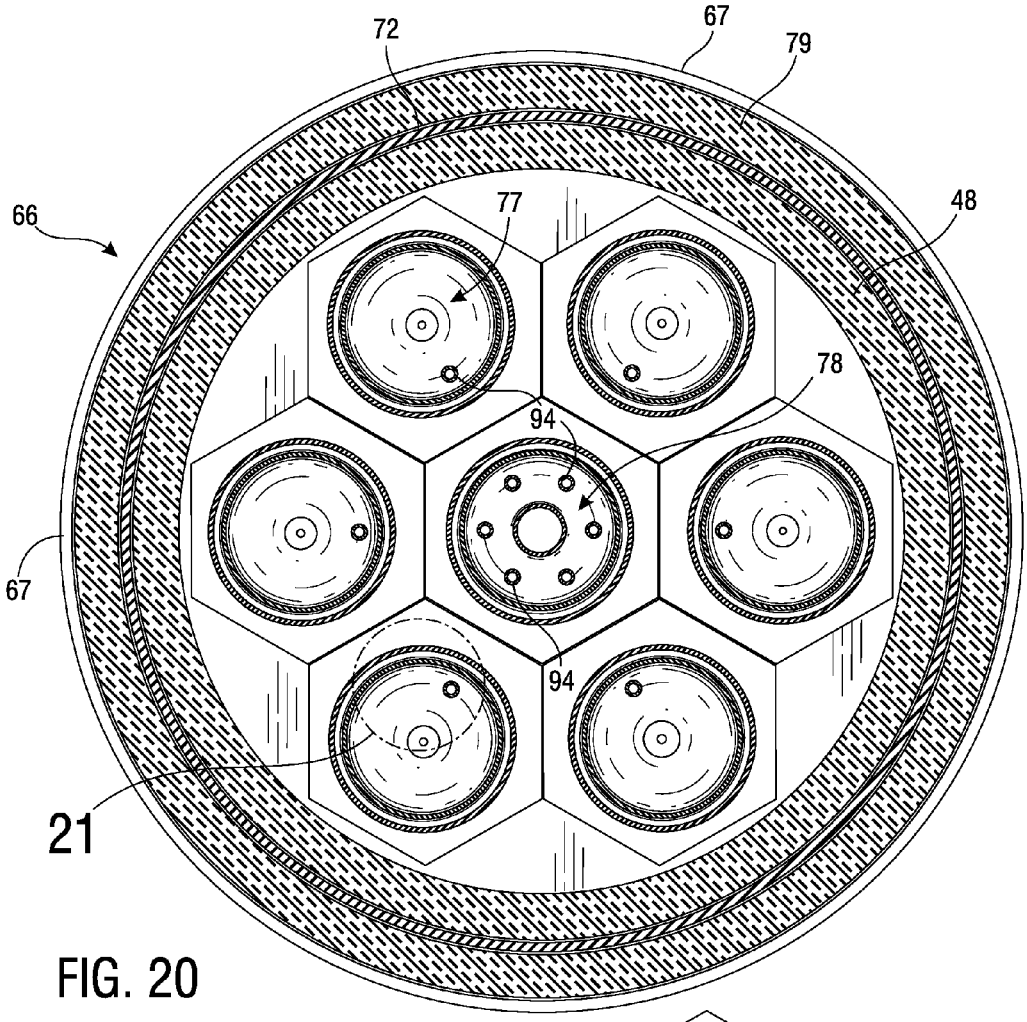
FIG. 20 is an enlarged, vertical sectional view taken generally along line 20-20 of FIG. 17 looking down in the direction of the arrows.

Referencing FIGS. 20 and 21, the outer steel jacket of a pressure vessel 77 has been designated by the reference numeral 190. Portions of a surrounding canister 150, including the heating coil 170 and insulation 192 are visible, spaced apart from the vessel jacket 190. There is an annulus 194 between the vessel jacket 190 and the heating coil 170 across which heat is transmitted through the phenomena of radiation to the first stage pressure vessel 77.

D. Heat Transfer Characteristics

As used herein, the term "superheated steam" means steam in which the operating temperature of the gas (i.e., steam) exceeds that of the saturated steam temperature at the given operating pressure of interest. Superheated steam is physically produced by the addition of heat to saturated steam (being a mixture of both the liquid and gaseous phases of water), whereby the liquid phase has been removed in its entirety. Once the liquid phase has been eliminated, the addition of heat causes the temperature of the steam to increase beyond its associated saturation temperature. The resulting properties of the superheated steam then closely approximate those of a perfect gas as opposed to the mixed phase vapor associated with the saturated steam environment. In comparison with saturated steam, whose temperature is bounded while the presence of liquid water exists, superheated steam in the pure gaseous form can reach temperatures consistent with the degree of heating supplied by the respective source of heat. In addition, superheated steam cannot condense (i.e., creating the presence of liquid water) without its temperature being reduced to the temperature of saturated steam at the pressure of interest. As long as the gas temperature is above that of saturated steam at the corresponding pressure, it is in the superheated regime and before condensation is possible, the number of degrees of superheat must vanish through some method or combination of methods of heat transfer (i.e., conduction, convection, and radiation).

Another consideration in the employment of superheated steam in our generators is the absence of liquid water in the superheater vessels and attached outlet piping. In comparison to the use of saturated steam by others in the industry, the thermal conductivity of superheated steam, that is, its propensity to reject heat to the surrounding environment and nearby components, is much lower than that of purely saturated steam and therefore, its heat will not be transmitted as quickly to the walls of the pipe as when saturated steam may be flowing through the outlet pipe. The only loss through the superheated steam system then becomes only a loss of some degree of sensible heat, resulting in an insignificant loss of heat capacity at the end of the outlet piping for the process fluid. Furthermore, our superheated steam generators enable a considerable amount of heat to be radiated from the exterior piping surfaces and still be capable of delivering dry, superheated steam in the form of "steam for use."

In stark comparison, the radiative and convective losses through a similar piping system utilizing saturated steam may be significant if the heat losses result in a transition through the pressure-temperature relations associated with saturation and the latent heat of the process fluid is lost. In comparison, the latent heat capacity of the superheated steam system will remain available while only giving up an insignificant amount of sensible heat of the process fluid with the generators described herein. These positive attributes of the superheated steam supply system are a direct result of the poor conduction heat transfer properties of superheated steam when compared to a saturated steam system, even though the superheated steam system is hotter and contains more energy than a saturated steam system.

Figure 22:
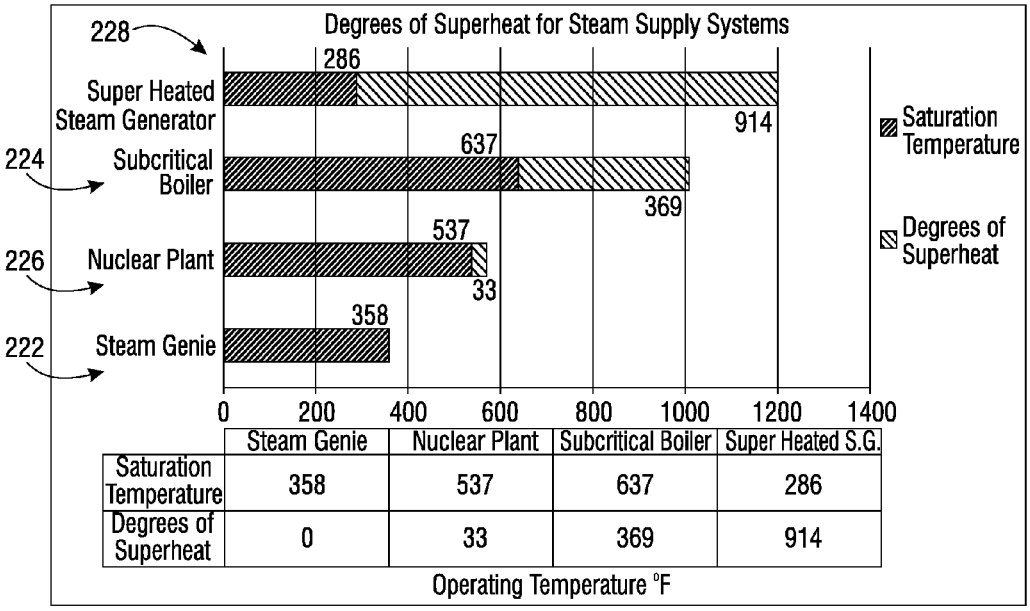
FIG. 22 is a stacked bar graph illustrating superheat characteristics of the subject invention.

The superheated steam generators described herein make use of a combination of radiant heating sources employing the radiation heat transfer mode utilized in combination with the convection heat transfer mode on the external surface areas of the steam module 46, i.e., the first stage vessels 77 and second stage pressure vessel 78, resulting in the production of superheated steam in excess of 900° F. as depicted in FIG. 22 on the right half of stacked bar graph 228. This degree of superheated steam is exceptional in comparison with that of commercial nuclear power plants whereby the degree of superheat is most often significantly less than 100° F. as depicted in FIG. 22 on the right half of stacked bar graph 226. The degree of superheat is not the operating steam temperature, but rather, the measure of the temperature difference between the outlet steam temperature and the saturation temperature of the steam at a given coincident pressure, commonly expressed in psig. The operating temperatures of four steam supply systems may be divided into two constituent portions: the saturation temperature (i.e., the left half of each bar chart) and the additional degrees of superheat, if any, (on the right half of each bar chart) as shown on the stacked bar graphs of FIG. 22, items 222, 224, 226, and 228.

Referring now to FIG. 22, a clear comparison of our superheated steam generators is made to three other forms of steam producing plants and components. As the sensible heat that is available over and above that at the saturation temperature (and associated pressure) is a direct function of the number of degrees of superheat, FIG. 22 depicts that the number of degrees of superheat for our superheated steam generators is in excess of 914° F. (item 228, right half of stacked bar chart) as compared to a subcritical, fossil fueled boiler at 369° F. (item 224, right half of stacked bar chart); a commercial nuclear power plant at 33° F. (item 226, right half of stacked bar chart); and a commercial steam genie, operating at saturation temperature and providing literally no available superheat (item 222, in which the right half of stacked bar chart does not exist because there is no superheat). In other words, the number of degrees of superheat is also the difference of the operating temperature of each system (shown on the horizontal axis label of FIG. 22) less the respective saturation temperature at which each system operates as depicted by items 222, 224, 226, and 228. The associated bar graph for each of the defined systems depicted in FIG. 22 is further comprised of two constitute parts, namely the saturation temperature (on the left side of each bar) and the number of degrees of superheat (on the right side of the bar); when taken in summation represents the operating temperature of each system. Furthermore, it can be deduced from FIG. 22 item 228 that our superheated steam generators while operating at 1200° F. with a saturation temperature of 286° F. produces 914° F. of superheated steam. Any increase in the operating temperature does not change the saturation temperature but results in an even greater heat capacity as a result of the increase in the number of available degrees of superheated steam and available sensible heat.

Figure 23:
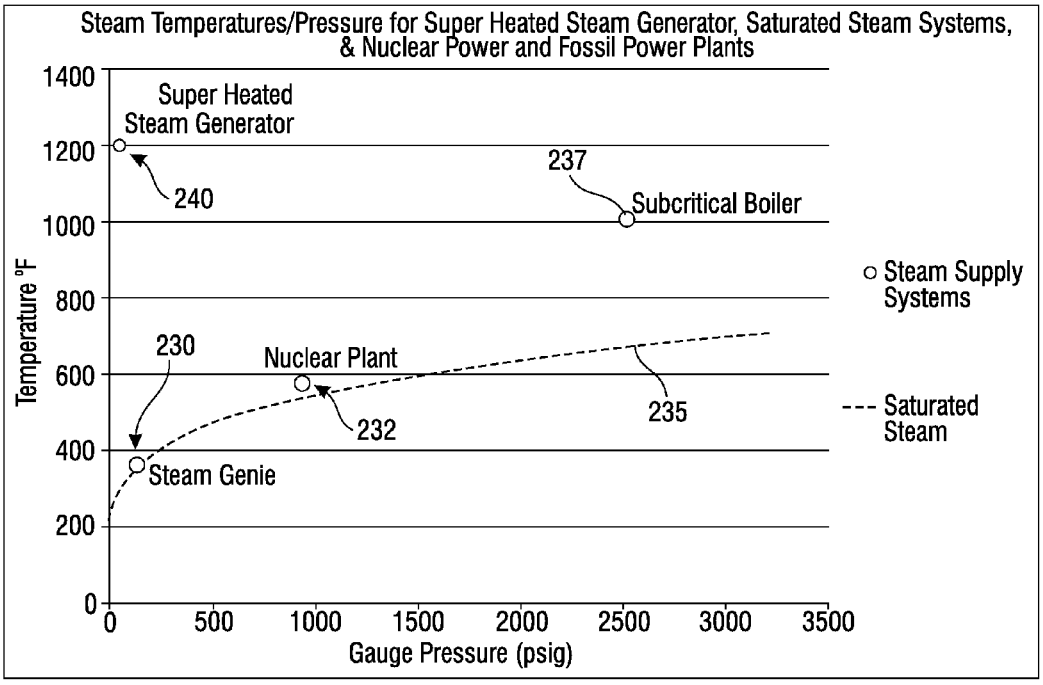
FIG. 23 is a graph of temperature vs. gauge pressure comparing the subject invention with known prior art steam suppliers or devices.

A second major feature of the superheated steam generators is the operating steam outlet temperature, which is in excess of 1200° F. Turning to FIG. 23, typical commercial steam genie temperature and gauge pressure is plotted at point 230 (FIG. 23) and lies coincident with the saturated steam curve along graphical trace 235 (representing zero degrees of superheat). A nuclear power plant steam temperature and coincident operating pressure is plotted at point 232, slightly vertical of graphical trace 235. A typical subcritical boiler is plotted at point 237 which is measurably vertical of trace 235. Our superheated steam generator, however, is plotted at 240 (FIG. 23). The outlet steam temperature is significantly higher than that available by normal commercial means and industry standards, and it occurs at a significantly lower coincident operating pressure than those of other industry steam producing devices and plants. For comparison purposes, the operating steam outlet temperatures available through superheated steam systems associated with that of both fossil and nuclear power plants and steam district heating distribution systems are in general less than 650° F. The subject outlet steam temperature in our superheated steam generators additionally and distinctively differentiates this process from industry standards in the production of superheated "steam-for-use."

Quite significant is the relatively low operating pressure of our generators, which is taken to be 40 psig as compared to the commercial steam genie at approximately 135 psig; the nuclear power plant in excess of 900 psig; and the subcritical fossil fueled boiler at approximately 2500 psig as depicted in FIG. 23, reference numerals 240, 230, 232, and 237, respectively. The low operating pressure is clearly depicted in FIG. 23 with respect to the operating temperature of 1200° F., which produces 914° F. of superheated steam as shown previously in FIG. 22, item 228. In summary, the coincident relatively low internal pressure associated with the extraordinarily high degree of available superheat and sensible heat distinctively differentiates the disclosed generators and processes from industry standards in the production of superheated "steam-for-use."

Figure 24:
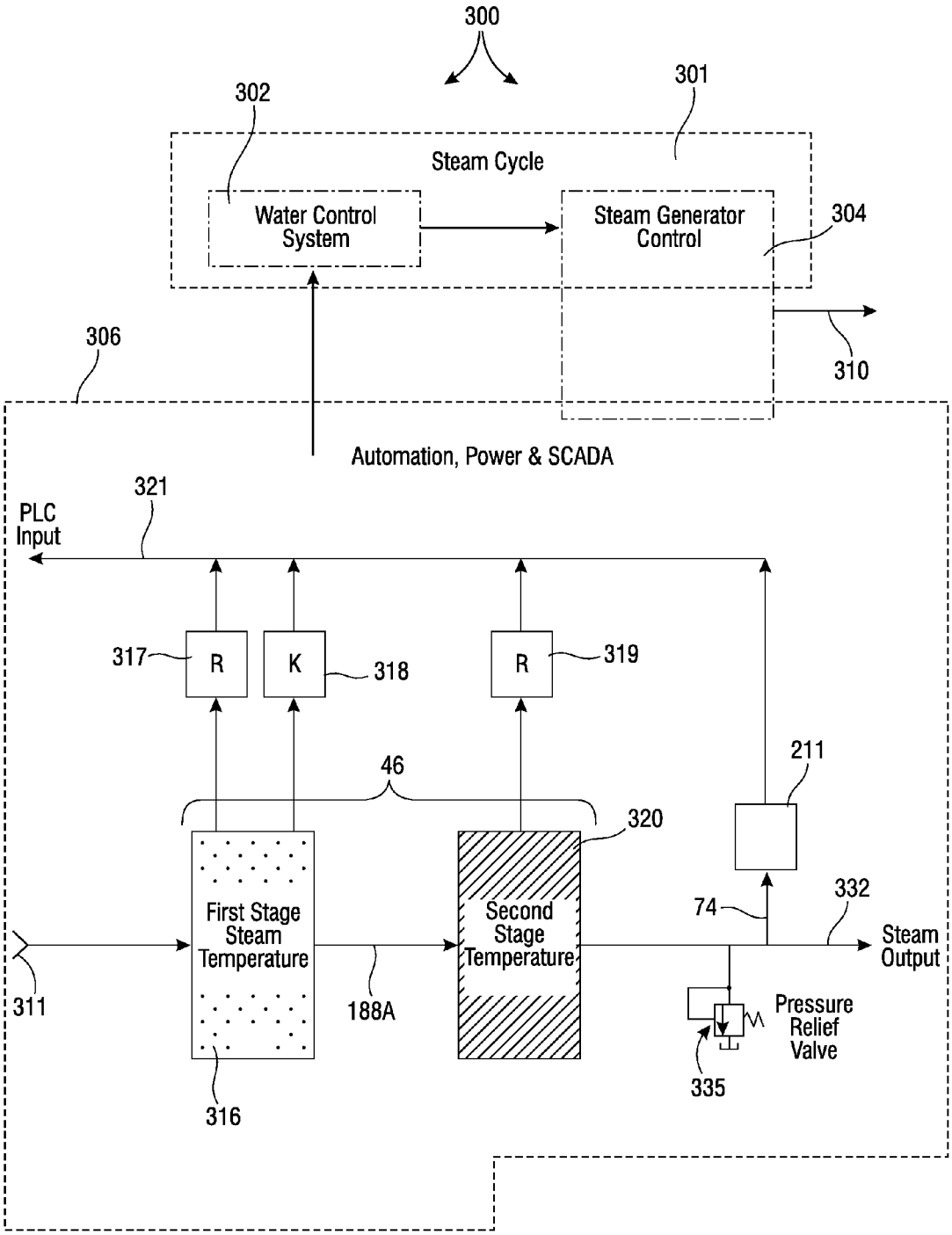
FIG. 24 is a generalized block diagram of the computerized temperature monitoring. water control, and steam generator control system.

E. Flow Control:

With reference now directed to FIG. 24, the basic water and steam cycle 300 is diagrammed extremely generally for simplicity. The steam generator 50 (i.e., FIG. 1) executes a steam cycle, generally indicated by the reference numeral 301, that involves the coordination of a water control system 302, with the steam generator control system 304. The reference numeral 306 generally indicates the computerized PLC automation and power control systems described later that interacts with systems 302 and 304. Line 310 from the steam generator control system 304 connects with line 311 (FIG. 24) that leads to temperature sensing thermocouples associated with the steam module 46 described previously. The first stage pressure vessels 77 are collectively and diagrammatically indicated by the reference numeral 316. Thermocouples 39A and 39B (i.e., FIG. 3) associated with the first stage pressure vessels 77 are collectively designated by the blocks 317 and 318. Line 188A (FIG. 24) collectively designates the transmission of steam from all first stage pressure vessels 77 through pipes 94 (FIG. 9) to the second stage pressure vessel 78, represented by block 320. Line 332 (FIG. 24) schematically indicates the steam output pipe, mechanically designated by reference numeral 104 in FIGS. 8 and 9. Excesses in steam pressure are prevented by pressure relief valve 335.

In FIG. 24, the block 317 collectively indicates the "R type" thermocouples 39A that measure temperature between vessels 77. Block 318 collectively represents "K type" thermocouples 39B that measure process temperatures within the first stage pressure vessels 77. Similarly, block 319 (FIG. 24) diagrammatically indicates "R type" thermocouples 39A disposed proximate the second stage vessel 78. Sensor 211 (FIG. 24) measures output steam temperature. The electrical thermocouple lines leading to the PLC computer circuitry are collectively designated by line 321 (FIG. 24).

Figure 25:
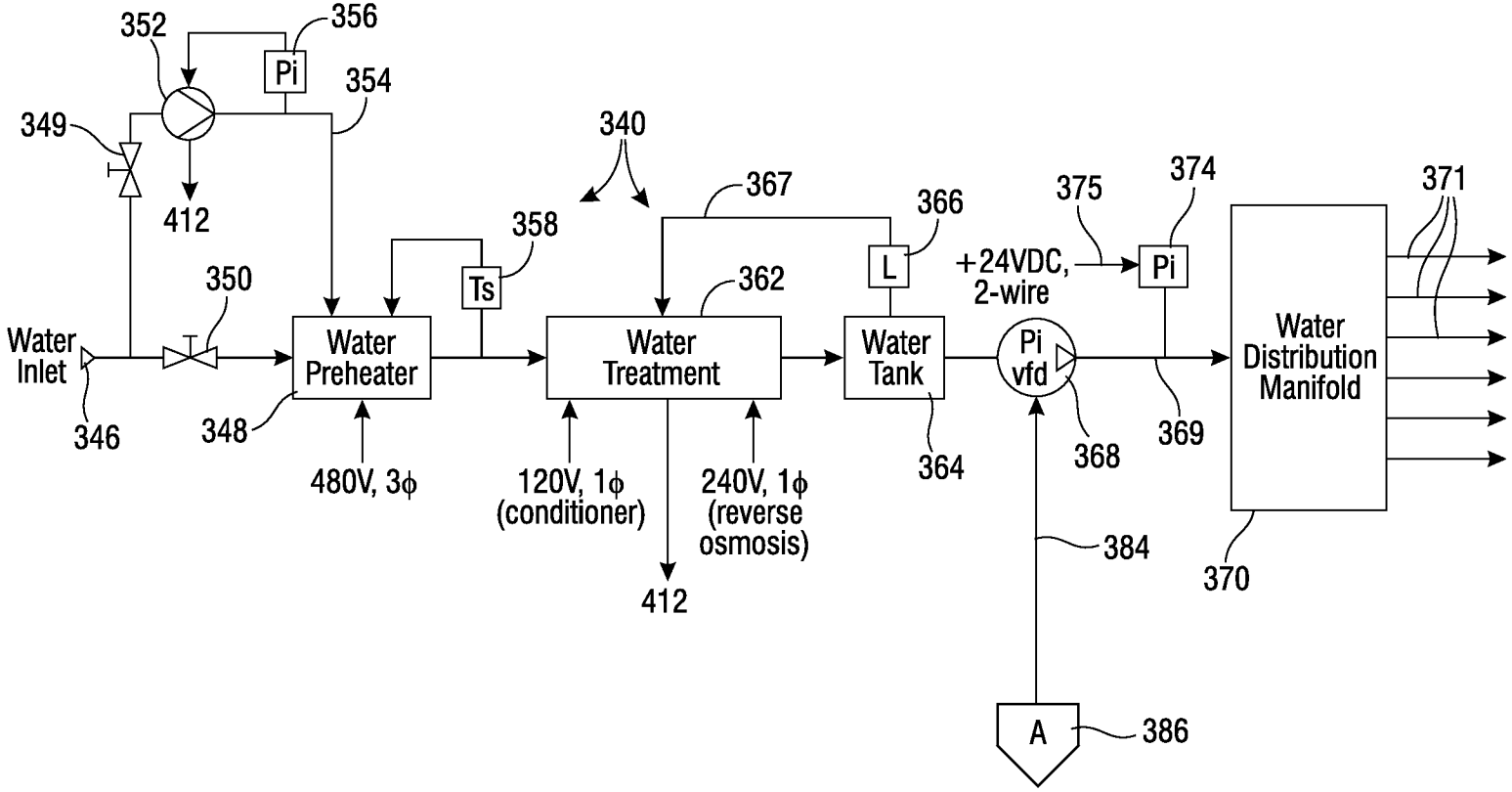
FIG. 25 is a block diagram of the preferred water feeding system.

With reference now to FIG. 25, the water delivery system is generally indicated by the reference numeral 340. Most of the components used in water delivery system 340 are disposed within conventional enclosure 68 (FIG. 1). A water supply comprising either a high pressure or low pressure water source at a job site is connected to water inlet 346 (FIG. 25). If an external water tank supplies water to inlet 346 (i.e., an on-site, low pressure source), valve 350 is manually closed and valve 349 is open. If higher pressure, "supplied" water is available at inlet 346 (FIG. 25), such as that provided by a municipal utility, then valve 350 is manually "opened" and valve 349 is "closed," so water may travel directly through valve 350 to preheater 348. Valve 349 establishes a separate water inlet path, delivering water through main pump 352 and line 354 to preheater 348 (FIG. 25).

Water pretreatment commences with preheating in preheater 348. Preferably, water preheater 348 (FIG. 25) is powered by 480 volt A.C., three-phase power. The temperature of preheated water is monitored by thermostat 358. The water treatment block 362 has a low voltage, initial treatment stage, and includes a conventional reverse osmosis treatment stage, preferably a SIEMANS-brand model MICROD2D0500A, powered by 240 volt A.C. power. Block 362 (FIG. 25) outputs to a water tank 364 that has an overflow path 366 returning to water treatment block 362 via line 367.

The Variable Frequency Drive (i.e., "VFD") system pump 368 (FIG. 25) outputs at variable pressures, and is controlled by software and computer hardware explained below. System pump 368 is in fluid flow communication with water inlet 346. Water provided to the high pressure "VFD" pump 368 reaches water distribution manifold 370 via pipe 369, from which pressure is monitored in real time by pressure sensor 374. Line 375 interconnects pressure sensor 374 (FIG. 25) with the PLC input card 374A (FIG. 26) so the PLC 390 (FIG. 26) can analyze the input pressure applied to manifold 370. Preferably, there is a separate water delivery output line 371 for each first stage pressure vessel 77 exiting water control manifold 370 (i.e., FIGS. 25, 27).

The schematically represented water delivery output lines 371 (FIG. 25) represent hardware feed lines 69 (FIG. 1) and vessel feeders 93 (FIG. 8) described earlier that direct water through injectors 84 at the bottom of the first stage pressure vessels 77. The water distribution manifold 370 (FIGS. 25, 27) is thus fed by the variable pressure, VFD system pump 368 that is ultimately PLC controlled.

VFD system pump 368 (FIG. 25) is controlled by the PLC computer system discussed below. A pump control line 384

Figure 26:
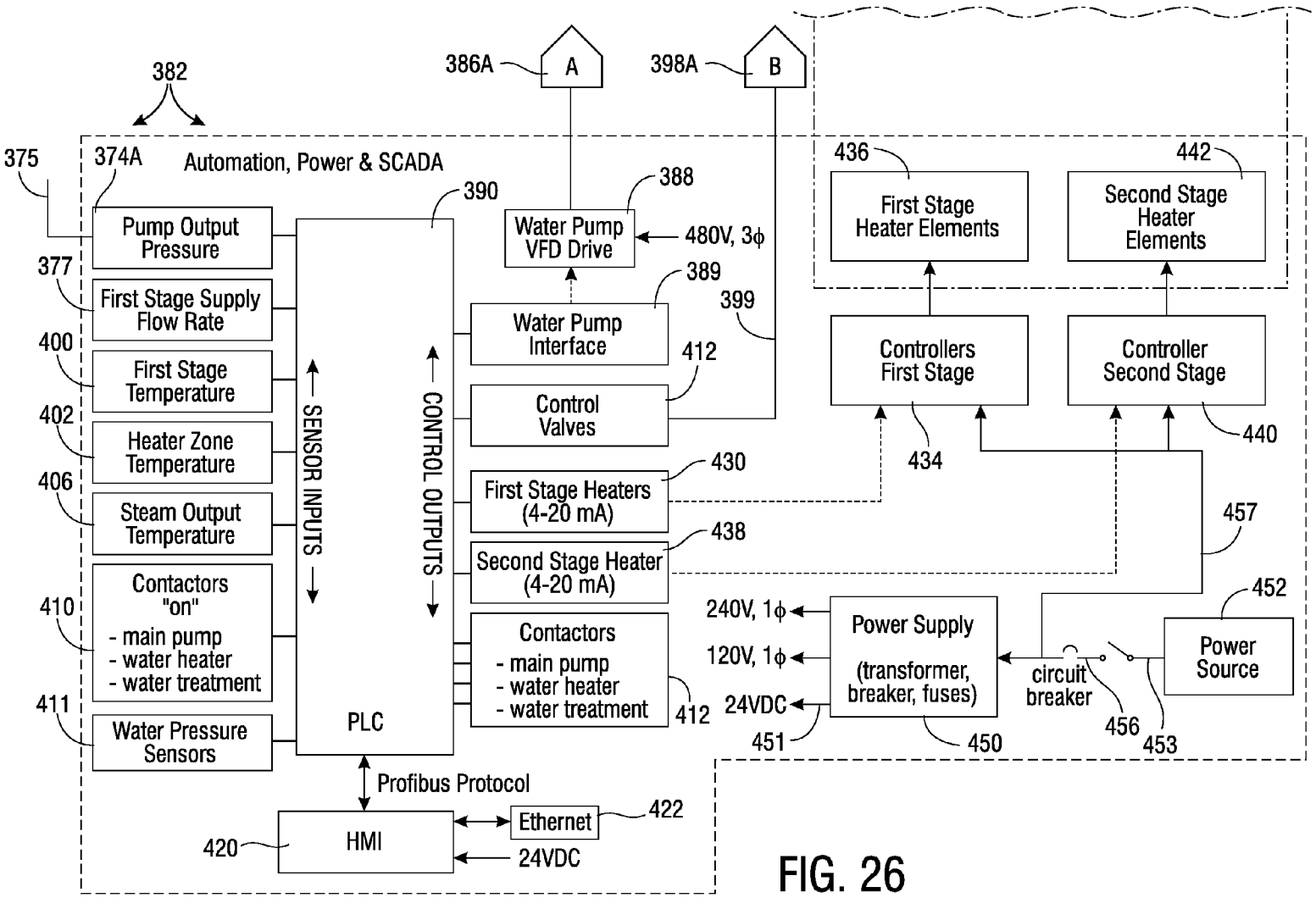
FIG. 26 is a generalized block diagram of the Programmable Logic Controlled (PLC) computer automation system.

(FIG. 25) leads to junction 386 that connects to junction 386A in FIG. 26. The high-pressure VFD system pump 368 (FIG. 25), is controlled by the PLC-driven, variable-speed drive controller 388 (FIG. 26) that is linked to junction 386A and powered by 480 volt A.C. three-phase electricity. Drive controller 388 is controlled by PLC computer interface 389 (FIG. 26) that is controlled by PLC 390. In general, VFD system pump speed control is responsive to pump pressure. The PLC input card 374A (FIG. 26) monitors VFD system pump pressure sensor 374 (FIG. 25) discussed above. Various temperature sensor input blocks feeding PLC 390 (FIG. 26) are also sensed by software to control the VFD system pump 368.

Figure 28:
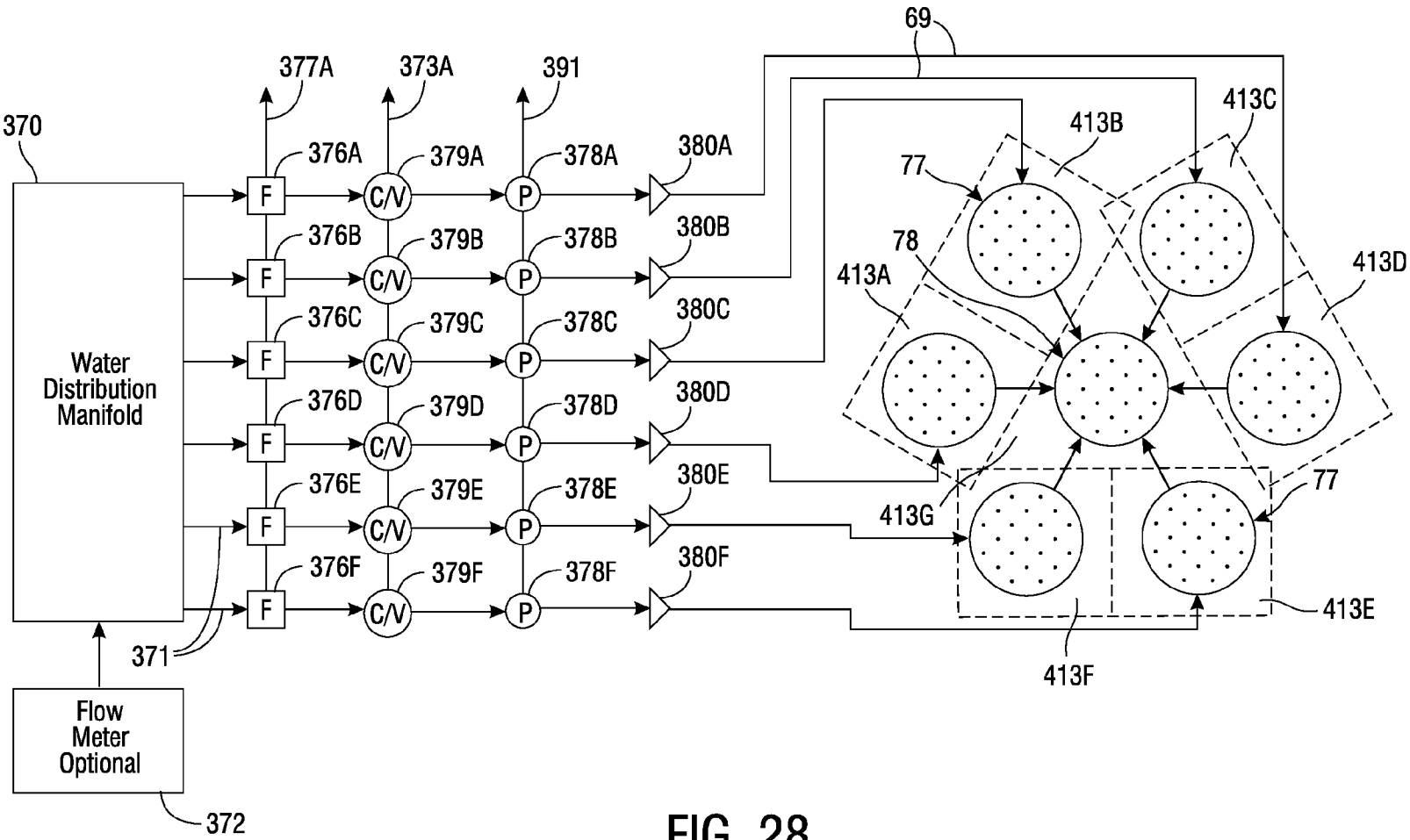
FIG. 28 is a generalized schematic diagram of the preferred water feeding system used with the reduced power generator, with seven pressure vessel heating zones shown in dashed lines.

FIGS. 27 and 28 show water control details for the high power and reduced power generators respectively. In either case there are two modes for controlling water flow. First, a separate flow meter 372 may control bulk water flow through water distribution manifold 370. The flow meter 372 may comprise an OMEGA-brand model FPD 2011-A. In the best mode, however, separate water lines 371 output water from distribution manifold 370 first to the first stage steam vessels 77. There is one line 371 for each first stage pressure vessel 77. Each of the lines 371 lead to separate, inline water flow indicators 376A-376F. Bus 377A (FIG. 27) from flow indicators 376A-376F connects to PLC input block 377 (FIG. 26) to deliver flow control information to the PLC 390. Flow control information derived from bus 377A is one of the parameters used by the PLC to adjust the VFD system pump 368 (FIG. 25) through PLC output block 389 (FIG. 26.)

The flow indicators 376A-376F (FIGS. 27, 28) respectively feed inline, control valves 379A-379F that enable or disable the water flow delivered to each of the first stage pressure vessels 77 in both the high power and reduced power embodiments. Control valves 379A-379F are either fully "on" or "off" for fail-safe operation, and they are opened by the software at machine start up. The control valves 379A-379F (FIG. 27) may comprise electrically operated, solenoid control led valves. The control valve bus 373A (FIG. 27) is interconnected with PLC drive block 412 through lines 399 and junction 398A (FIG. 26) for software control. Power is supplied by the 24 volt D.C. power supply line 451 emanating from the multiple voltage power supply 450 (FIG. 26).

In the best mode control valves 379A-379F (FIG. 27) respectively connect to inline pressure sensors 378A-378F that monitor water pressure transmitted to each of the first stage pressure vessels 77. Sensed pressure information from sensors 378A-378F is delivered via bus 391 to "Pressure Sensor" input card 411 (FIG. 26) connected to PLC 390.

Finally, flow continues from the pressure sensors 378A-378F (FIGS. 27, 28) to the individual first stage pressure vessels 77 through one-way, back-flow prevention check valves 380A-380F. As seen in FIG. 27, the six first stage pressure vessels 77 in the high power mode are arranged into three zones 129A, 129B, and 129C, and the second stage vessel 78 occupies a fourth heater zone 134. As seen in FIG. 28, it is preferred in the reduced power mode that the pressure vessels 77, 78 are arranged into seven, separate heating zones 413A-413G.

F. Computer Details:

Referring to FIG. 26, PLC 390 provides the heart of the computer automation system 382. Software steps are detailed hereinafter. Several PLC-monitored input cards are shown at the left of FIG. 26. The output pressure of system pump 368 (FIG. 25) is monitored by card 374A (FIG. 26) that receives an input from sensor 374 (FIG. 25) as discussed earlier. Pump pressure control signals are handled by controller 388 and drive 389 (FIG. 26) discussed earlier. PLC input block 377 (FIG. 26) receives separate inputs from each flow rate sensor 376A-376F seen in FIG. 25.

The thermocouples 39B internally monitoring each first stage pressure vessel 77 input signals to a "First Stage Input temperature" block 400 (FIG. 26) that collectively receives separate temperature inputs from thermocouples 39B. Each thermocouple 39B is monitored by the PLC 390 and the data is utilized by the software discussed later. The thermocouples 39A externally monitor the temperature of the heating elements proximate first stage pressure vessels 77 and second stage pressure vessel 78. The "Heater Zone Input temperature" block 402 (FIG. 26) collectively receives separate temperature inputs from thermocouples 39A. Each thermocouple 39A is monitored by the PLC 390 and the data is utilized by the software described in detail hereinafter.

The "Steam output temperature" sensing block 406 (FIG. 26) receives inputs from the sensor 211 (FIG. 24). Temperature data is delivered to "Steam output" temperature monitoring block 406 (FIG. 26) that feeds PLC 390 and is analyzed by software discussed hereinafter.

In the software-controlled "start-up" and "ramp-up" sequences discussed below, input card 410 (FIG. 26) delivers sensed "power on" status to the PLC 390 from several components. Referencing FIG. 25, these include the main pump 352, the preheater 348, and the water treatment block 362. Output block 412 (FIG. 26) effectuates computer control of these parameters from PLC 390. All of these devices are turned on during the machine start up cycle.

The "human-machine interface" (HMI) block 420 (FIG. 26) communicates with PLC 390 to present a visual computer display. Ethernet connectivity is indicated at block 422. A Profibus protocol (i.e., "Process Field Bus") is preferably established.

G. Heater Details:

Heating elements associated with the electrode modules are energized by power control circuits 500, 500B (FIGS. 29, 30) in response to the computer automation system 382 (FIG. 26). Various parameters handled by PLC 390 (FIG. 26) from the previously described input blocks are handled by software discussed hereinafter to control the various heaters. Heating elements associated with the first stage pressure vessels 77 are actuated by PLC-operated, zone controller card 430 (FIG. 26) that controls SCR-controllers collectively designated by the reference numeral 434 (FIG. 26). Zone controller card 434 limits the operating voltage and current applied to the heater elements 119A-119C discussed earlier in the first stage heaters indicated collectively by block 436 (FIG. 26). The second stage pressure vessel 78 is actuated by PLC block 438 (FIG. 26) that similarly operates controller block 440. Power is applied to block 442 (FIG. 26) that collectively represents the heater elements associated with the second stage pressure vessel 78.

In FIG. 26 the main power supply is designated by the reference numeral 450. This supply outputs single phase, 240 volt current, single phase 120 volt current, and twenty-four volt DC. Power supply 450 operates from a 480 volt AC, three-phase tap provided by source 452 which is interconnected via switch 453 and circuit breaker 456. Line 457 supplies 480-volt single phase power to blocks 434 and 440.

Figure 29:
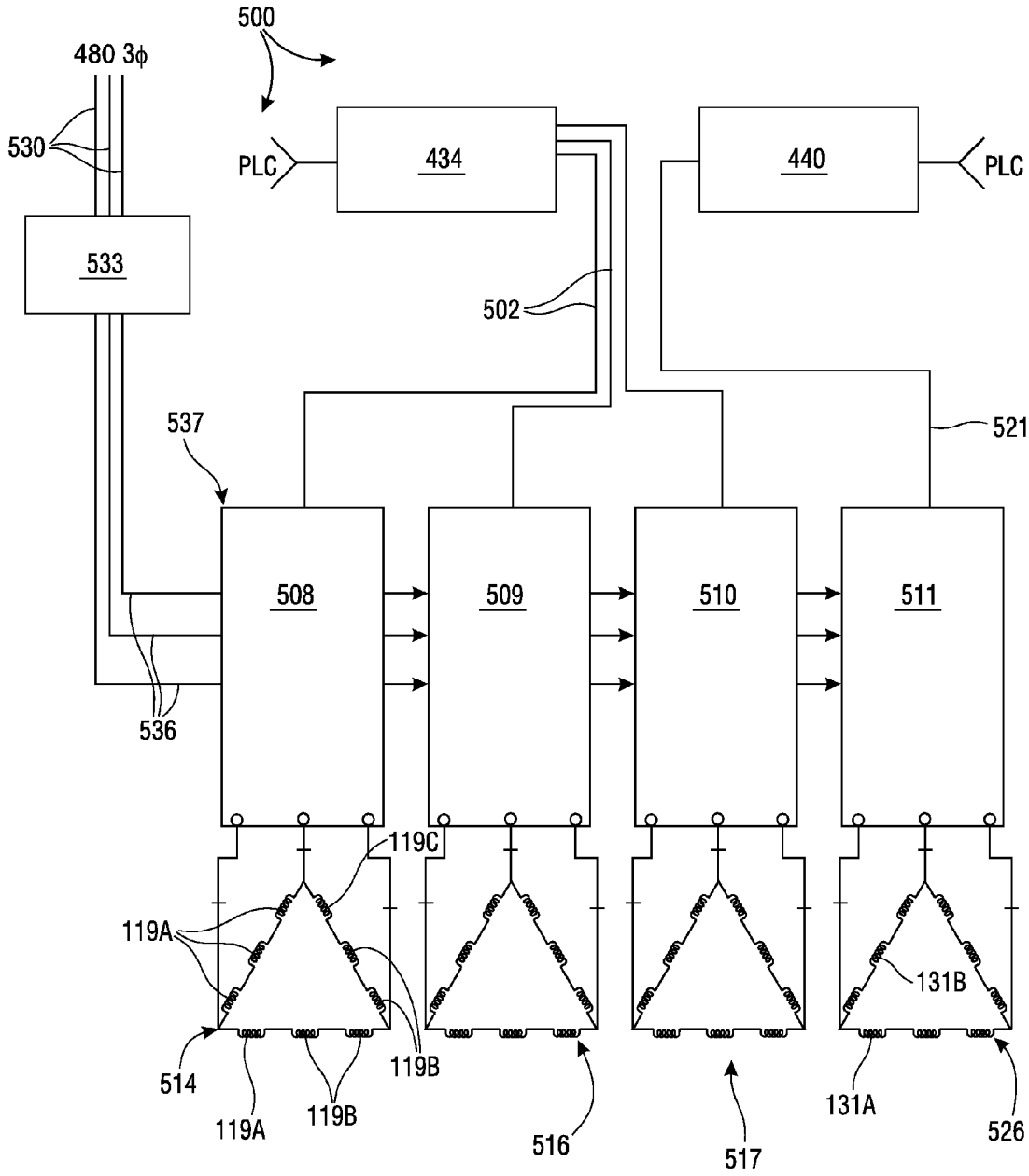
FIG. 29 is a generalized schematic diagram of the preferred electrical control system used with the high power generator, electrically showing four pressure vessel heating zones.
Figure 30:
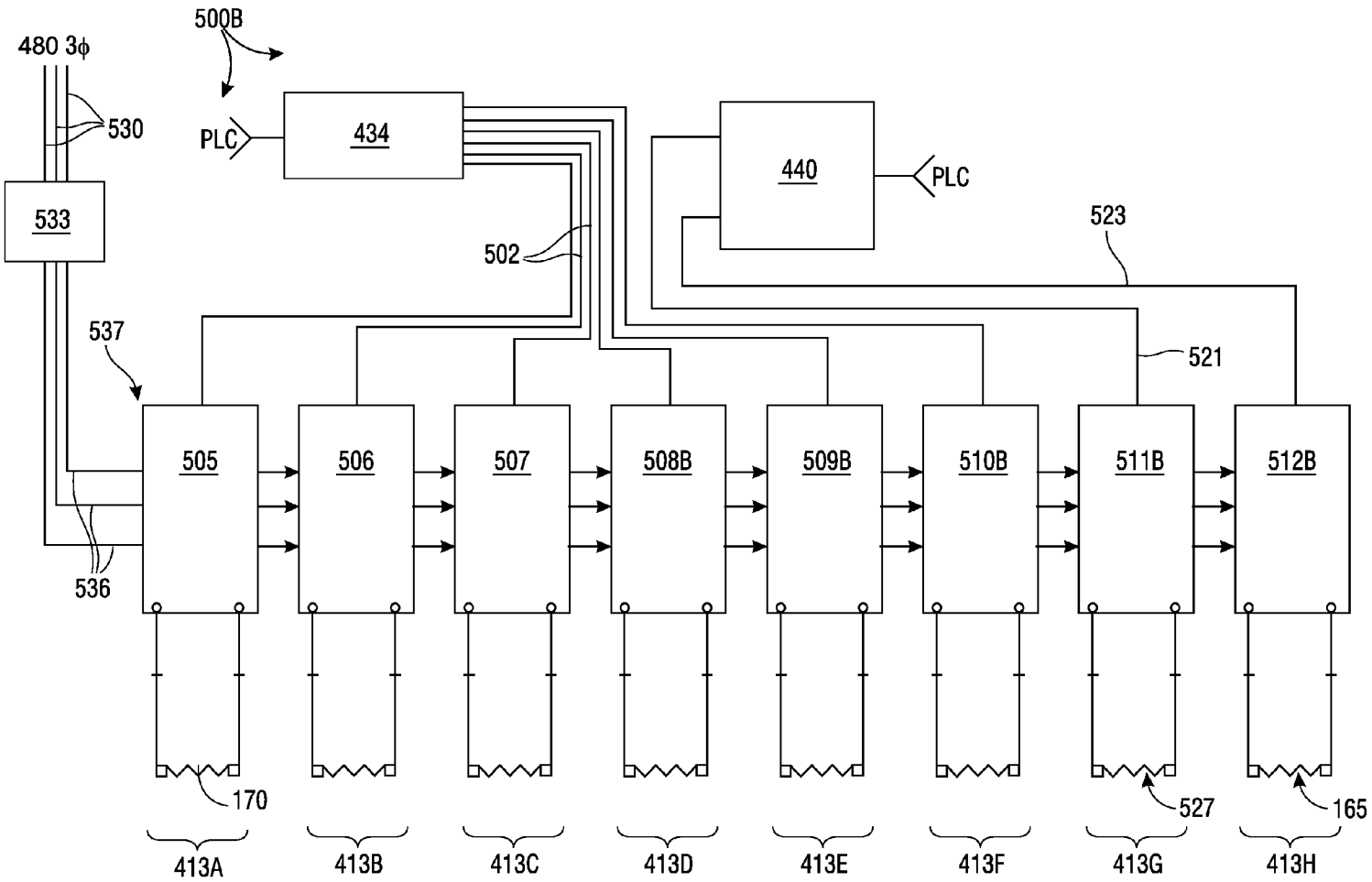
FIG. 30 is a generalized schematic diagram of the preferred electrical control system used with the reduced power generator, electrically showing seven pressure vessel heating zones and an auxiliary zone.

Referring to FIGS. 29 and 30, power control circuits associated with the high power and reduced power generator embodiments are generally designated by the reference numerals 500 and 500B respectively. In general, three phase power is used for the high power embodiment, and single phase power is utilized with the reduced power embodiment.

A PLC-activated controller 434 (i.e., FIGS. 29, 30) communicates through lines 502 with SCR power controllers directly connected to heating elements to be energized. There are four individual SCR power controllers 508-511 (FIG. 29) in the high power mode, and eight SCR power controllers 505-507, and 508B-512B in the reduced power mode (FIG. 30). In the high power mode, for example, SCR power controller 508 energizes heater elements 119A, 119B and 119C disposed around a first pair of first stage pressure vessels establishing zone 129A (i.e., FIG. 27). Other groups of heater elements are controlled by SCR controllers 509-511. The four heater elements 119A, four heating elements 119B and one heating element 119C (discussed earlier) are wired as indicated in a three-phase delta array 514 (FIG. 29) and are operated by SCR controller 508. The second and third three-phase delta arrays of first stage heater elements are respectively designated by the reference numerals 516 and 517 respectively and are driven by SCR controllers 509 and 510. Similarly, in the high power mode, the PLC-driven heater zone controller 440 (i.e., FIG. 29) controls heating of the fourth heating zone 134 (i.e., FIG. 27) associated with the second stage pressure vessel 78. Zone controller 440 block operates via control line 521 (FIG. 29) that leads to SCR controller 511 that powers electrode Delta array 526 (FIG. 29) comprising the heating elements 131A and 131B (FIG. 29) establishing the second stage heating zone 143 surrounding pressure vessel 78.

Preferably three-phase, 480 volt A.C. power is supplied on site via lines 530 (FIGS. 29, 30). Three phase electrical power is transmitted through safety block 533 comprising fuses and circuit breakers along lines 536 to the power controller blocks 508-511.

Figure 15:
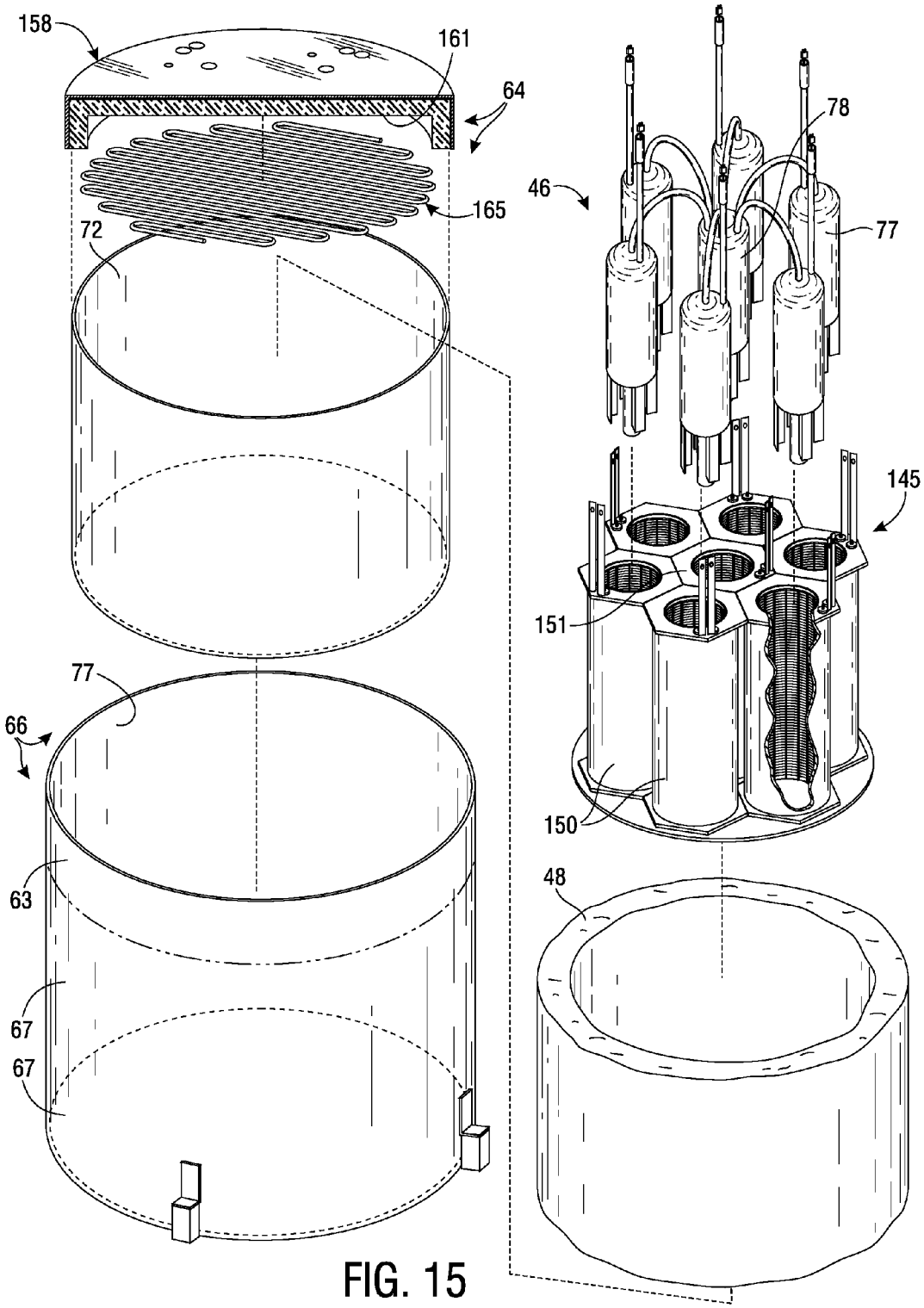
FIG. 15 is an exploded, isometric assembly view of the reduced power generator, showing parts of the containment enclosure and the steam module, with portions thereof broken away, shown in section for clarity, or omitted for brevity.

FIG. 30 reveals that in the lower power embodiment, involving the canisters 150, 151 discussed earlier, there are eight heating zones 413A-413H. The first six heating zones 413A-413F (FIG. 30) are associated with the first stage pressure vessels 77, the seventh heating zone 413G is associated with the second stage pressure vessel 78, and the eighth heating zone 413H is associated with optional heater element 165 (FIG. 15). The heating elements 170 within the previously described canisters are wired into single phase arrays, such as array 527 (FIG. 30). The seven heater zones 413A-413F used in the reduced power embodiment are also diagrammed in FIG. 28. In the reduced power embodiment, the PLC-driven heater controller 434 operates SCR controllers 506-507 and 508B-510B. Heater controller block 440 (FIG. 30) actuates SCR controller 511B associated with the second stage pressure vessel 78 via control line 521 (FIG. 29) that leads to SCR controller 511 that powers electrode array 527 (FIG. 30). Controller block 440 also operates SCR controller 512B via line 523 to operate heater 165.

Figure 31:
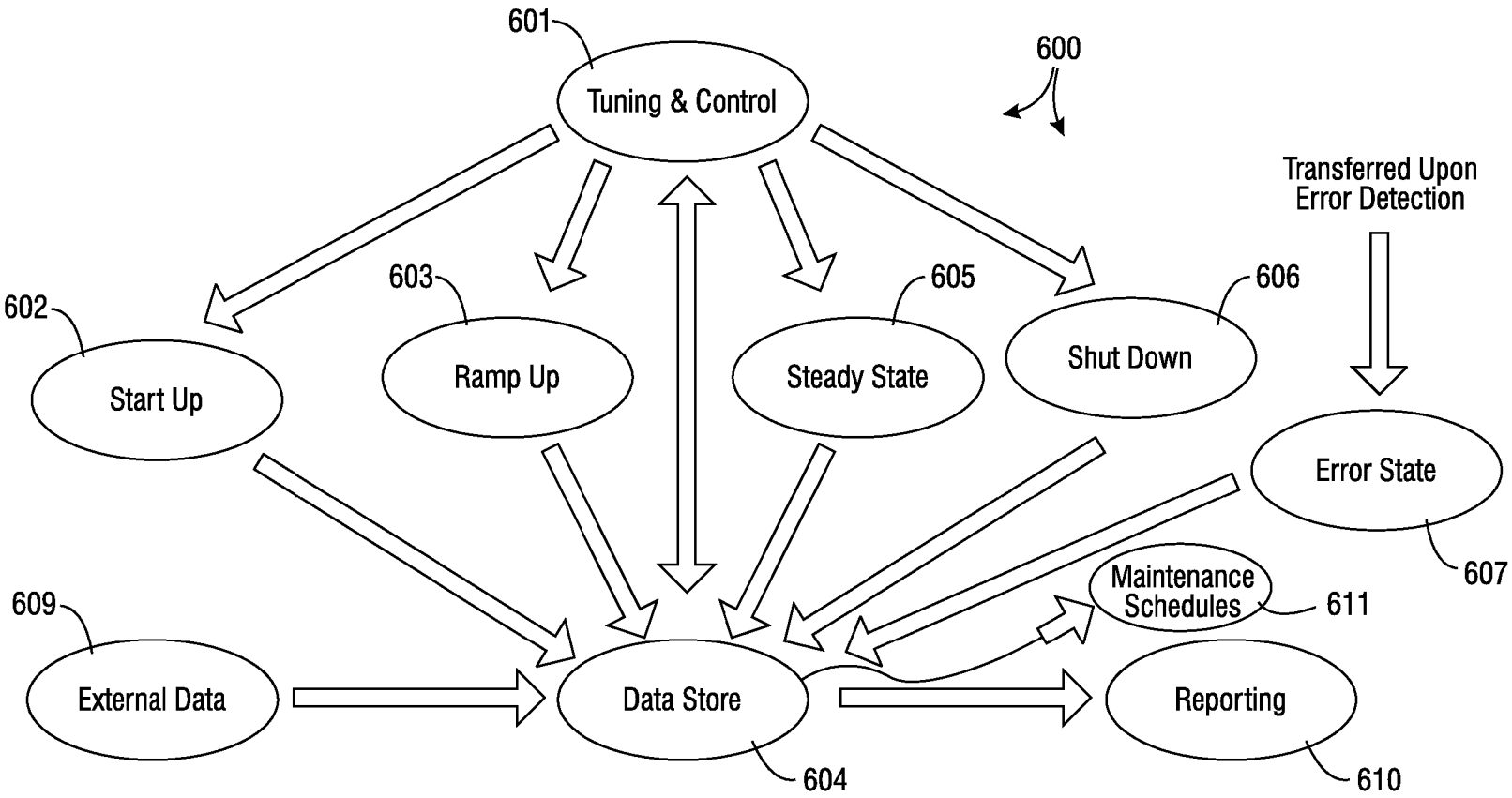
FIG. 31 is a generalized diagrammatic view of the preferred software control system.

H. Preferred Software:

Referring initially to FIG. 31, the overall SCADA (i.e., Supervisory Control and Data Acquisition) software operating program has been generally designated by the reference numeral 600. The software is preferably programmed into a Siemens SCADA (i.e., "Supervisory control and data acquisition") system. It will be apparent to those skilled in the art however, that the software algorithms below can be implemented through a variety of computer operating systems and hardware hosts.

Program 600 (FIG. 31) begins with a "tuning and control" subroutine 601 that controls all other processes and subprocesses that are explained in detail hereinafter. Steam generation begins with a "start-up" subroutine 602 that begins with diagnostic checking and then starts electrode energization and water flow. As with all other steps, "start-up" subroutine 602 reports to data storage subroutine 604. After start-up, the "ramp-up" subroutine 603 brings apparatus components up to their operation parameters, resulting in the "steady state" subroutine 605. Errors are monitored and reported in subroutine 607 and stored by subroutine 604. The tuning and control subroutine 601 can trigger the "shut down" subroutine 606 when operation is completed, or when system maintenance or repairs are necessary. The data storage subroutine 604 can accumulate external data from "External Data" step 609 and reporting subroutine 610. Maintenance schedules can be recalled and displayed in process 611.

The high level software program 600 (FIGS. 31, 32) supports various operating sub-processes, such as the basic water and steam cycle 300 (i.e., FIG. 24) involving automation, power control, and SCADA. Program 600 communicates with hardware components that turn components on or off, and adjusts operating characteristics such as pressure, water flow rate and temperature. Specific hardware such as previously discussed sensors, thermocouples and flow meters identified previously provides data such as pressure, temperature, flow rate, and continuity. This data is used to evaluate and adjust the operation of the system.

Preferably, program 600 (FIG. 32) organizes the logic into a mainline flow comprising four primary subroutines. The main line logic consists of "Start Up" subroutine 602, Ramp Up" subroutine 603, "Steady State" subroutine 605, and "Shut Down" subroutine 606. These four primary subroutines are generally executed in sequence with supporting steps when necessary.

The "Data Store" subroutine 604 (FIG. 32) is used whenever there is data or processing information available about the system. Subroutine 604 is called by every other subprocess that generates or processes data. All operational information stored by subroutine 604 (i.e., "Data Store") is transferred to the "Data Base" subroutine 612, as indicated by line 615. Subroutine 601 (i.e., "Tuning & Control") runs constantly to adjust the operation of the computer program 600 in response to historical data from "Data Base" subroutine 612 and "External Data" step 609. The "Tuning & Control" subroutine 601 writes the results of adjustments made to "Data Base" subroutine 612. "Tuning & Control" subroutine 601 communicates with the main logic subroutines 602, 603, 605, and 606 (FIG. 32) to utilize internal historical, current and external data to update algorithms, models and parameters, and to apply changes to processes. The "Tuning & Control" subroutine 601 can also run tests and record results using different parameters. Examples of information derived from "Data Base" subroutine 612 that are used by subroutine 601 include error history, and information identified by date and time. Examples of external data from step 609 (i.e., "External Data") that are used by subroutine 601 are the cost of electric power and the outside temperature. The "Tuning & Control" subroutine 601 thus processes quantities of data to minimize expense, reduce fuel consumption, and increase efficiency.

Ancillary "tuning and control reports" subroutine 618 (FIG. 32) creates reports such as performance reports, billing reports and analysis reports. Reports can be triggered internally automatically based upon events, automatically on schedule, automatically based on thresholds being reached and manually.

Figure 32:
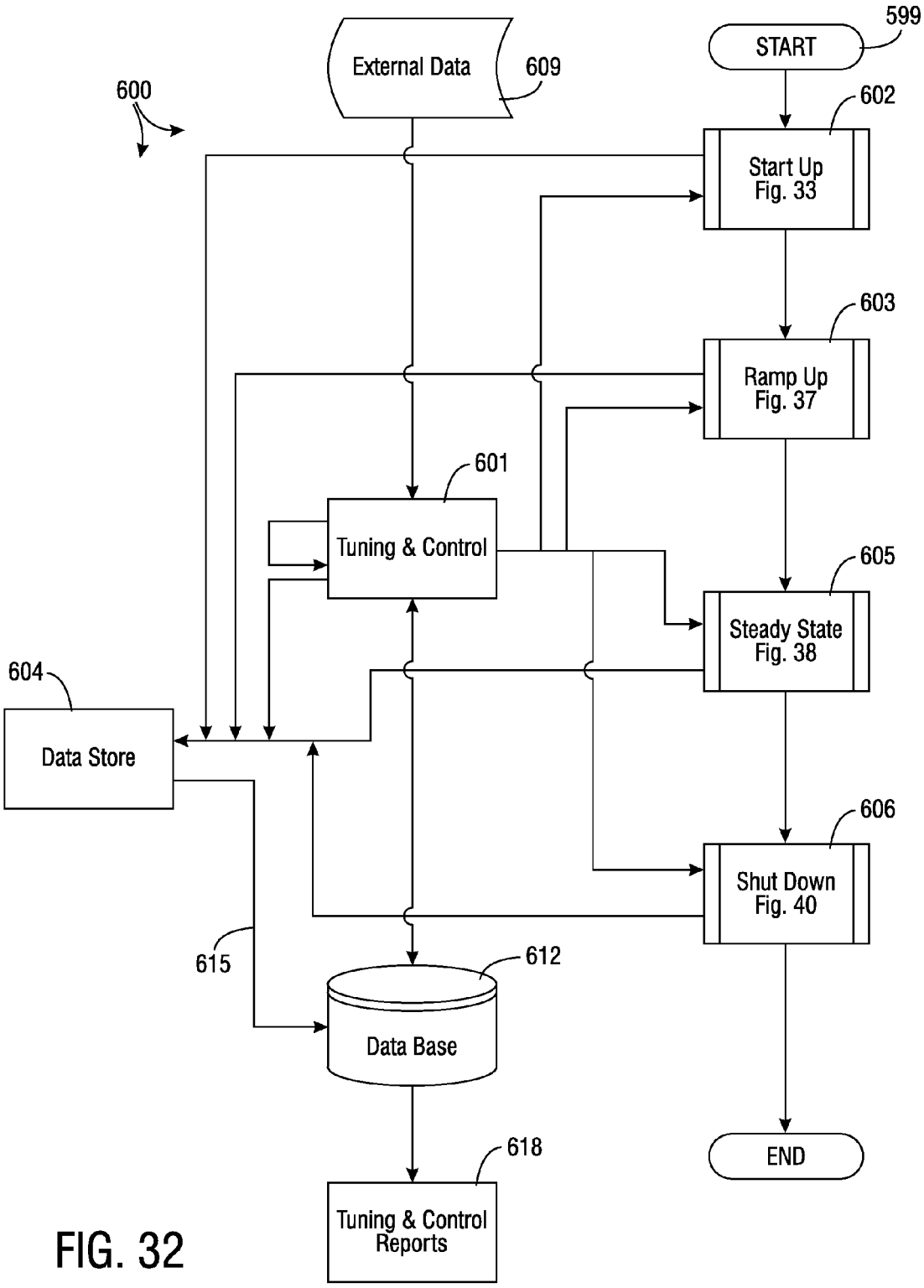
FIG. 32 is a more specific software logic flowchart detailing the software control system of FIG. 31, that shows the four major operational subroutines.
Figure 33:
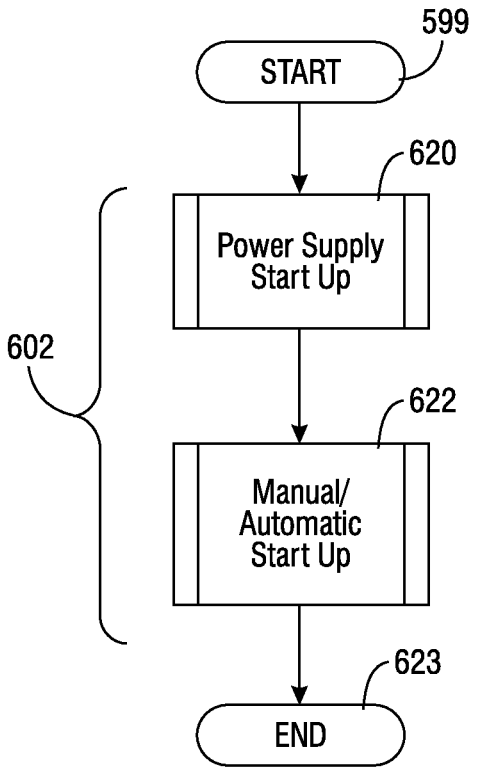
FIG. 33 is a software flowchart showing general power supply startup steps executed during the start up phase of operation detailed in FIGS. 34 and 35.

Referring to FIGS. 32 and 33, the "Start Up" subroutine 602 begins with "start" step 599 and involves all of the steps necessary up to and including turn-on of the steam generator 50. Subroutine 602 consists of a "Power Supply Start Up" subroutine 620 and "Manual/Automatic Start Up" subroutine 622 that are executed in sequence, stopping at "end" step 623 (FIG. 33). Subroutine 620 establishes the power needed to operate the system, turns all appropriate components on, establishes initial operation parameters, and starts the system. In addition, subroutine 620 (i.e., FIG. 33) performs all of the necessary steps to choose a power supply for the operation of the steam generator 50. Preferably, three-phase, 480 V.A.C. power is used.

The power supply start-up subroutine 620 (FIG. 33) comprises a subroutine 624 (FIG. 34) that establishes an onsite generator as the power source for the steam generator, and a subroutine 627 (FIG. 35) that facilitates operation from an electric connection provided by an electric utility.

The "Power Supply Start Up" subroutine 624 (FIG. 34) begins with "start" step 625 and first determines an available source of 480 V.A.C. power in decision Step 626 (i.e., " Power Source?"). The power source will be either a generator of at least 200 kW rating, or an electric utility. If the determined source of power for the system is an onsite generator, the existence of a ground connection will be manually checked in Step 628 (i.e., "Ground Connected?"). If no acceptable ground is detected, a warning to install a grounding rod will then be made in step 630 (i.e., "Install Ground Rod"). A ground continuity test is performed in Step 632 (i.e., the "Ground Continuity Test") which tests the effectiveness of the ground. The results of the test are compared against a standard in decision Step 634 (i.e., "Conductance<3.0 ohm?"). If conductance is inappropriate (i.e., ground resistance is greater than three ohms) then Step 636 (i.e., "Install Ground System") provides a warning wherein the operating technician is prompted to install an enhanced grounding system minimally comprising approximately twenty-five feet of bare copper wire coiled in a three foot deep hole in the ground. The hole is filled one foot deep with concrete and the remainder of the hole is backfilled.

Figure 34:
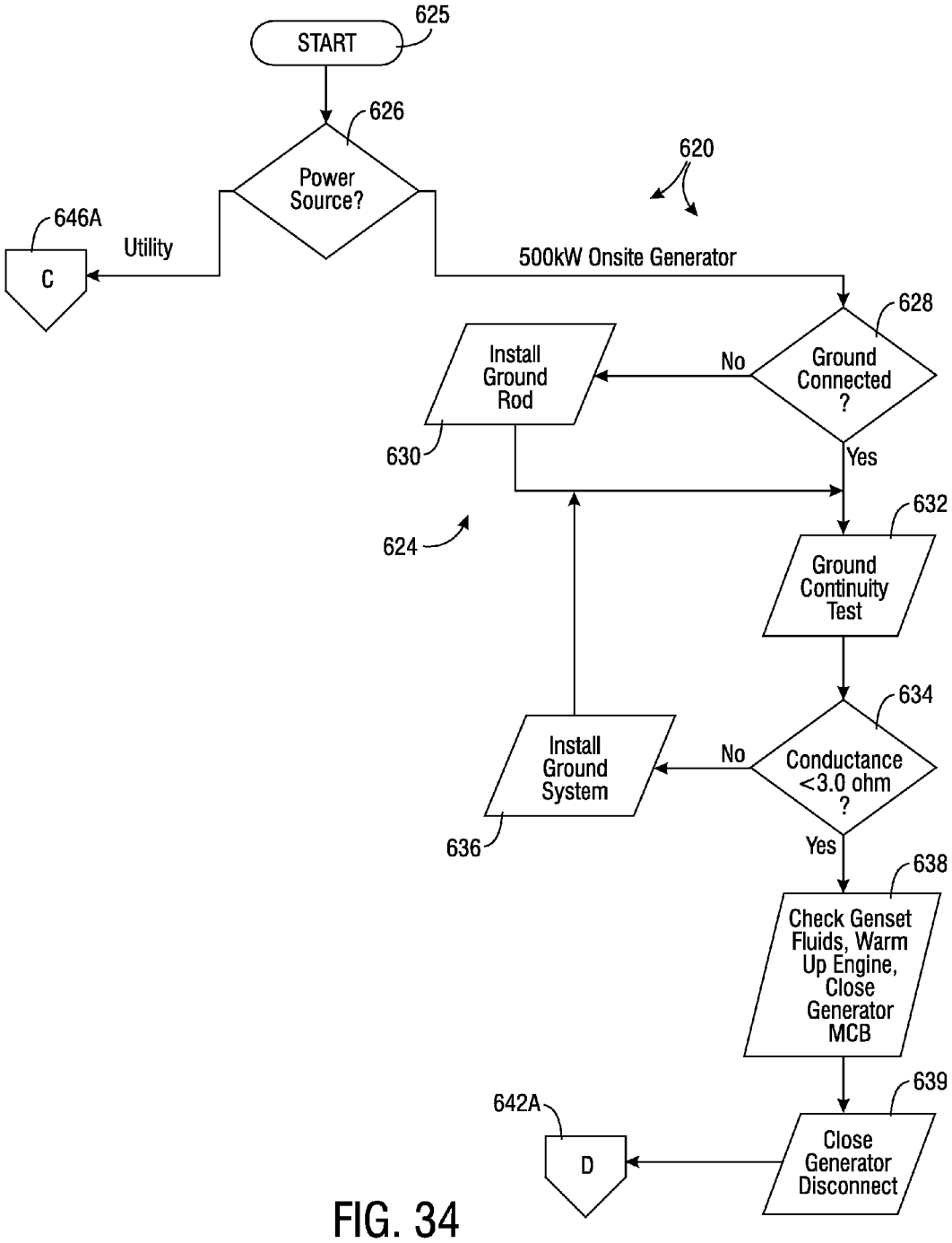
FIG. 34 is a software flowchart showing steps that can be executed during startup of an onsite generator when used as the power source for the steam generator.
Figure 35:
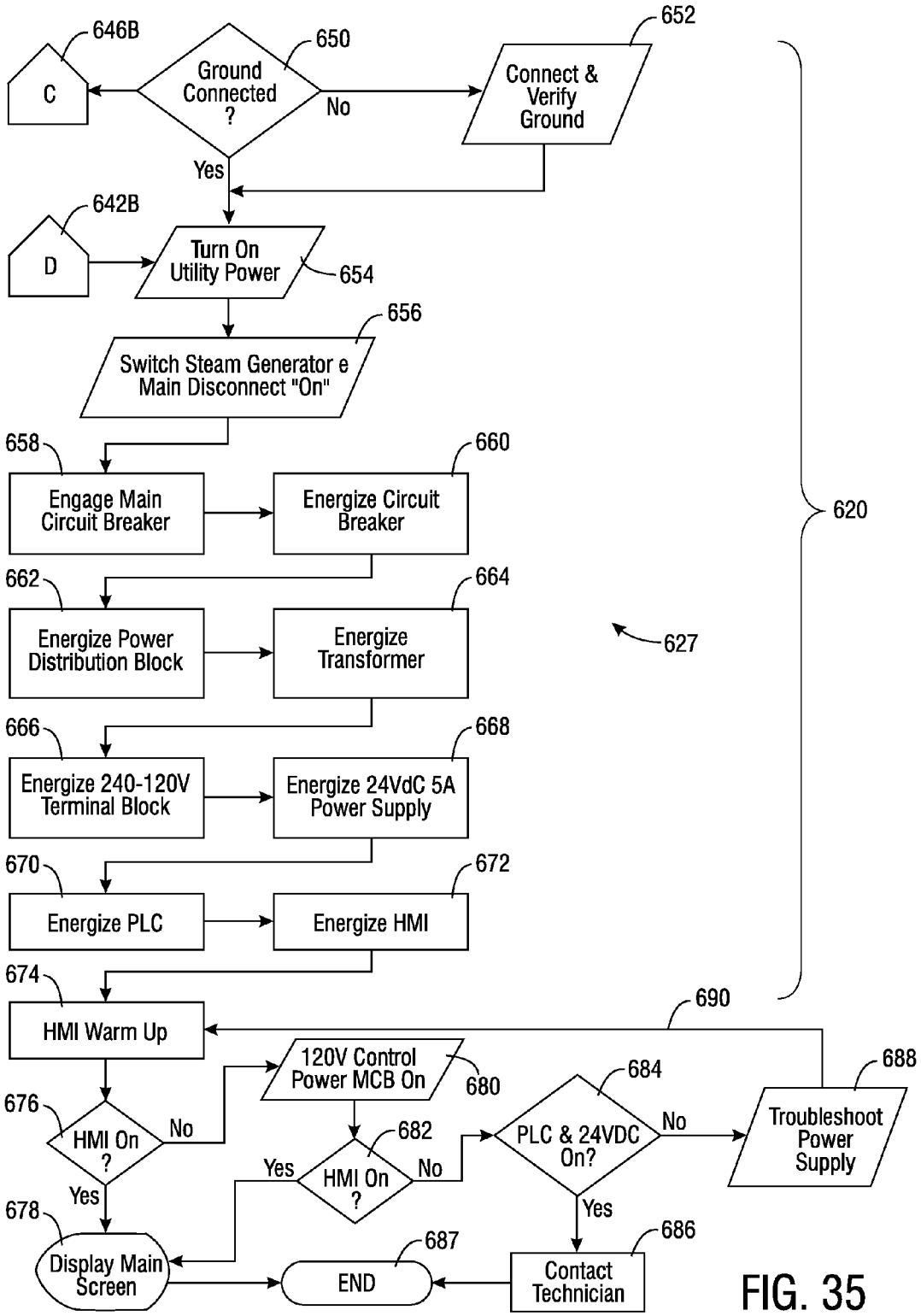
FIG. 35 is a software flowchart showing steps that can be executed during power supply startup.

If step 634 (FIG. 34) determines that ground conductance is proper, then step 638 (i.e., "Check Genset Fluids, Warm Up Engine, Close Generator MC") follows. Step 638 performs a standard set of procedures that includes checking fluids, and warming up the generator engine. The generator is connected in step 639 (i.e., "Close Generator Disconnect"). Subroutine 624 (FIG. 34) interconnects with subroutine 627 (FIG. 35) through "C" junctions 646A, 646B, and "D" junctions 642A, 642B (FIGS. 34, 35).

If subroutine 624 (FIG. 34) determines that utility power is available in step 626, subroutine 627 (FIG. 35) commences. Subroutine 627 (i.e., "Power Supply Start Up") implements the logic to establish a utility as the power source for the steam generator. Decision block 626 (FIG. 34) is routed through junctions 646A (FIGS. 32) and 646B (FIG. 35) to "ground Connected" decision block 650. If it is determined that a ground is not connected in decision Step 650 (i.e., "Ground Connected?") the technician is prompted to connect the ground in step 652 (FIG. 35), and the connection is verified. If it is determined that ground is connected in decision Step 650 (i.e., "Ground Connected?"), utility power is interconnected via in Step 654 (i.e., "Turn On Utility Power"). If an available generator is turned off and disconnected, and utility power is also available, connection blocks 642A (FIGS. 34) and 642B (FIG. 35) can trigger step 654 (FIG. 35) to turn on utility-provided electric power.

Where the power source is to be the utility, step 656 (FIG. 35) turns the main circuit breaker 533 (FIG. 29) to "On," energizing power lines 536 (FIG. 29). In step 656 (i.e., "Switch Steam Generator Main Disconnect On") the main generator circuit breaker 533 (FIG. 28) is engaged in step 658 (i.e., "Engage Main Circuit Breaker"). The result is a series of component-energizing steps including step 660 (i.e., "Energize Circuit Breaker"), step 662 (i.e., "Energize Power Distribution Block"), step 664 (i.e., "Energize 5 kVA 480/240-120V Transformer), step 666 (i.e., "Energize 240-120V Terminal Block"), Step 668 (i.e., "Energize 24 VDC 5 A Power Supply"), Step 670 (i.e., "Energize PLC"), and step 672 (i.e., "Energize HMI"). The latter steps energize power components 450, 452, and 456 (FIG. 26) to power-up the steam generator 50.

Step 672 (FIG. 35) turns on HMI (i.e., Human-Machine Interface) block 420 (FIG. 26) to communicate with the PLC 390. HMI block 420 is allowed to warm up for one minute in step 674 (i.e., "HMI Warm Up"). If the HMI is determined to be "On" in decision step 676 (i.e., "HMI On?") the main computer screen is displayed in step 678 (i.e., "Display Main Screen"). If the HMI is determined not to be "on" in decision step 676 (FIG. 35), then the 120V control power will be turned on in Step 680 (i.e., "120V Control Power MCB On") and step 682 again checks to see if the HMI is "on." If the HMI is thereafter determined to be "on" in step 682 (i.e., "HMI On?") then the main screen is displayed in screen-display step 678.

If step 682 (FIG. 35) determines that the HMI was not "on", the PLC and 24 VDC availability are checked in step 684 to verify that they are both "On" or available. If they are not "On," then a display to troubleshoot the power supply results in Step 688 (i.e., "Troubleshoot Power Supply") and HMI warm-up step 674 is reinitiated , as indicated by line 690 (FIG. 35). If the PLC is "on" and 24 VDC is available, then a screen display to contact a technician in Step 686 results and the subroutine stops with "end" step 687.

Figure 36:
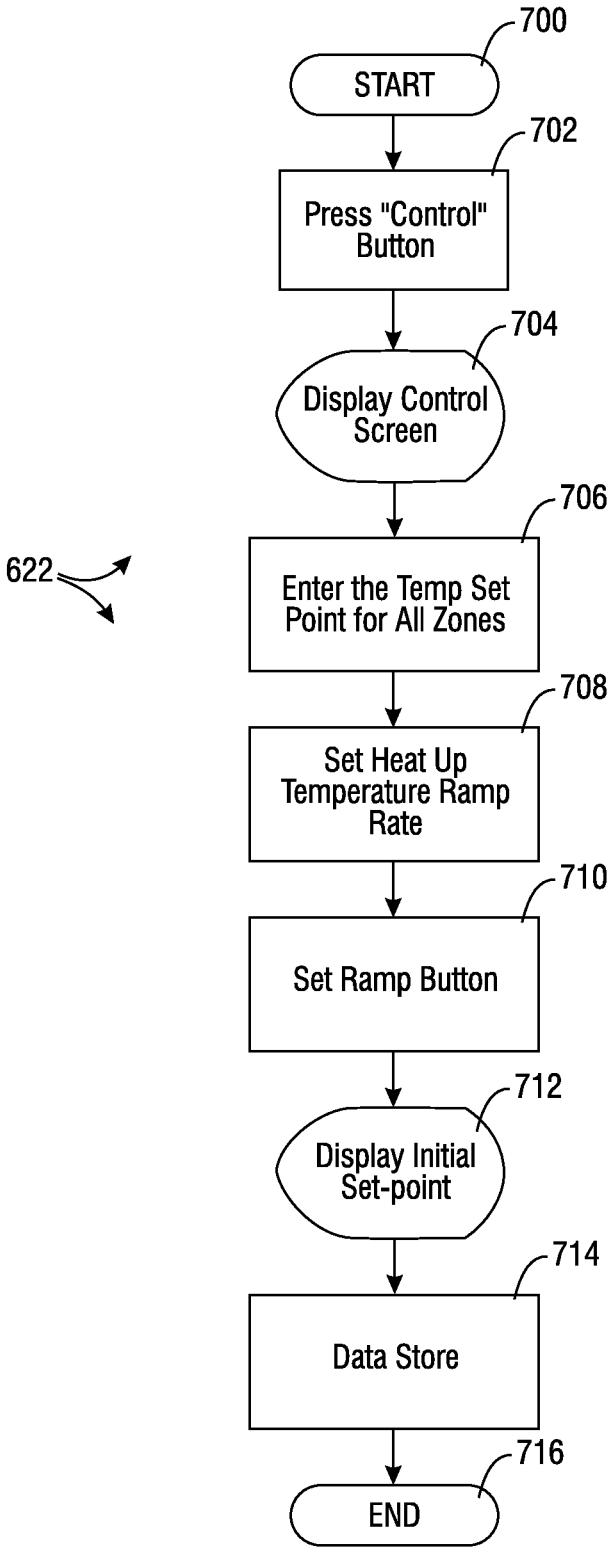
FIG. 36 is a software flowchart showing steps executed during manual start-up and initiation of the SCADA (i.e., Supervisory control and data acquisition) system.

The "Manual/Automatic Startup" subroutine 622 (FIG. 33) discussed earlier is shown in detail in FIG. 36. The Manual/Automatic Startup subroutine 622 (FIG. 36) initiates operation of the SCADA (i.e., Supervisory control and data acquisition) system and establishes initial parameters.

Subroutine 622 (FIGS. 33 and 36) begins with "start" step 700 (FIG. 36) and responds to step 702 (i.e., "Press Control Button") by displaying a control screen in Step 704 ("i.e., "Display Control Screen"). It will be recalled that first stage pressure vessels 77 are sensed by thermocouples 39B (FIG. 11). In response to the prompt displayed by the HMI after steps 702, and 704, the operator will manually enter a temperature set point in step 706, and a heat up temperature amp rate in step 708. The ramp up process is started by manually setting the ramp button in Step 710, the "Set Ramp Button" step. The initial set-point is displayed on the HMI in step 712, (i.e., "Display Initial Set-point"). The startup settings are saved to the database in step 714 (i.e., "Data Store") prior to "end" 716. This completes the "start up" subroutine of FIG. 32.

As discussed earlier, the next main subroutine discussed in conjunction with FIGS. 31 and 32 is the "Ramp Up" subroutine 603 (FIG. 37), that executes steps to take the steam generator 50 from an "off" condition to a fully operating condition at predetermined parameters, providing 480 volt three phase power is available. In normal operation, the "Ramp Up" subroutine is a one time, preliminary event that occurs only prior to start-up. It monitors processes and establishes an operating environment with established parameters.

Figure 37:
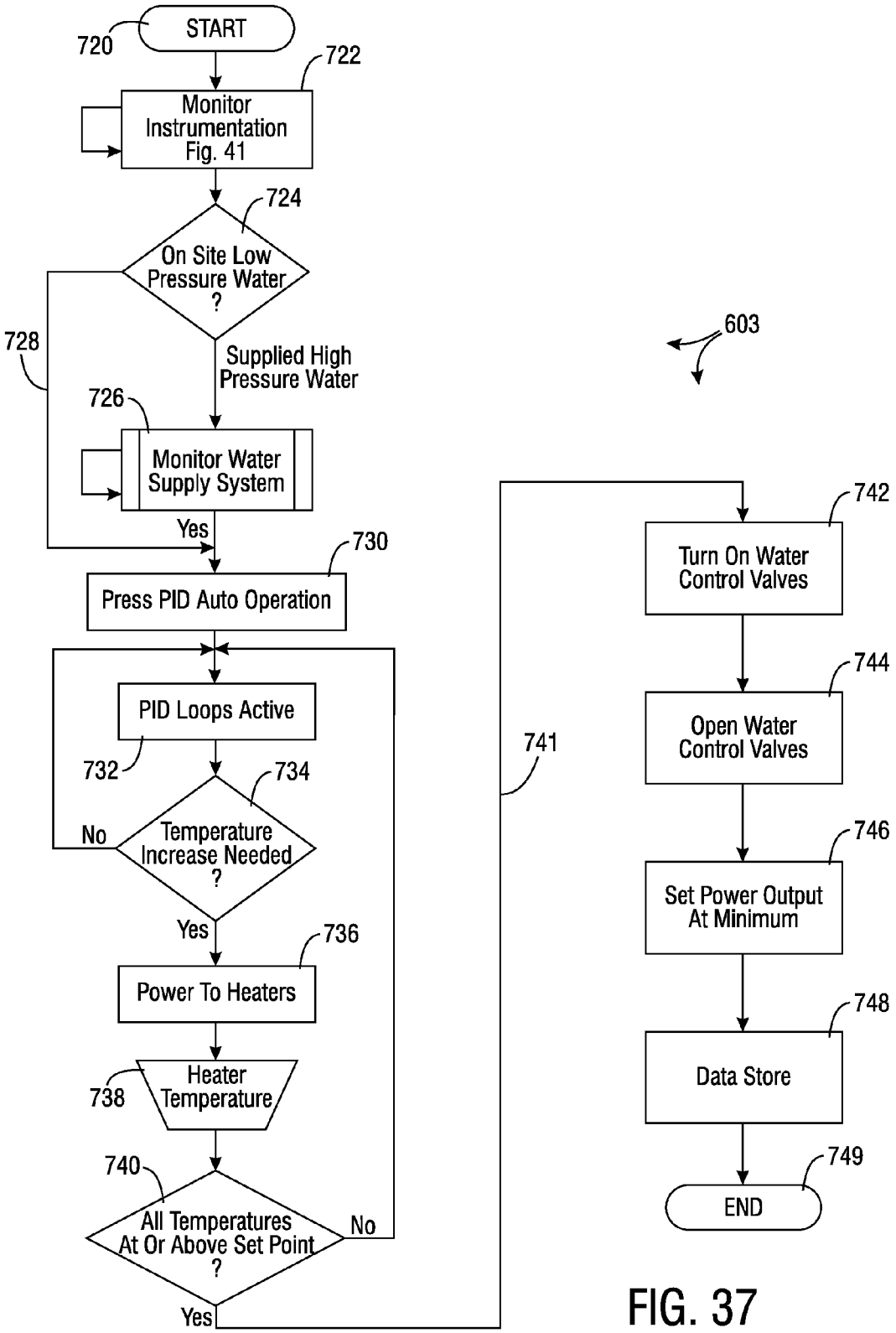
FIG. 37 is a software flowchart showing steps executed during the "Ramp Up" phase of operation wherein the steam generator is switched from an "off" condition to a fully powered operating condition.

As seen in FIG. 37, "Ramp Up" subroutine 603 begins with start step 720 and monitors instrumentation constantly in Step 722. The HMI screen 420 displays the on/off status of the main pump 352 (FIG. 25). The water supply is determined in step 724 (i.e., "On Site Or Supplied Water?") and if the water source is high pressure. "supplied water" (i.e., from local pressure lines) then the water system is monitored constantly in subroutine 726 (i.e., "Monitor Water Supply System"). If instead, is a supply of "on site", low pressure water, in a storage tank, for example, then the water system is not monitored and subroutine 726 is skipped, as indicated by line 728.

In step 730 (FIG. 37) the operator is prompted by the HMI display 420 (FIG. 26) to manually initiate automatic operation. A PID ("Proportional Integral Derivative") control algorithm is utilized for automated control, and is initiated in step 730 (i.e., "Press PID Auto Operation.") A proportional-integral-derivative (PID) controller is a generic, control loop feedback mechanism known in the art that is widely used in industrial control systems. A PID controller calculates an "error" value as the difference between a measured process variable and a desired set point. The controller attempts to minimize the error by adjusting the process control inputs. In the absence of knowledge of the underlying process, a PID controller has historically been considered desirable. By tuning the three parameters in the PID controller algorithm, the controller can provide control action designed for specific process requirements.

Activated PID Loops are caused to be displayed by the HMI in Step 732 (i.e., "PID Loops Active"). If it is determined that a temperature increase is needed in Step 734 (i.e., "Temperature Increase Needed?") then power is sent to the first stage heating elements 119A-119C of the appropriate first stage heaters in step 736 (i.e., "Power To Heaters"). Thermocouples 39A monitor the temperature and feed information to PLC390 and thus into the corresponding PID loop.

If it is determined that a temperature increase is not needed in step 734, then continual temperature monitoring occurs. When the temperatures monitored in step 738 (i.e., "Heater Temperature") are all at or above set point as determined by step 740 (i.e., "All Temperatures At Or Above Set Point?"), steps 742 and 744 follow as indicated by line 741. One or more water control valves 379A-379F (FIG. 27) are first powered by step 742 ("Water Control Valves Active") and then turned on (i.e., opened) in step 744 ("Open Water Control Valves"). Thus, when control valves 379A-379F (FIG. 27) are opened, water from the manifold 370 is available for the first stage pressure vessels 77. Flow meters 376A-376F and pressure sensors 378A-378F measure the flow and pressure and report this data back to the PLC input cards 377 and 411 (FIG. 26) respectfully.

Concurrently, the power is set at a minimum (initially 15%) in "Set Power Output At Minimum" step 746 (FIG. 37). Information about date, time and status among other data is sent to the database in "Data Store" step 748 (FIG. 37) with "end" at step 749. Power during "ramp up" is limited to 50% to minimize surge currents and heater element stress. Steps 736 and 746 of FIG. 37 instruct controllers 508, 509, 510 and 511 (FIG. 29), for example, to vary outputted heater element voltage.

Figure 38:
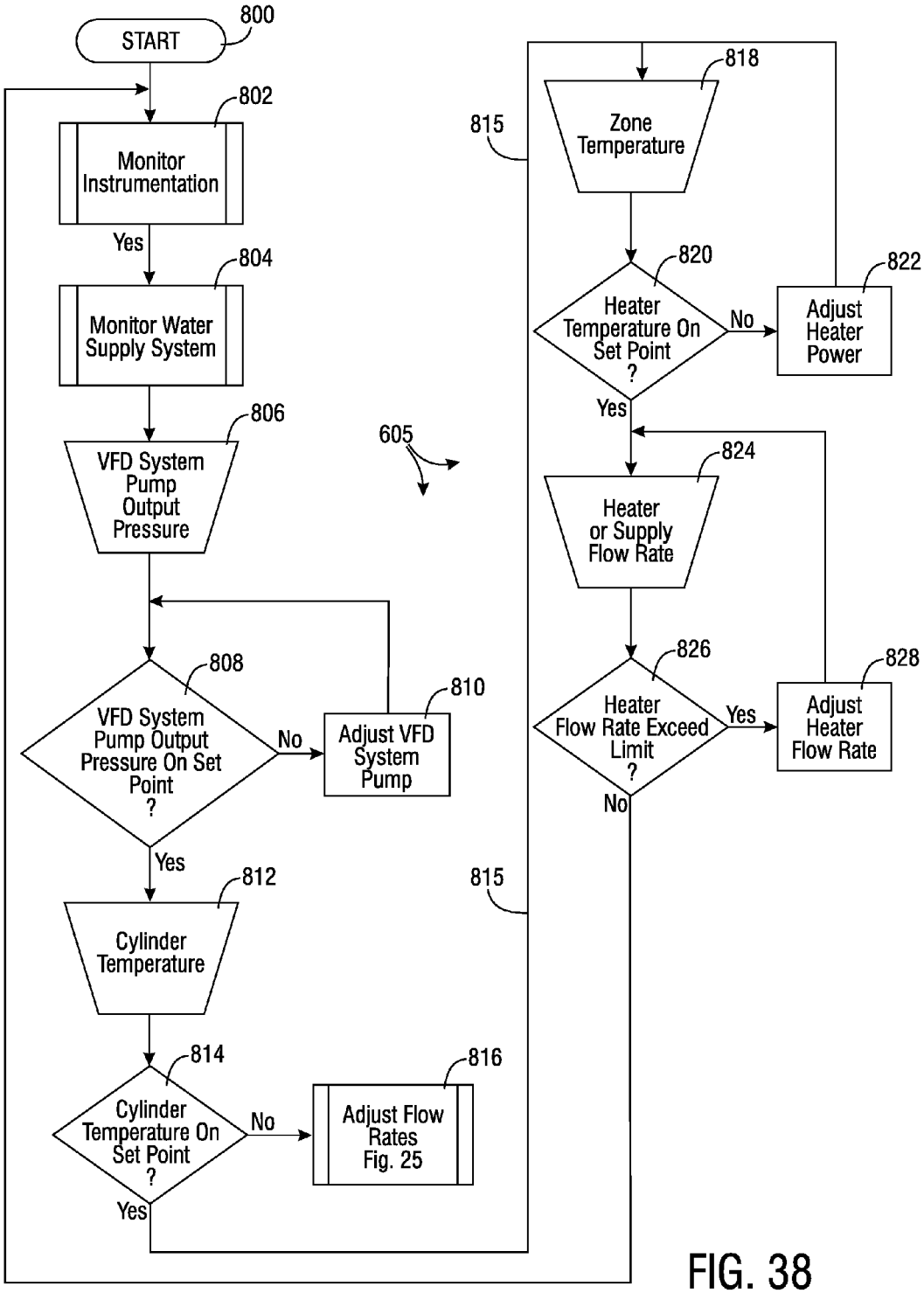
FIG. 38 is a software flowchart showing steps that are repeatedly executed during "Steady State" operation.

The "Steady State" subroutine 605 (i.e., FIGS. 32, 38) governs normal operation. Referring to FIG. 38, "start" step 800 is followed by "Steady State" steps that are performed repeatedly while the steam generator 50 operates at predetermined "steady state" levels. Constant monitoring assures that all components are operating. Software implemented adjustments in conjunction with the PID processes are made constantly to assure that the components are operating at specified levels. The goal of the control system is to maintain a preselected operating temperature in regions surrounding the heating elements, and within the first stage pressure vessels 77.

The goal is accomplished in two ways. First, the temperatures are monitored by "R-type" thermocouples 39A, analyzed by the PLC 390 (FIG. 26), and instructions are sent to the appropriate PLC block and SCR controller (i.e., FIG. 30) to increase or decrease power to heating elements in that zone. For example, the high power embodiment has heating zones 129A-129C and 134 seen in FIG. 27; these are controlled by block 434 and SCR controllers 508-511 (FIG. 29). Secondly, pressure vessel temperatures are monitored by "K-type" thermocouples 39B (i.e., FIG. 6) entering pressure vessels 77. Any change in temperature in a pressure vessel is noted, analyzed by the PLC 390, and instructions are generated and sent to the appropriate water flow control valve 379A-379F (FIG. 28) to increase or decrease water flow through bus 373A (FIG. 28) to control one or more pressure vessels 77. Water flow is monitored by 376A-376F whose bus connection 377A (FIG. 28) leads to PLC input card 377.

Referring again to FIG. 38, during steady state operation the instrumentation is monitored constantly in step 802 (i.e., "Monitor Instrumentation") as a continuation of the previously discussed ramp up subroutine 603. If the water system is supplied as determined by step 724 (i.e., "On Site, low pressure, or Supplied Water, high pressure?) in FIG. 37, then the water system is monitored constantly in "Monitor Water Supply System" step 804 (FIG. 38). However, if there is on site water, then the water system is not monitored as indicated by line 728 (FIG. 37).

The output pressure from VFD system pump 368 (FIG. 25) is monitored by sensor by 374 and line 375 (FIG. 25) is sensed by the PLC 390. Output pressure determined from step 806 (i.e., VFD System Pump Output Pressure") in FIG. 38 is compared to the Set Point in step 808 (i.e., "VFD Pump Output Pressure On Set Point?). If the VFD system pump output pressure does not equal the pressure set point, the VFD pump 368 (FIG. 25) is adjusted by step 810. This step is executed by hardware PLC interface 389 (FIG. 26) that drives VFD drive controller 388.

Continuing with FIG. 38, heater temperatures sensed from the thermocouples 39B (i.e., FIGS. 6, 8) are called in step 812. Cylinder temperature is checked against the set point in step 814 (i.e., "Heater Temperature On Set Point?). If the temperature is on the set point, the process continues via path 815 and checks other operating conditions. If the temperature is not on the set point, then the water flow rates are adjusted to modulate temperature in step 816 (i.e., "Adjust Flow Rates"). Thus, water flow rate is varied to influence electrode temperature. As discussed earlier (i.e., FIG. 26) PLC 390 commands blocks 388 and 389 to vary water pressure with the VFD system pump 368 (FIG. 25.)

Thermocouples 39A (i.e., FIG. 3) are called in step 818 (i.e., Heater Upper Temperature") of FIG. 38. Temperature is compared to the calculated heater temperature set point in step 820 (i.e., "Heater Temperature On Set Point?"). If the heater temperature is not on the set point, the heater electrode power will be adjusted in step 822 (i.e., "Adjust Heater Power"). In this instance, with the high power embodiment, the PLC 390 (FIG. 26) driving blocks 430, 438 actuates SCR controllers 508-511 (FIG. 29) with controller blocks 434 and 440 (FIG. 29).

In FIG. 38 when the heater temperature is on the set point, the heater supply flow rate provided in step 824 (i.e., "Heater Supply Flow Rate") is compared to the heater flow rate limit in step 826 (i.e., " Flow Rate Exceed Limit?). In the best mode, flow rate is derived from indicators 376A-376F (i.e., FIG. 38) via bus 377A leading to PLC block 377 (FIG. 26) An alternative method is to use a single flow meter 372 FIG. 28 to measure gross flow rate. If the flow rate exceeds the limit, the flow rate is adjusted in Step 828 (i.e., "Adjust Heater Flow Rate"). Flow rate adjustment is made through bus 373A (FIG. 27) associated with control valves 379A-379F. If the pressure vessel flow rate does not exceed the limit, then control is returned to the start of Steady State.

Figure 39:
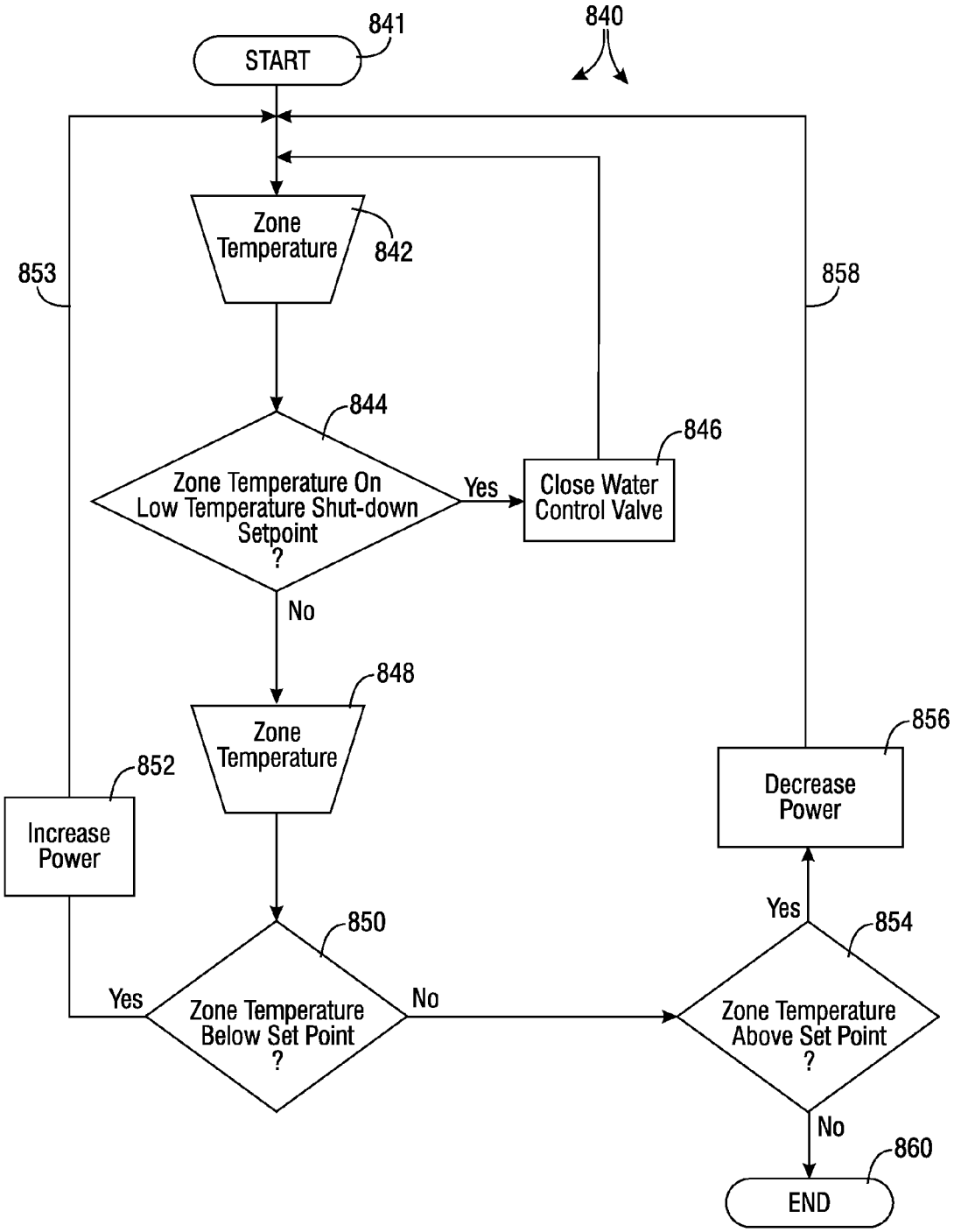
FIG. 39 is a software flowchart showing steps executed during an "Adjust Flow Rates" subprocess of FIG. 38 to adjust the temperatures in the steam generator using water flow rates.

FIG. 39 shows the detailed "Adjust Flow Rates" process 840 used by the steady state subroutine 605 (FIG. 38). Subroutine 840 adjusts temperatures in the pressure vessels 77 using water flow rates. After start 841 the heater temperatures read in step 842 (i.e., "Heater Temperature") are compared to settings in step 844 (i.e., "Heater Temperature on Low Temperature Shut down Setpoint). If a sensed temperature is too low, a water control valve 379A-379F (FIG. 27) feeding a corresponding pressure vessel is closed in step 846 (i.e., "Close Water Control Valve") to stop all water from flowing into a given pressure vessel to prevent flooding. In this instance, PLC 390 (FIG. 26) instructs PLC drive control block 412 to adjust one or more of the six, in-line water control valves 379A-379F (FIG. 27) via control bus 373A. The latter check is a safety shutoff currently set at fifteen degrees below the set-point for a given heater. 412

Again referring to FIG. 39, if the heater temperature is above the Shut-down Set-point then the heater temperatures read in step 848 (i.e., "Cylinder Temperature") are compared to the heater temperature set point in step 850 (i.e., " Temperature Below Set Point?"). Each heater zone can be temperature-varied independently of the others. Preferably however, operating temperatures of the first stage heater zones involving pressure vessels 77 are set the same. The temperature set-point of heater zone 134 (i.e., FIG. 27) involving second stage pressure vessel 78 is preferably set fifty percent (50%) higher, but this can be adjusted for optimal performance. If the sensed heater temperature is below the cylinder set-point temperature, the power will be increased in step 852 (i.e., "Increase Power") that returns on 853 to "Start" 841. If the temperature is not below the set-point in step 850 it is checked to see if it is above the set point in step 854 (i.e., "Cylinder Temperature Above Set Point?"). If it is above the set point the power will be decreased in step 856 (i.e., "Decrease Power") with return via 858 to "start" 841. If the temperature is not above set point the process ends at 860.

Figure 40:
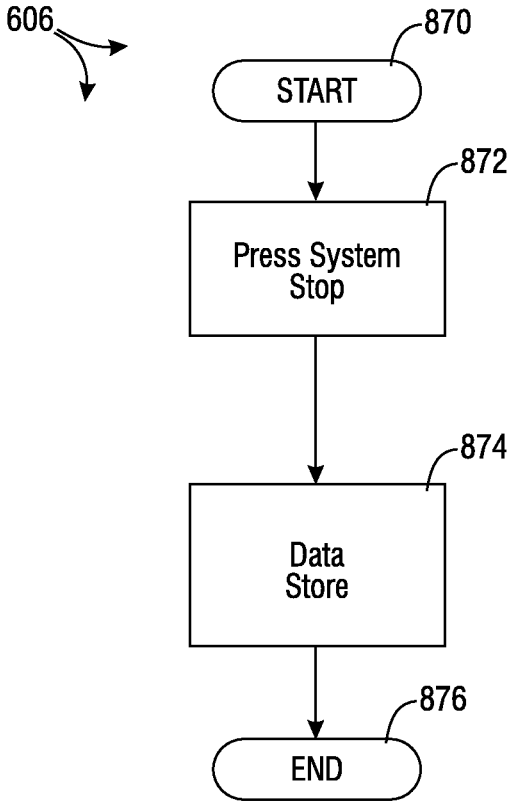
FIG. 40 is a software flowchart showing steps executed during the "Shut Down" subroutine wherein heating stops, water flow ceases, and the hardware cools.

FIG. 40 details the preferred "Shut Down" subroutine 606 referenced previously in discussion relating to FIGS. 31 and 32. Shut Down occurs at the end of a job, when a severe error occurs, or when maintenance or repairs are necessary. All heating and water flow are stopped, and the hardware is allowed to cool. After "Start" 870 the "Shut down" subroutine 606 waits for an instruction in step 872 wherein an operator can input a stop signal by pressing "System Stop" on the computer screen to turn all settings to zero and "off." This will stop all flow of water and power to the operational components. The data regarding the shutdown is stored in the database in step 874 (i.e., "Data Store") prior to "end" step 876.

Figure 41:
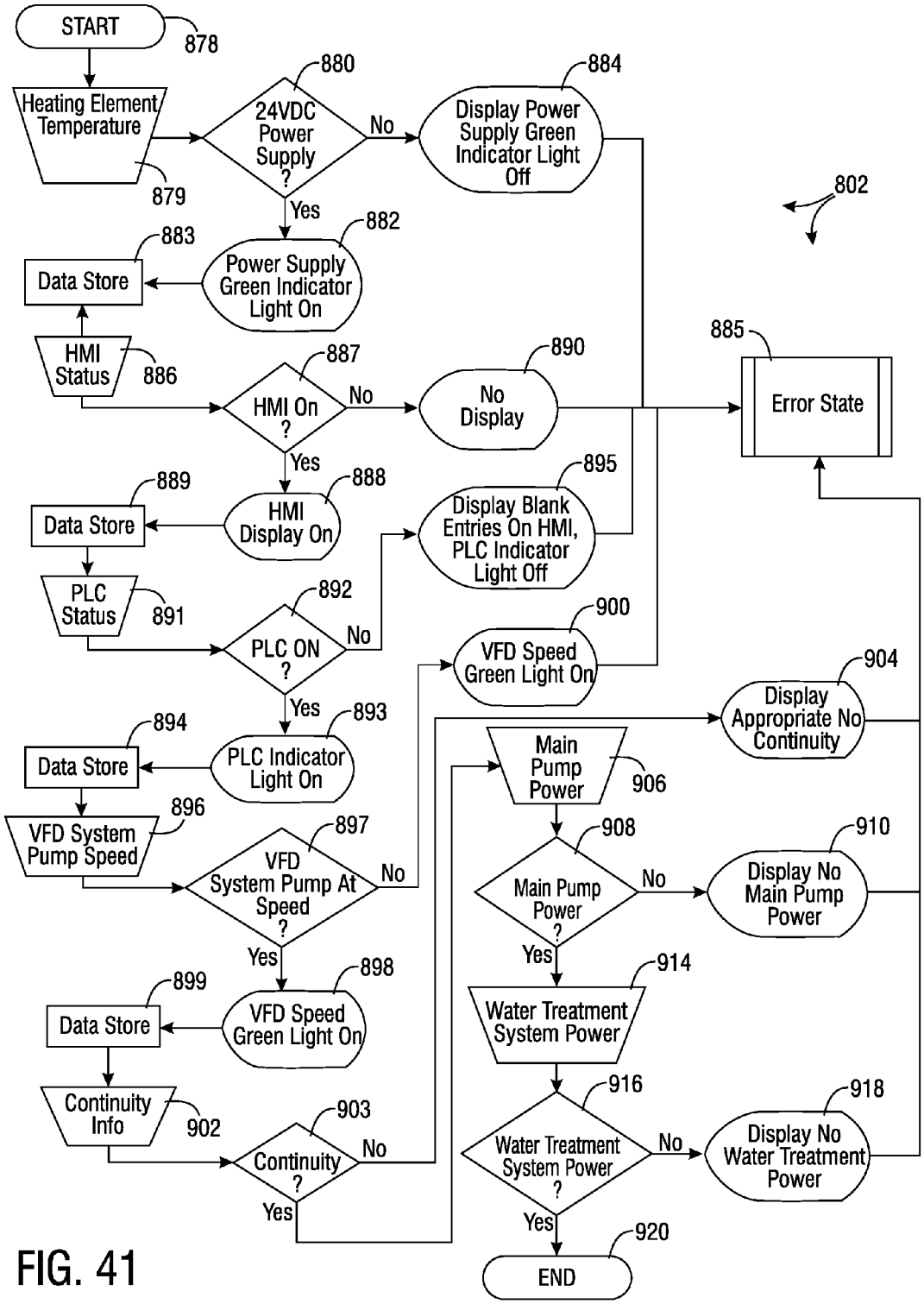
FIG. 41 is a software flowchart showing "Monitor Instrumentation" steps wherein all of information from input sensors and electrical components are monitored.

FIG. 41 details the "Monitor Instrumentation" step 802 (FIG. 38) discussed earlier. All of the information from input sensors and electrical components is monitored to assure that all of the components are "on" and operating appropriately. After "start" 878 the heater temperatures are checked in step 879. Then, the status of the 24 VDC power supply (i.e., part of block 450 in FIG. 26) is checked in step 880 (i.e., "24 VDC Power Supply?") and if the power is determined to be on, a power supply indicator light (currently a green light) is displayed brightly on the HMI in step 882 (i.e., "Power Supply Green Indicator Light On"). This information is stored in the data base in step 883 (i.e., "Data Store"). If the 24 VDC power is determined to be off in step 880, the indicator light is not brightly illuminated on the HMI, as represented by step 884, and control is transferred to the error processing module step 885 (i.e., "Error State.")

In FIG. 40 HMI (i.e., "Human Machine Interface") status is queried in step 886 (i.e., "HMI Status") and if the HMI is determined to be on in step 887, then the HMI display is presented in step 888 (i.e., "HMI Display On"). This information is stored in the data base in step 889 (i.e., "Data Store"). If the HMI display is determined to be off in step 887, then there will be no data displayed in step 890 (i.e., "No Display") and control is transferred to the error processing step 885.

The status of the PLC power supply is provided in step 891 (i.e., "PLC Status") and if power is determined to be "on" in step 892 ("PLC On?"), a power supply indicator light is displayed by step 893 (i.e.,"PLC Indicator Light On") on the HMI. This information is stored in the data base in step 894 (i.e., "Data Store"). If the PLC power is determined to be off in step 892 then display step 895 (i.e., Display Blank Entries On HMI, PLC Indicator Light Off) is executed, and all HMI entries are blank (i.e., the indicator light is "off") and control is transferred to the error processing step 885.

Referencing FIG. 41, the status of the VFD system pump speed is provided in step 896 (i.e., "VFD system pump Speed"), and if the VFD system pump is determined to be at speed in step 897 (i.e., "VFD System Pump At Speed?") then a VFD speed light (currently green) on the HMI is lit in step 898 (i.e., "VFD Speed Green Light On"). This information is stored in the data base in step 899 (i.e., "Data Store"). If the VFD system pump is determined not to be at speed in step 897, then a VFD speed light (currently green) on the HMI is turned off in Step 900 (i.e., "VFD Speed Green Light Off"). This information is also stored in the data base. Step 902 provides continuity information for the VFD system pump pressure sensor 374 (FIG. 25), the water flow meters 376A-376F (i.e., FIG. 28), the water flow control valves 379A-379F (FIG. 28), and thermocouples 39A and 39B. The status of each of these is individually checked in step 903 (i.e., "Continuity?"). If one or more does not have continuity, then an appropriate error message is displayed for each component without continuity in step 904. and control is passed to error Step 885.

Power status of the main pump 356 (FIG. 25) is checked in step 906 (i.e., "Main Pump Power"). If there is no main pump power as determined by step 908 (i.e., "Main Pump Power?"), then a message stating "No Main Pump Power" is displayed on the HMI by step 910 and control is transferred to the error processing step 885. Processing continues when there is power.

The power status of the water treatment block 362 (FIG. 25) is provided in step 914 (i.e., "Water Treatment Power"). If there is no water treatment power as determined by step 916 (i.e., Water Treatment System Power?") then a "no water treatment" power message is displayed on the HMI in step 918 and control is transferred to the error processing step 885. Control is returned to the calling process when there is water treatment power resulting in End 920.

Figure 42:
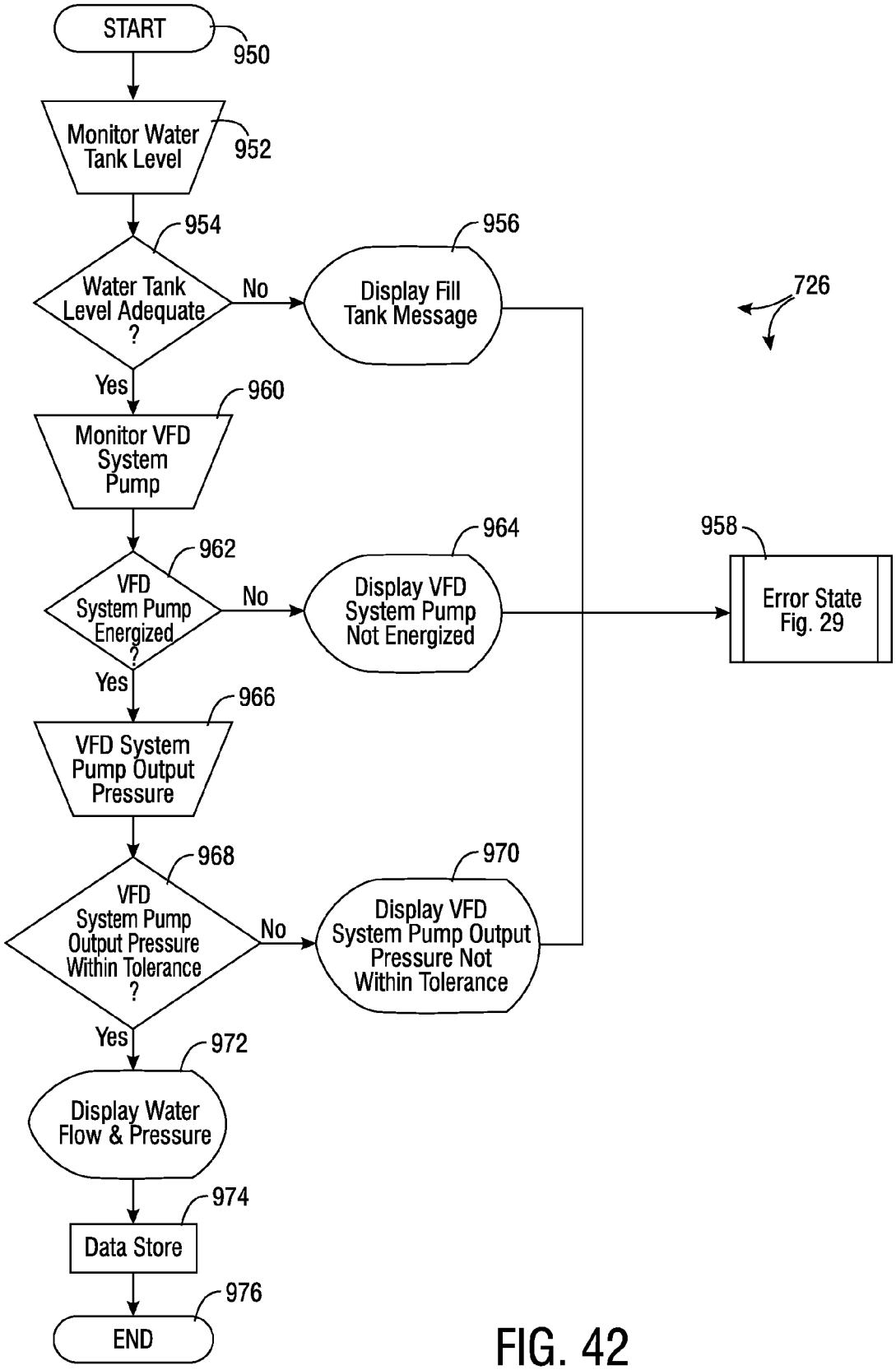
FIG. 42 is a software flowchart progressively showing steps executed in a "Monitor Water Supply System" used when water is supplied by storage tanks, that assures a sufficient water supply and proper storage tank pump operation; and, FIG. 43 is a software flowchart showing the preferred "Error State" subroutine.

FIG. 42 details the "Monitor Water Supply System" subroutine 726 discussed before that is shown in FIG. 37. Subroutine 726 assures that the water supply system has water and that the main pump 352 (FIG. 25) is working correctly. This is only done when water provided by holding tanks rather than by a utility or external pressure source. Such tanks will have a pump for filling them.

After "start" 950 (FIG. 42) the water tank level is determined in step 952 (i.e., "Monitor Water Tank Level"). The water tank level is checked in step 954 (i.e., "Water Tank Level Adequate?"). If the level is not adequate, a visual "fill tank" message is displayed on the HMI by step 956 and control is transferred to the error processing step 958 (i.e., " Error State"). VFD system pump energized status is provided in step 960 (i.e., "Monitor VFD System Pump"). The VFD system pump status is checked in step 962 (i.e., "VFD System Pump Energized?"). If the pump is not energized, a "pump not energized" message is displayed on the HMI by step 964 and control is transferred to the error processing step 958.

Step 966 (FIG. 42) monitors output pressure on the VFD system pump 368 (FIG. 25), which is compared to established tolerances in step 968 (i.e., "VFD System Pump Output Pressure Within Tolerance?"). If inadequate pressure from VFD pump 968 is determined, as sensed by sensor 374 (FIG. 25), step 970 causes a display entitled "VFD System Pump Output Pressure Not Within Tolerance"). Step 972 causes water flow and pressure to be displayed. "Data store" step 974 and "End" step 976 follow.

Figure 43:
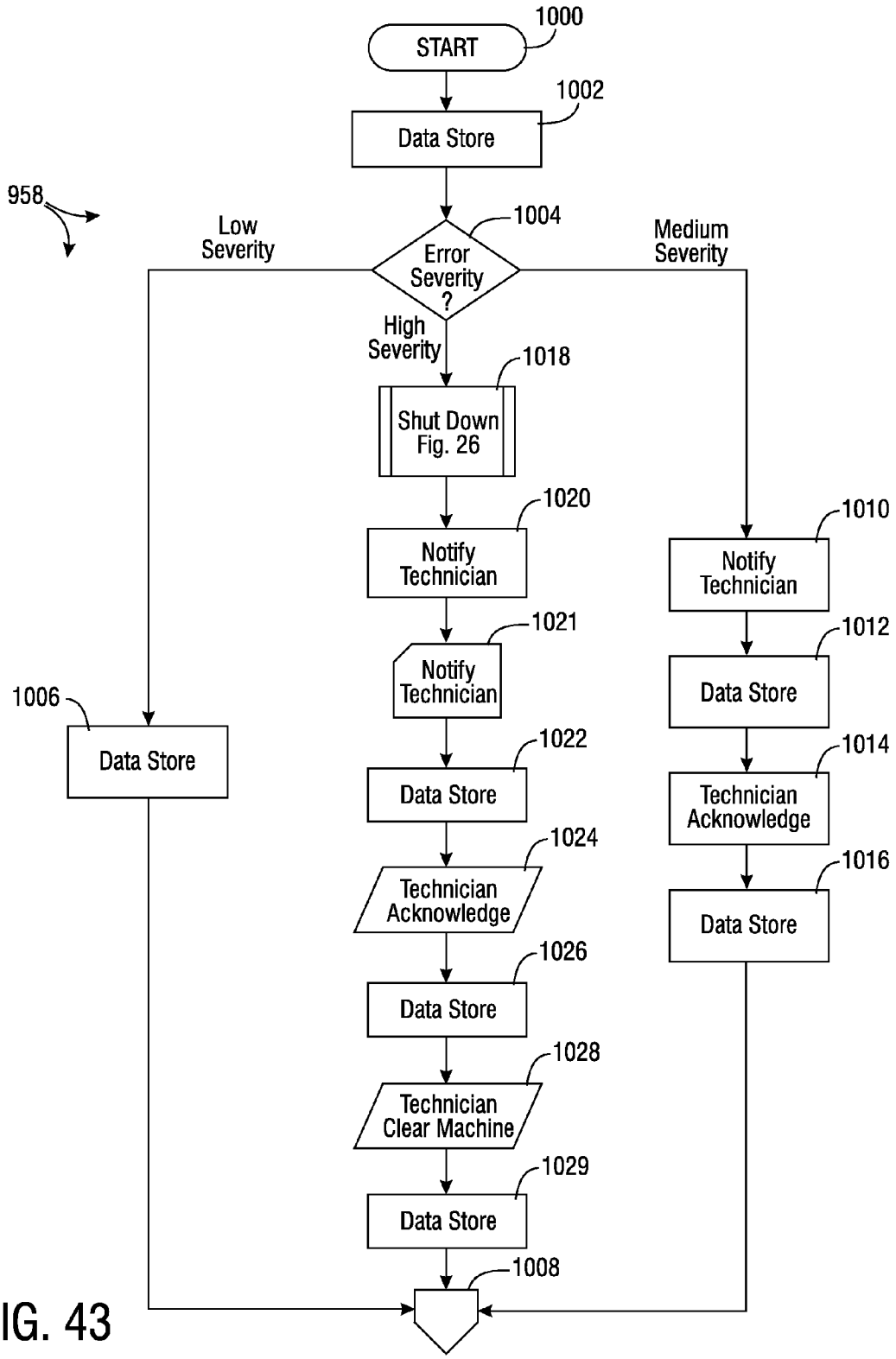

FIG. 43 details the "Error State" subroutine called often in the process that has been discussed previously. For example, this subprocess is designated by the reference numeral 958 in FIG. 42. An error state is called whenever any step identifies a condition outside of normal operating conditions. All errors are sent to the error state subroutine 958 (FIG. 43) that handles both expected and planned-for errors as well as unexpected situations. The error state subroutine handles the error as designed and returns control to the calling process.

After "start" 1000 the error state subroutine first stores all received information in the database in step 1002. Based upon algorithms, business practices, procedures and needs, and impact or severity of the error is determined in step 1004 (i.e., "Error Severity?"). The processing in step 1004 is part of the Siemens SCADA software for PLC hardware control. In general the errors are divided into three levels of severity.

Error severity is classified here as either "low severity," "medium severity" and/or "high severity." The low severity errors require either no attention or only scheduled action. In this case the data will be stored in the database in step 1006. Regular generated reports will notify appropriate service personnel of any issues generated by the low severity errors. Control is returned to the process that transferred control to the error state in step 1008 entitled "Return To Calling Process."

Medium severity errors (FIG. 43) require the attention of a service person, a maintenance staff, or a technician. The appropriate staff is notified in step 1010 (i.e., "Notify Technician."). The data will be stored in the database in step 1012 (i.e., "Data Store"). Staff will acknowledge the error in step 1014 (i.e., "Technician Acknowledge"). The data will be stored in the database in step 1016. Control is returned to the process that transferred control to the error state in step 1008.

High severity errors (FIG. 43) require the operation to be shut down via "Shut Down" step 1018 invoking the shut down subroutine 606 discussed earlier. These errors are of a nature that the operation can no longer run safely or effectively. The appropriate staff is notified through steps 1020 and 1021 (i.e., "Notify Technician"). The data will be stored in the database in Step 1022. An appropriate staff member will acknowledge the error in step 1024 (i.e., "Technician Acknowledge"). The data will be stored in the database in step 1026. Staff will clear the machine in step 1028 after resolution to the error has been implemented. The data will be stored in the database in step 1029 and control is returned to the process that transferred control to the error state in step 1008.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method for producing superheated steam, the method comprising the steps of :

providing a plurality of pressure vessels;

heating the pressure vessels with a plurality of heating elements;

sensing temperatures proximate said vessels;

providing water to said pressure vessels through a water distribution manifold connected through individual water delivery lines leading to said pressure vessels;

feeding water to said water distribution manifold at selectable pressures with a variable pressure system pump;

energizing said heating elements during operation of said generator with a power control circuit;

operating said variable pressure system pump, and energizing said power control circuit with a PLC computer system; and, discharging superheated steam.

2. The method as defined in claim 1 including the steps of:

obtaining incoming through either a high or low pressure water source;

selecting whether a high or low pressure source has been connected with valves;

if low pressure water source has been utilized, pumping in the water and providing it to the variable pressure pump;

preheating incoming water; and, subjecting water to reverse osmosis treatment prior to delivery to said variable pressure pump.

3. The method as defined in claim 1 wherein said feeding step employs a Variable Frequency Drive pump.

4. The method as defined in claim 3 including the step of driving said pump with a variable-speed drive controller operated by said PLC computer system.

5. The method as defined in claim 3 wherein said step of providing a plurality of pressure vessels comprises the steps of:

providing a plurality of first stage pressure vessels and at least one second stage pressure vessel;

feeding steam from said first stage pressure vessels to said second stage pressure vessel;

delivering water to said first stage pressure vessels from said water distribution manifold through separate water delivery lines.

6. The method as defined in claim 5 including the steps of monitoring the water flow in said water delivery lines and providing flow information to said PLC computer system.

7. The method as defined in claim 5 including the steps of opening or closing the water delivery lines with control valves in response to said PLC computer system.

8. The method as defined in claim 7 including the steps of monitoring the water flow in said water delivery lines and providing flow information to said PLC computer system.

9. The method as defined in claim 5 including the steps of sensing pressure on each of said water delivery lines and providing pressure information to said PLC computer system.

10. The method as defined in claim 5 including the step of preventing backflow with one-way, check valves in said water delivery lines.

11. The method as defined in claim 5 including the steps of providing each water delivery line with:

control valves that enable or disable the water flow through said water delivery lines in response to said PLC computer system;

pressure sensors that monitor water pressure in said water delivery lines and provide pressure information to said PLC computer system; and, flow indicators that monitor water flow to individual pressure vessels and provide flow information to said PLC computer system.

12. The method as defined in claim 11 further comprising the steps of operating software with the PLC computer system and establishing:

a "start-up" subroutine for beginning generator operation;

a "ramp up" subroutine for initially checking the water supply, water flow and available electrical power;

a "steady state" subroutine for monitoring normal operational parameters and for storing them in a data storage system; and, a "shut down" subroutine, which turns components off in a proper sequence that avoids damage and prevents overheating.

13. The method as defined in claim 12 wherein the "start-up" subroutine performs functions selected from the group consisting of: diagnostic checking, determining available power, determining the availability of a proper ground, establishing electric power connections, providing power to the various circuit breakers and power supplies and transformers, and initialization of said PLC automation system.

14. The method as defined in claim 12 wherein the "ramp up" subroutine performs functions selected from the group consisting of: energizing the power control circuit to activate heating elements, checking for a proper water supply, monitoring heater temperature, opening water control valves, and monitoring water flow and water pressure.

15. The method as defined in claim 12 wherein the "steady state" subroutine performs functions selected from the group consisting of: monitoring operational parameters. storing data in a data storage system, controlling water supplied by said variable pressure pump, and determining temperatures by monitoring thermocouples.

16. A method for producing superheated steam, the method comprising the steps of :

providing a plurality of first stage pressure vessels;

providing at least one second stage pressure vessel;

radiantly heating the first stage and second stage pressure vessels with a plurality of heating elements;

delivering steam from said first stage pressure vessels to said at least one second stage pressure vessel;

monitoring system temperatures proximate said vessels;

providing water to said first stage pressure vessels through a water distribution manifold connected through individual water delivery lines leading to said first stage pressure vessels;

feeding water to said water distribution manifold at selectable pressures with a variable pressure system pump;

monitoring water pressure;

energizing said heating elements during operation of said generator with a power control circuit;

operating said variable pressure system pump and energizing said power control circuit with a PLC computer system in response to system temperature and water pressure; and, discharging superheated steam from said at least one second stage pressure vessel.

17. The method as defined in claim 16 including the steps of:

obtaining source water through either a high or low pressure water source;

selecting whether a high or low pressure source has been connected with valves;

if low pressure water source has been utilized, pumping in the water;

preheating incoming water; and, subjecting water to reverse osmosis treatment prior to delivery to said variable pressure pump.

18. The method as defined in claim 16 wherein said feeding step employs a Variable Frequency Drive pump.

19. The method as defined in claim 18 including the step of driving said pump with a variable-speed drive controller operated by said PLC computer system.

20. The method as defined in claim 16 including the steps of monitoring the water flow in said water delivery lines, providing flow information to said PLC computer system, and varying said variable frequency drive pump pressure in response to said flow information.

21. The method as defined in claim 16 including the steps of opening or closing the water delivery lines with control valves in response to said PLC computer system.

22. The method as defined in claim 16 including the steps of monitoring water pressure in said water delivery lines, providing said water line pressure information to said PLC computer system, and varying said variable pressure system pump output pressure in response to said water line pressure information.

23. The method as defined in claim 16 including the step of preventing backflow with one-way, check valves in said water delivery lines.

24. The method as defined in claim 16 including the steps of providing each water delivery line with:

control valves that enable or disable the water flow through said water delivery lines in response to said PLC computer system;

pressure sensors that monitor water pressure in said water delivery lines and provide pressure information to said PLC computer system; and, flow indicators that monitor water flow to individual pressure vessels and provide flow information to said PLC computer system.

25. The method as defined in claim 24 wherein said feeding step employs a Variable Frequency Drive pump, and wherein the PCL computer system adjusts said Variable Frequency Drive pump in response to said pressure sensors and flow indicators.

26. The method as defined in claim 16 further comprising the steps of operating software with the PLC computer system and establishing:

a "start-up" subroutine for beginning generator operation;

a "ramp up" subroutine for initially checking the water supply, water flow and available electrical power;

a "steady state" subroutine for monitoring normal operational parameters and for storing them in a data storage system; and, a "shut down" subroutine, which turns components off in a proper sequence that avoids damage and prevents overheating.

27. The method as defined in claim 26 wherein the "start-up" subroutine performs functions selected from the group consisting of: diagnostic checking, determining available power, determining the availability of a proper ground, establishing electric power connections, providing power to the various circuit breakers and power supplies and transformers, and initialization of said PLC automation system.

28. The method as defined in claim 26 wherein the "ramp up" subroutine performs functions selected from the group consisting of: energizing the power control circuit to activate heating elements, checking for a proper water supply, monitoring heater temperature, opening water control valves, and monitoring water flow and water pressure.

29. The method as defined in claim 26 wherein the "steady state" subroutine performs functions selected from the group consisting of: monitoring operational parameters. storing data in a data storage system, controlling water supplied by said variable pressure pump, and determining temperatures by monitoring thermocouples.

30. A method for producing superheated steam, the method comprising the steps of :

providing a plurality of first stage pressure vessels;

connecting outputs from said first stage vessels to at least one second stage pressure vessel;

radiantly heating the first stage pressure vessels and said at least one second stage pressure vessels with a plurality of heating elements;

providing water to said first stage pressure vessels through a water distribution manifold connected through individual water delivery lines leading to each of said first stage pressure vessels;

feeding water to said water distribution manifold at selectable pressures with a variable pressure system pump;

monitoring system pump water pressure;

energizing said heating elements during operation of said generator with a power control circuit;

monitoring system temperatures proximate said vessels;

operating said variable pressure system pump with a PLC computer system in response to system water pressure; and, energizing said power control circuit with said PLC computer system in response to system temperature; and, discharging superheated steam from said at least one second stage pressure vessel.

31. The method as defined in claim 30 wherein said feeding step employs a Variable Frequency Drive pump.

32. The method as defined in claim 30 including the step of varying said power control circuit with said PLC computer system in response to system pump pressure.

33. The method as defined in claim 30 including the steps of monitoring the water flow in said water delivery lines, providing flow information to said PLC computer system, and varying said variable frequency drive pump pressure in response to said flow information.

34. The method as defined in claim 30 including the steps of opening or closing the water delivery lines with control valves in response to said PLC computer system.

35. The method as defined in claim 30 including the steps of monitoring water pressure in said water delivery lines, providing said water line pressure information to said PLC computer system, and varying said variable pressure system pump output pressure in response to said water line pressure information.

36. The method as defined in claim 30 including the steps of providing each water delivery line with:

control valves that enable or disable the water flow through said water delivery lines in response to said PLC computer system;

pressure sensors that monitor water pressure in said water delivery lines and provide pressure information to said PLC computer system; and, flow indicators that monitor water flow to individual pressure vessels and provide flow information to said PLC computer system.

37. The method as defined in claim 36 wherein said feeding step employs a Variable Frequency Drive pump, and wherein the PCL computer system adjusts said Variable Frequency Drive pump in response to said pressure sensors and flow indicators.

* * * * *